US010396460B2

(12) United States Patent
Kosaka et al.

(10) Patent No.: US 10,396,460 B2
(45) Date of Patent: Aug. 27, 2019

(54) MULTIBAND ANTENNA AND WIRELESS COMMUNICATION DEVICE

(71) Applicant: NEC Corporation, Minato-ku, Tokyo (JP)

(72) Inventors: Keishi Kosaka, Tokyo (JP); Hiroshi Toyao, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/762,124

(22) PCT Filed: Sep. 15, 2016

(86) PCT No.: PCT/JP2016/004216

§ 371 (c)(1),
(2) Date: Mar. 22, 2018

(87) PCT Pub. No.: WO2017/056437

PCT Pub. Date: Apr. 6, 2017

(65) Prior Publication Data

US 2018/0269577 A1 Sep. 20, 2018

(30) Foreign Application Priority Data

Sep. 29, 2015 (JP) ..... 2015-190531

(51) Int. Cl.
*H01Q 5/10* (2015.01)
*H01Q 19/17* (2006.01)
(Continued)

(52) U.S. Cl.
CPC ..... *H01Q 5/10* (2015.01); *H01Q 5/45* (2015.01); *H01Q 5/48* (2015.01); *H01Q 13/10* (2013.01);
(Continued)

(58) Field of Classification Search
CPC .. H01Q 5/10; H01Q 5/45; H01Q 5/48; H01Q 13/10; H01Q 15/00; H01Q 19/17;
(Continued)

(56) References Cited

U.S. PATENT DOCUMENTS

2017/0040689 A1* 2/2017 Toyao ..... H01Q 13/10

FOREIGN PATENT DOCUMENTS

JP 1993-082119 U 11/1993
JP 1993-082120 U 11/1993
(Continued)

OTHER PUBLICATIONS

International Search Report for PCT Application No. PCT/JP2016/004216, dated Nov, 22, 2016.
(Continued)

*Primary Examiner* — Andrea Lindgren Baltzell

(57) ABSTRACT

When a plurality of antenna elements tuned to respective different frequency bands are closely disposed, the performance (the band, the radiating pattern, and so on) of each antenna element may deteriorate. In order to solve the problem, a multiband antenna according to the present invention is provided with: a conductive reflection plate; a frequency selective surface that is disposed so as to at least partially face the conductive reflection plate, that transmits therethrough electromagnetic waves in a first frequency band, that reflects thereon electromagnetic waves in a second frequency band that is a higher frequency band than the first frequency band, and that has a plurality of openings; a plurality of first antenna elements that are disposed in a region sandwiched between the conductive reflection plate and the frequency selective surface and that are tuned to a first frequency included in the first frequency band; and a plurality of second antenna elements that are disposed on a surface opposite the surface of the frequency selective
(Continued)

surface facing the first antenna elements, that are fed through feeders passing through the openings, and that are tuned to a second frequency included in the second frequency band.

11 Claims, 70 Drawing Sheets

(51) Int. Cl.

| | |
|---|---|
| ***H01Q 13/10*** | (2006.01) |
| ***H01Q 15/00*** | (2006.01) |
| ***H01Q 19/185*** | (2006.01) |
| ***H01Q 21/06*** | (2006.01) |
| ***H01Q 21/28*** | (2006.01) |
| ***H01Q 5/45*** | (2015.01) |
| ***H01Q 5/48*** | (2015.01) |
| *H01Q 15/14* | (2006.01) |
| *H01Q 9/26* | (2006.01) |
| *H01Q 21/24* | (2006.01) |

(52) U.S. Cl.
CPC ..... *H01Q 15/0013* (2013.01); *H01Q 19/17* (2013.01); *H01Q 19/185* (2013.01); *H01Q 21/062* (2013.01); *H01Q 21/28* (2013.01); *H01Q 9/26* (2013.01); *H01Q 15/14* (2013.01); *H01Q 21/24* (2013.01)

(58) Field of Classification Search
CPC ..... H01Q 19/18; H01Q 21/06; H01Q 21/28; H01Q 9/26; H01Q 15/14; H01Q 21/24
USPC ..... 343/767
See application file for complete search history.

(56) References Cited

FOREIGN PATENT DOCUMENTS

| | | | |
|---|---|---|---|
| JP | H09-284040 | A | 10/1997 |
| JP | 2000-174552 | A | 6/2000 |
| JP | 2005-094360 | A | 4/2005 |
| JP | 2009-267754 | A | 11/2009 |
| JP | 2014-086952 | A | 5/2014 |
| JP | 2015-046846 | A | 3/2015 |
| WO | 2013/027824 | A1 | 2/2013 |
| WO | 2014/059946 | A1 | 4/2014 |
| WO | 2015/029383 | A1 | 3/2015 |

OTHER PUBLICATIONS

English translation of Written opinion for PCT Application No. PCT/JP2016/004216.

* cited by examiner

MULTIBAND ANTENNA AND WIRELESS COMMUNICATION DEVICE

This application is a National Stage Entry of PCT/JP2016/004216 filed on Sep. 15, 2016, which claims priority from Japanese Patent Application 2015-190531 filed on Sep. 29, 2015, the contents of all of which are incorporated herein by reference, in their entirety.

TECHNICAL FIELD

The present invention relates to a multiband antenna and a wireless communication device.

BACKGROUND ART

In recent years, as antennas for base stations in a mobile communication network and antenna devices of Wi-Fi communication apparatuses, multiband antennas that are capable of performing communication in a plurality of frequency bands for the purpose of securing communication capacity have been put in practical use.

An example of such multiband antennas is disclosed in PTL 1. A multiband antenna disclosed in PTL 1 is configured with a plurality of dipole antenna elements each of which is tuned to a different frequency band. The multiband antenna is configured by alternately arraying crossed-dipole antenna elements for high frequencies and crossed-dipole antenna elements for low frequencies on an antenna reflector. Further, the multiband antenna has central conductive fences placed between columns of antenna elements. The central conductive fences are configured to reduce mutual coupling between adjacent high frequency antenna elements and between adjacent low frequency antenna elements.

CITATION LIST

Patent Literature

[PTL 1] WO 2014/059946 A
[PTL 2] WO 2013/027824 A
[PTL 3] JP 2014-086952 A
[PTL 4] JP 2005-094360 A
[PTL 5] JP 2000-174552 A
[PTL 6] JP 9-284040 A
[PTL 7] JP 2009-267754 A

SUMMARY OF THE INVENTION

Technical Problem

A first problem in the related technologies is that, when a plurality of antenna elements each of which is tuned to a different frequency band are disposed in proximity to one another, performance (band, radiation pattern, and the like) of each antenna element may deteriorate.

The reason for the deterioration is because, since each antenna element is configured with a metal, the antenna elements influence one another.

An object of the present invention is to provide a multiband antenna, a multiband antenna array, and a wireless communication device that are capable of reducing distances among a plurality of antenna elements tuned to different frequency bands.

Solution to Problem

A multiband antenna in one aspect of the present invention includes: a conductive reflection plate; a frequency selective surface that is disposed so as to at least partially face the conductive reflection plate, that transmits therethrough electromagnetic waves in a first frequency band, that reflects thereon electromagnetic waves in a second frequency band that is a higher frequency band than the first frequency band, and that has a plurality of openings; a plurality of first antenna elements that are disposed in a region sandwiched between the conductive reflection plate and the frequency selective surface and that are tuned to a first frequency included in the first frequency band; and a plurality of second antenna elements that are disposed on a surface opposite a surface of the frequency selective surface facing the first antenna elements, that are fed through feeders passing through the openings, and that are tuned to a second frequency included in the second frequency band.

Advantageous Effects of the Invention

A first advantageous effect in the present invention is that distances among a plurality of antenna elements tuned to different frequency bands may be reduced.

BRIEF DESCRIPTION OF THE DRAWINGS

FIG. 11 is another plan view illustrating the structure of the multiband antenna 1 in the variation 4 of the present invention;

DESCRIPTION OF EMBODIMENTS

Next, example embodiments of the present invention will be described in detail with reference to the drawings. Note that, in the respective drawings and the respective example embodiments described in the description, the same signs are assigned to components having the same function.

First Example Embodiment

Figure 1:
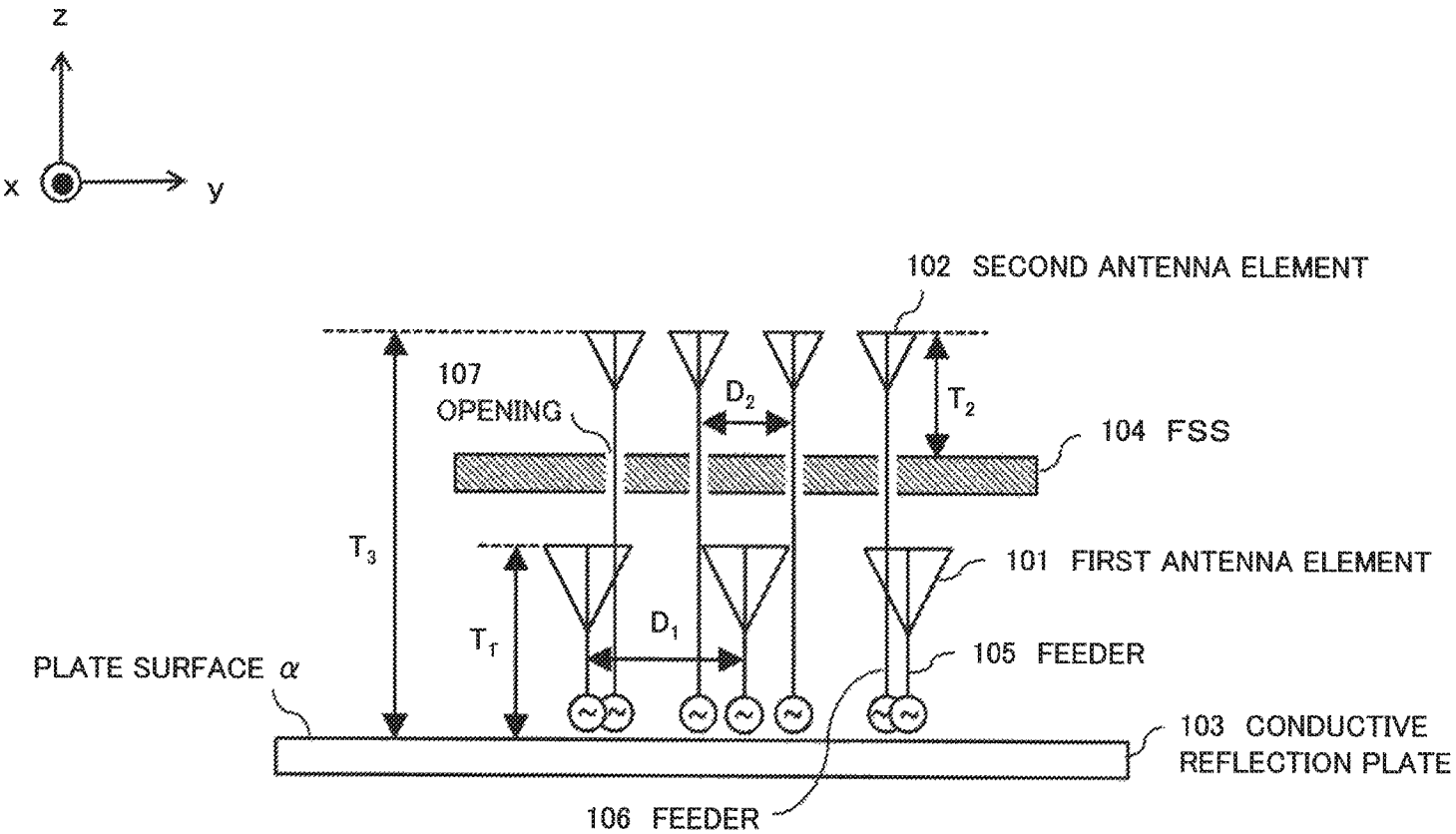
FIG. 1 is a diagram illustrating a configuration of a multiband antenna 1 in a first example embodiment of the present invention.

FIG. 1 is a configuration diagram illustrating a configuration of a multiband antenna 1 in a first example embodiment of the present invention.

Referring to FIG. 1, the multiband antenna 1 in the first example embodiment of the present invention includes a plurality of first antenna elements 101, a plurality of second antenna elements 102, a conductive reflection plate 103, and a frequency selective surface (or frequency selective sheet, hereinafter, referred to as FSS) 104. Each of the first antenna elements 101 includes a feeder 105. Similarly, each of the second antenna elements 102 includes a feeder 106. The FSS 104 includes a plurality of openings 107.

The multiband antenna 1 in the first example embodiment transmits and receives electromagnetic waves corresponding to a plurality of frequency bands. The multiband antenna 1 is configured by stacking the conductive reflection plate 103, the plurality of first antenna elements 101, the FSS 104, and the plurality of second antenna elements 102 in this sequence. In other words, the plurality of first antenna elements 101 and the plurality of second antenna elements 102 are disposed at different heights above the conductive reflection plate 103, respectively. In this configuration, an operating frequency $f_1$ of the first antenna elements 101 is set lower than an operating frequency $f_2$ of the second antenna elements 102 ($f_1<f_2$). The configuration enables the multiband antenna 1 to, while disposing the plurality of first antenna elements 101 and the plurality of second antenna elements 102 in proximity to one another in the planar direction (directions perpendicular to the height direction), retain performance of each antenna element.

Hereinafter, the respective components included in the multiband antenna 1 in the first example embodiment will be described.

Conductive Reflection Plate 103

The conductive reflection plate 103 is a plate-shaped conductor formed in such a way as to have a conductive plate surface $\alpha$ on a plane (xy plane) in space. The conductive reflection plate 103 is generally formed of copper foil stuck to sheet metal or a dielectric substrate. However, the conductive reflection plate 103 may be formed of other metal, such as silver, aluminum, and nickel, or other material as long as such metal and material are conductive. Hereinafter, any component that is described as a conductor is assumed to be formed of a similar material. The conductive reflection plate 103 constitutes a short-circuit plane.

Figure 66:
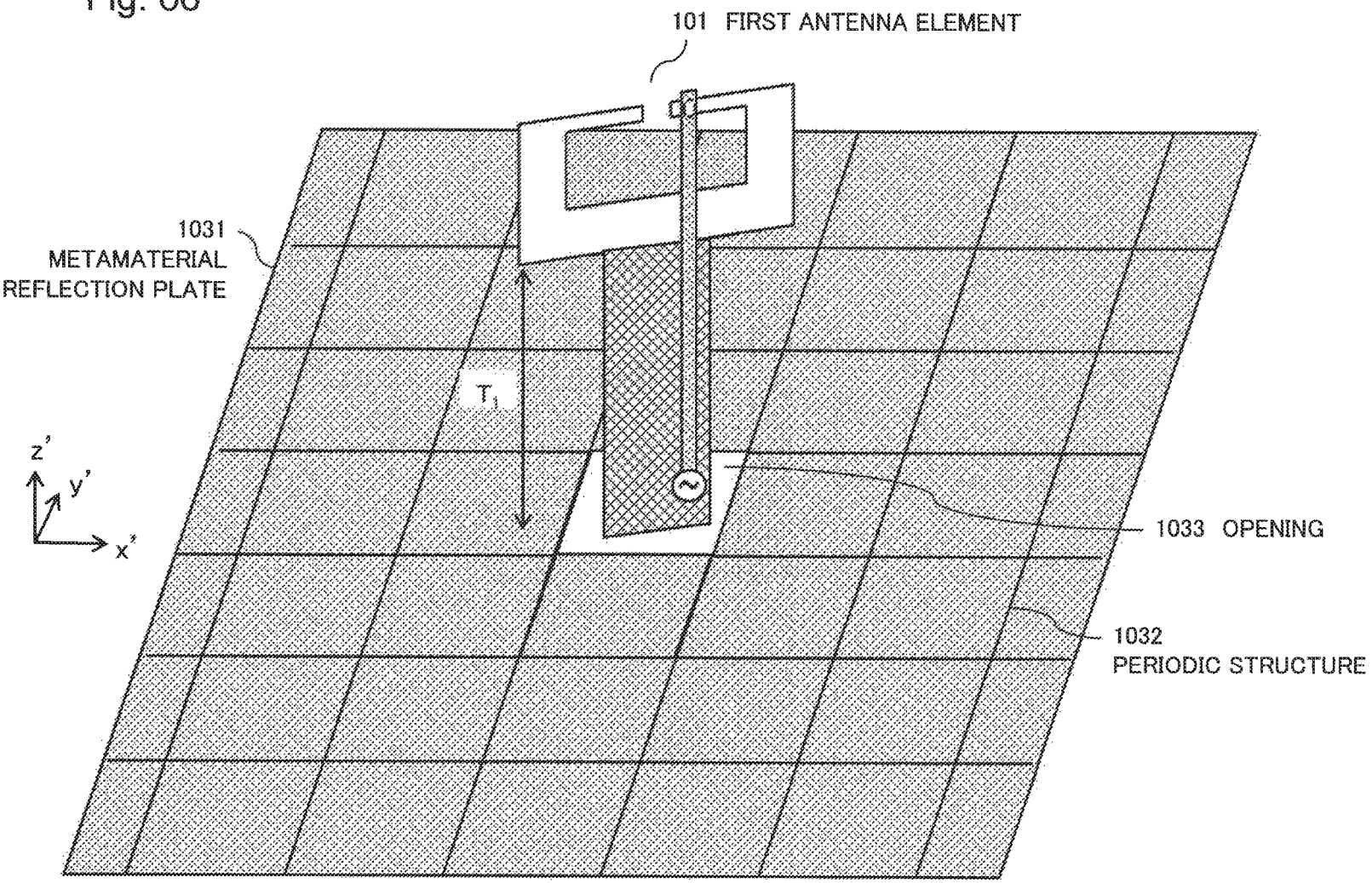
FIG. 66 is a perspective view illustrating a configuration of a metamaterial reflection plate 1031 in the first example embodiment of the present invention.

The conductive reflection plate 103 of the present example embodiment may be a metamaterial reflection plate 1031, as illustrated in FIG. 66. As used herein, the metamaterial reflection plate (also referred to as an artificial magnetic conductor, a high-impedance surface, or the like) refers to a reflection plate in which periodic structures 1032, each of which is made of a small conductor piece or a small dielectric piece formed in a predetermined shape, are periodically arrayed in the vertical direction (y'-axis direction) and the horizontal direction (x'-axis direction) of the plate surface $\alpha$. The metamaterial reflection plate 1031 is capable of shifting the reflection phase of a reflected electromagnetic wave to a value different from a reflection phase of 180° when reflected by a regular metal plate. By controlling the reflection phase at the operating frequency of the first antenna elements 101, the metamaterial reflection plate 1031 may suppress variation in the resonance characteristics of the first antenna elements 101 even when distance $T_1$ from the metamaterial reflection plate 1031 to the first antenna elements 101 is shorter than a quarter of wavelength $\lambda_1$.

The metamaterial reflection plate 1031 may, as with the FSS 104, which will be described later, include openings 1033 through which the feeders 105 of the first antenna elements 101 are passed.

First Antenna Element 101

The first antenna elements 101 have a characteristic of having a resonance frequency at the operating frequency $f_1$. The first antenna elements 101 transmit and receive electromagnetic waves having the frequency $f_1$. The first antenna elements 101 are fed through the feeders 105. The first antenna elements 101 are disposed at positions the distance of which from the conductive reflection plate 103 is $T_1$. In other words, the height of the first antenna elements 101 is indicated by $T_1$. It is preferable that the height $T_1$ be approximately $\lambda_1/4$ because the conductive reflection plate 103 constitutes a short-circuit plane. As used herein, the wavelength $\lambda_1$ indicates a wavelength in the case where an electromagnetic wave having the frequency $f_1$ propagates through a substance (including air and a vacuum).

Although, in the present example embodiment, the plurality of first antenna elements 101 are assumed to be disposed on an identical plane, all the first antenna elements 101 do not have to be on an identical plane. In addition, the first antenna element 101 may be singular in number. Although the plurality of first antenna elements 101 are periodically arrayed into a square lattice form at a constant interval $D_1$, which depends on the operating frequency $f_1$, the form of an array is not limited to the form. For example, the first antenna elements 101 may be arrayed into a lattice form that is made up of unit lattices having another shape, such as a rectangle and a triangle, or may be arrayed into a concentric circular form, a single row array, a double row array, or a form other than an array. Detailed structures of the first antenna elements 101 will be described later as variations.

FSS 104

Figure 2:
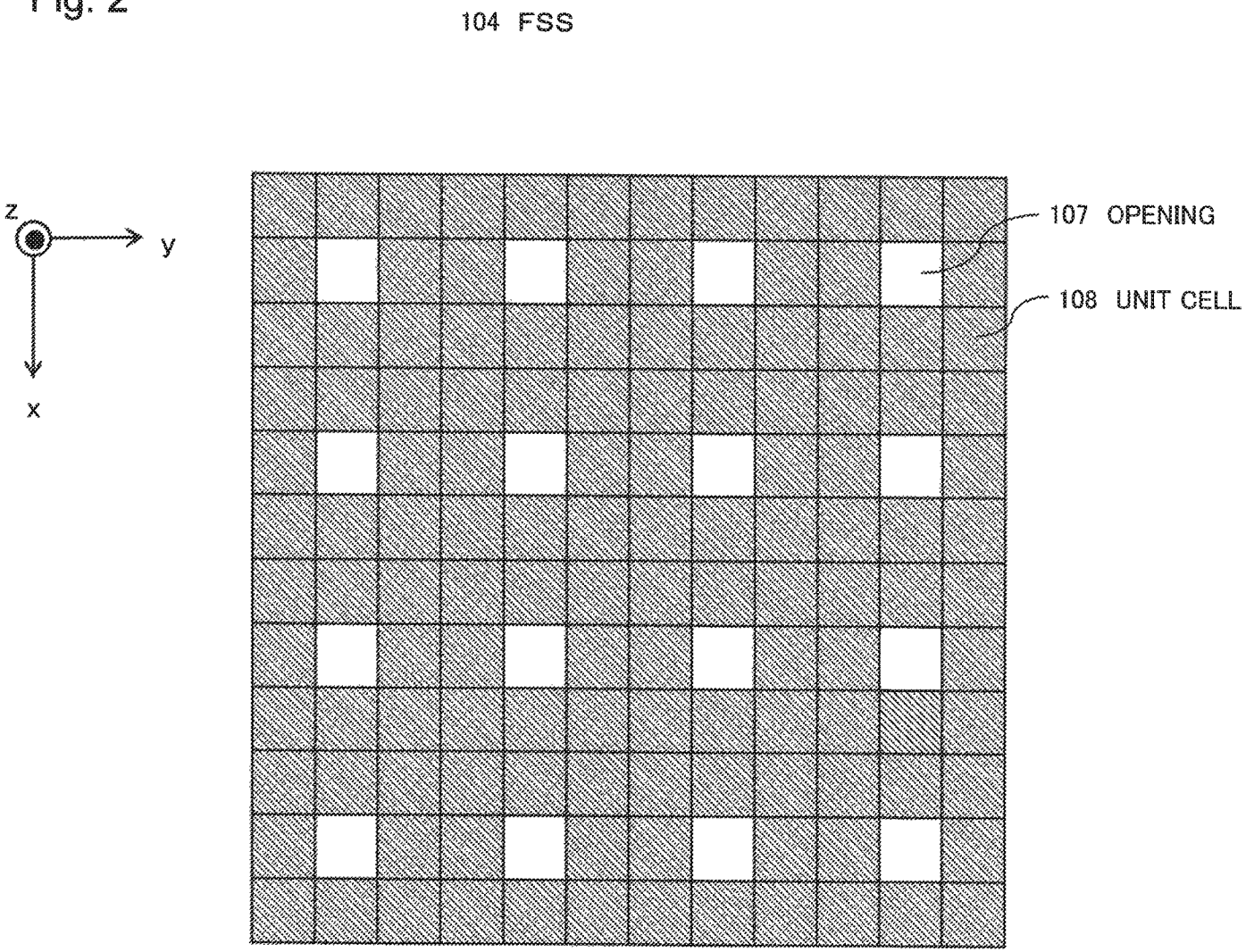
FIG. 2 is a top view illustrating a configuration of an FSS 104 in the first example embodiment of the present invention.

The FSS is a plate-shaped structure that has a conductor, a conductor and a dielectric, or a periodic structure thereof. The FSS has a function of transmitting therethrough or reflecting thereon electromagnetic waves in a specific frequency band selectively. The FSS 104 transmits therethrough electromagnetic waves in a first frequency band that includes the frequency $f_1$ and reflects thereon electromagnetic waves in a second frequency band that is a frequency band outside the first frequency band and includes the frequency $f_2$. The FSS 104 is disposed so as to at least partially face the conductive reflection plate 103 with the first antenna elements 101 interposed therebetween. The FSS 104 works as a conductive reflection plate for the second antenna elements 102, which will be described later. As illustrated in FIG. 2, the FSS 104 is generally formed by periodically arraying unit cells 108 each of which is a conductive patch or a conductive mesh-shaped structure. Further, the FSS 104 includes a plurality of openings 107 to pass the feeders 106 of the plurality of second antenna elements 102, which will be described later, therethrough. This configuration causes the feeders 106 to be wired in a direction substantially perpendicular to the FSS 104. Since the above wiring eliminates the necessity of complicated wiring of the feeders 106, the FSS 104 may retain the functions as an FSS without being influenced by the feeders 106. In addition, by including the openings 107, the FSS 104 may also retain performance of the second antenna elements 102. Detailed structures of the FSS 104 will be described later as variations.

Figure 3:
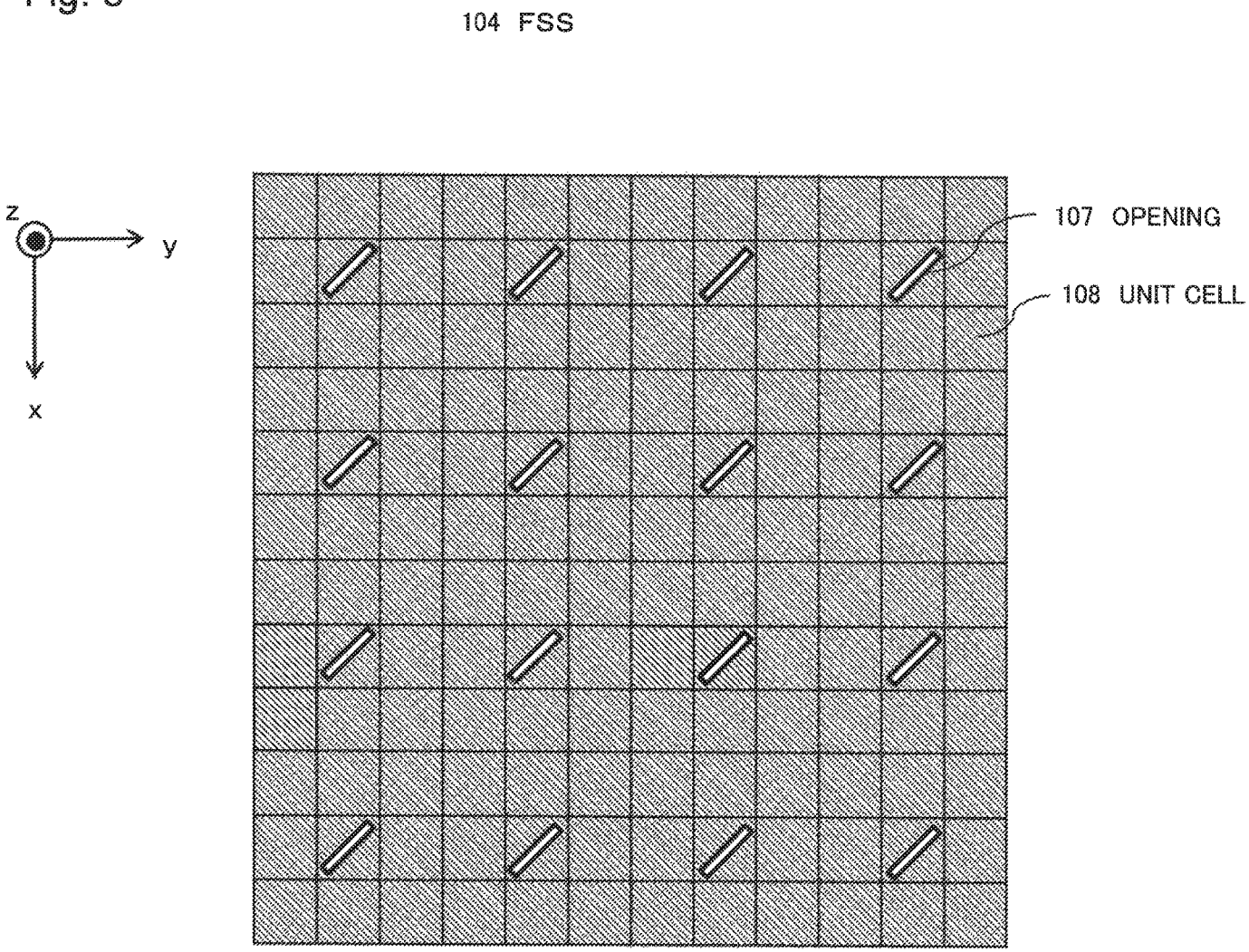
FIG. 3 is a top view illustrating another configuration of the FSS 104 in the first example embodiment of the present invention.

In the present example embodiment, the openings 107 are formed by removing some of the plurality of unit cells 107 that constitute the FSS 104, as illustrated in FIG. 2. However, the configuration of the openings 107 is not limited to the above configuration. Although it is preferable that the openings 107 be as small as possible, the inventors have found that, if the diameters of the openings 107 are smaller than or equal to $\lambda_2/2$, the performance of the FSS 104 scarcely varies. As long as satisfying the condition, the openings 107 may be formed into any shape. For example, each opening 107 may be formed into a slot shape as large as allowing a feeder 106 to be inserted thereinto, as illustrated in FIG. 3, or may be formed into another shape.

In the present example embodiment, it is assumed that the openings 107 are formed in plurality. However, when the second antenna element 102 is singular in number, it may also be assumed that a single opening 107 is formed. In addition, when influence of the feeders 106 on the FSS 104 is not taken into consideration or the feeders 106 can be wired so as not to influence the FSS 104, no opening 107 has to be formed. A multiband antenna in the case where the FSS 104 does not include any openings 107 will be described as a second example embodiment.

In the present example embodiment, the FSS 104 is assumed to selectively transmit therethrough or reflect thereon electromagnetic waves in a specific frequency band for all polarized waves in incident electromagnetic waves. However, the FSS 104 may have a structure that allows the above-described function to be performed only for polarization directions to which the first antenna elements 101 and the second antenna elements 102 are tuned.

Second Antenna Element 102

The second antenna elements 102 have a characteristic of having a resonance frequency at the operating frequency $f_2$, which is higher than the frequency $f_1$. The second antenna elements 102 transmit and receive electromagnetic waves having the frequency $f_2$. The second antenna elements 102 are fed through the feeders 106. The second antenna elements 102 are disposed at positions the distance of which from a surface opposite the surface of the FSS 104 facing the first antenna elements 101 is $T_2$. The height (distance from the conductive reflection plate 103) of the second antenna elements 102 is denoted by $T_3$. The FSS 104 can be considered to be a conductive reflection plate for the second antenna elements 102. It is preferable that the distance $T_2$ from the FSS 104 to the second antenna elements 102 be approximately $\lambda_2/4$ because a conductive reflection plate constitutes a short-circuit plane. As used herein, the wavelength $\lambda_2$ indicates a wavelength in the case where an electromagnetic wave having the frequency $f_2$ propagates through a substance (including air and a vacuum). In the present example embodiment, the feeders 106 pass through the openings 107 of the FSS 104 substantially perpendicularly to the FSS 104. For this reason, the feeders 106 do not require complicated wiring. In other words, the openings 107 of the FSS 104 may reduce influence of the feeders 106 on the characteristic of the second antenna elements 102 caused by complicated wiring.

Although, in the present example embodiment, the second antenna elements 102 are assumed to be disposed on an identical plane in plurality, all the second antenna elements 102 do not have to be on an identical plane. In addition, the second antenna element 102 may be singular in number. Although the plurality of second antenna elements 102 are periodically arrayed into a square lattice form at a constant interval $D_2$, which depends on the operating frequency $f_2$, the form of an array is not limited to the form. For example, the second antenna elements 102 may be arrayed into a lattice form that is made up of unit lattices having another shape, such as a rectangle and a triangle, or may be arrayed into a concentric circular form, a single row array, a double row array, or a form other than an array. Detailed structures of the second antenna elements 102 will be described later.

In the present example embodiment, it is assumed that the plurality of first antenna elements 101 and the plurality of second antenna elements 102 are disposed at the constant intervals $D_1$ and $D_2$, which depend on the operating frequencies $f_1$ and $f_2$ of the respective antenna elements, respectively (that is, $D_1 \neq D_2$). In this case, the multiband antenna 1 may perform beam forming using the respective antenna arrays at the respective frequencies. On this occasion, in terms of the purpose of reducing sidelobes, it is preferable that the intervals $D_1$ and $D_2$ be set at approximately $\lambda_1/2$ and $\lambda_2/2$. When being disposed in such a manner, the first antenna elements 101 and the second antenna elements 102 almost inevitably come close to one another in the planar direction of the conductive reflection plate 103. Therefore, configuring a multiband antenna in a manner as described in the present example embodiment enables a multiband antenna to be achieved that is capable of, while disposing a plurality of antenna elements each of which is tuned to a different frequency band in proximity to one another, retaining the characteristics of the respective antenna elements.

Although, in the present example embodiment, it is assumed that each of the plurality of first antenna elements 101 and the plurality of second antenna elements 102 are independently disposed at an interval, the configurations thereof are not limited to the above configuration. For example, the plurality of first antenna elements 101 may be disposed in an identical dielectric layer, and the plurality of second antenna elements 102 may be disposed in another dielectric layer.

Figure 4:
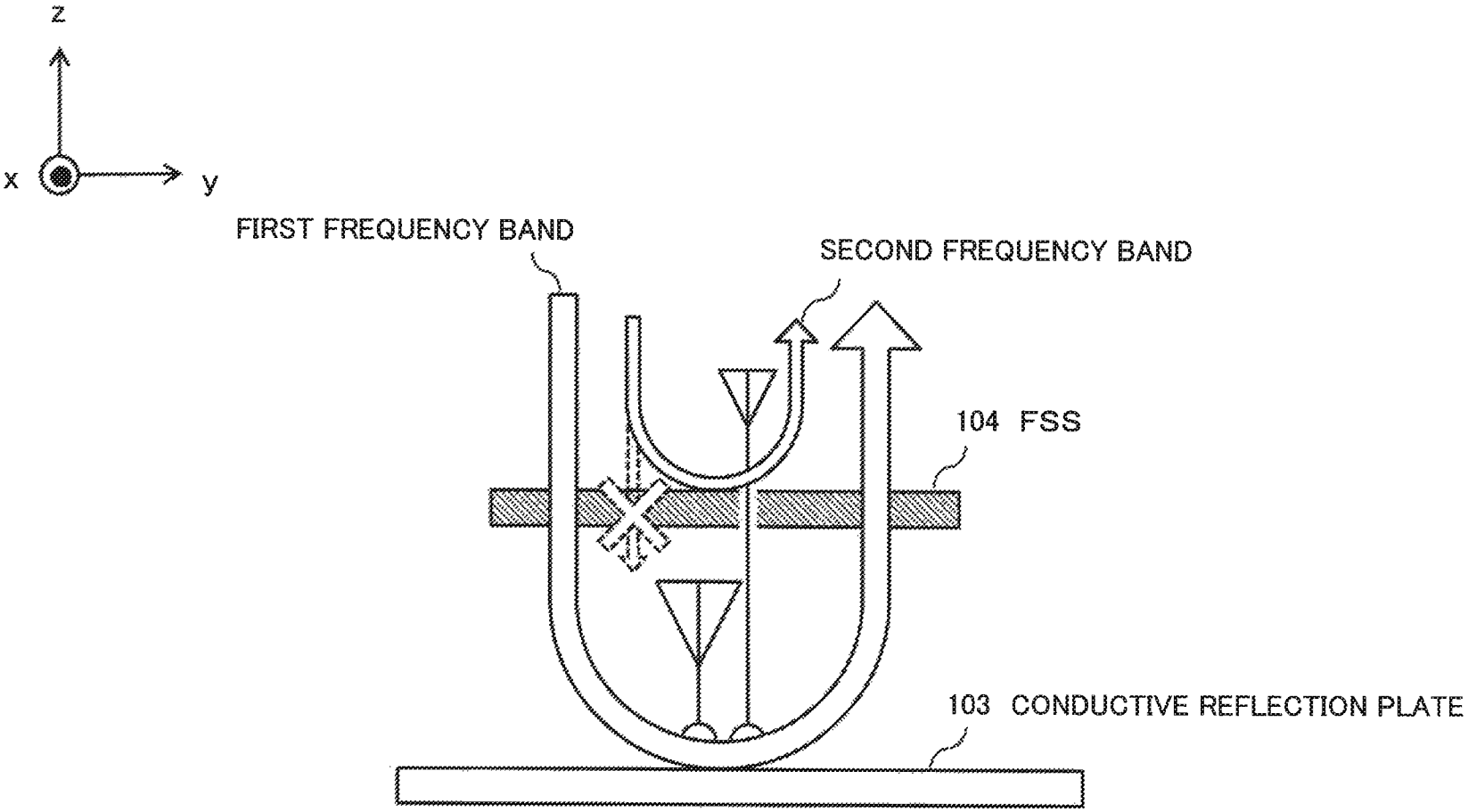
FIG. 4 is a diagram illustrating an operational effect of the multiband antenna 1 in the first example embodiment of the present invention.
Figure 5:
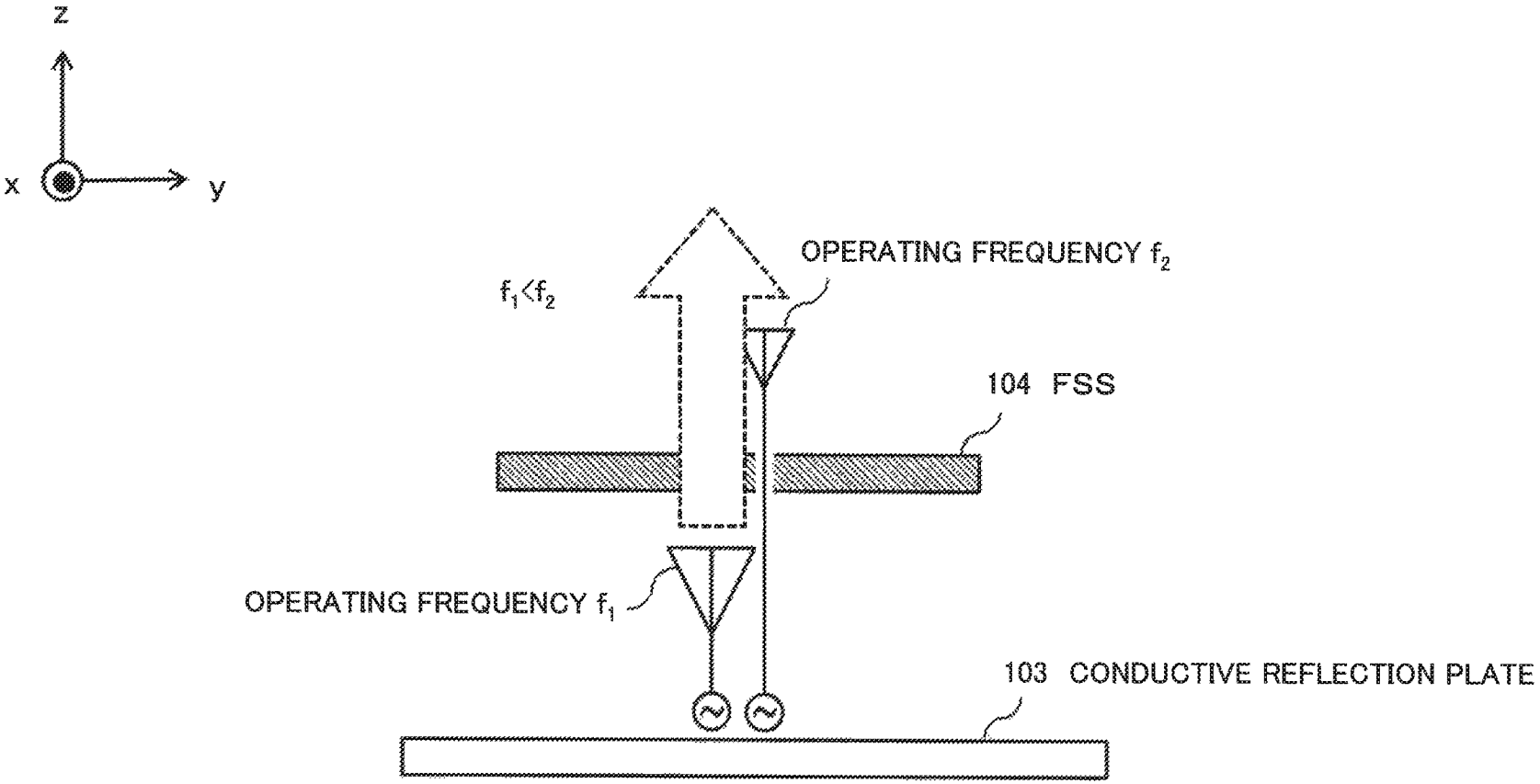
FIG. 5 is another diagram illustrating the operational effect of the multiband antenna 1 in the first example embodiment of the present invention.

FIGS. 4 and 5 are diagrams illustrating operational effects of the multiband antenna 1 in the first example embodiment of the present invention.

As described above, in general, when being disposed in proximity to each other, the first antenna elements 101 and the second antenna elements 102, which are tuned to different frequencies, respectively, influence each other. The influence causes the performance of the respective antenna elements to deteriorate.

Accordingly, in the multiband antenna 1 of the present example embodiment, when the first antenna elements 101 and the second antenna elements 102 are disposed in proximity to each other in the planar direction of the conductive reflection plate 103, the first antenna elements 101 and the second antenna elements 102 are disposed separated from each other in the perpendicular direction to the conductive reflection plate 103 by use of the FSS 104. In other words, the multiband antenna 1 is formed into a stacked structure in which the distance $T_1$ from the conductive reflection plate 103 to the first antenna elements 101 and the distance $T_3$ from the conductive reflection plate 103 to the second antenna elements 102 are set at different values (in the present example embodiment, $T_1<T_3$). By sandwiching the FSS 104 between the first antenna elements 101 and the second antenna elements 102, the multiband antenna 1 transmits electromagnetic waves in the first frequency band and reflects electromagnetic waves in the second frequency band, as illustrated in FIG. 4. Since the FSS 104 reflects thereon electromagnetic waves in the second frequency band, the multiband antenna 1 may reduce influence of the first antenna elements 101 on the second antenna elements 102.

Further, in the multiband antenna 1 of the present example embodiment, the operating frequency $f_1$ of the first antenna elements 101, which are located at lower positions, is set lower than the operating frequency $f_2$ of the second antenna elements 102, which are located at upper positions ($f_1<f_2$). In general, the second antenna elements 102 may, as metal objects, influence the first antenna elements 101 (however, the frequency selective surface 104 does not influence the first antenna elements 101). However, having the configuration described above causes the first antenna elements 101 to consider the second antenna elements 102 as small metal objects, as illustrated in FIG. 5. As a result, the multiband antenna 1 may reduce influence of the second antenna elements 102 on the radiation pattern of the first antenna elements 101.

In addition, the multiband antenna 1 of the present example embodiment includes the openings 107 for passing the feeders 106 of the second antenna elements 102 on the FSS 104. In other words, the feeders 106 can be wired substantially perpendicularly to the FSS 104. This configuration enables the feeders 106 to, without requiring complicated wiring, reduce influence thereof on the FSS 104 and the second antenna elements 102.

The multiband antenna 1 of the first example embodiment is configured by stacking the conductive reflection plate 103, the first antenna elements 101, the FSS 104, and the second antenna elements 102 in this sequence. In the configuration, the operating frequency $f_1$ of the first antenna elements 101 is set lower than the operating frequency $f_2$ of the second antenna elements 102. The above configuration enables the multiband antenna 1 to reduce distance between the first antenna elements 101 and the second antenna elements 102, which are tuned to different frequency bands. Further, the multiband antenna 1 may, by including the openings 107 on the FSS 104, reduce influence of the feeders of the second antenna elements 102 on the FSS 104 and the second antenna elements 102.

Detailed structures of the FSS 104 will be described below as variations 1 to 3.

<Variation 1>

Figure 6:
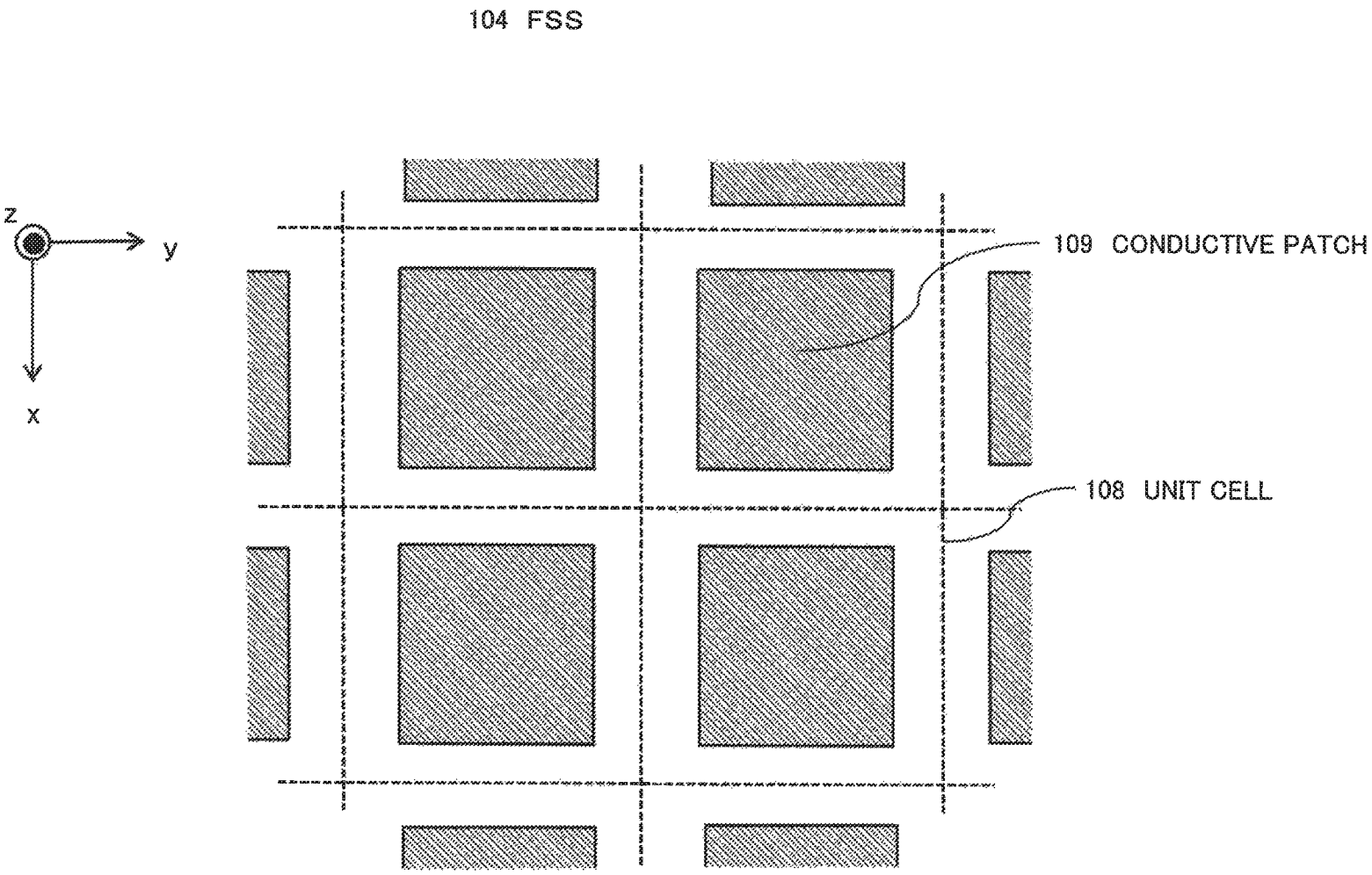
FIG. 6 is a top view illustrating a structure of an FSS 104 in a variation 1 of the present invention.

FIG. 6 is a configuration diagram illustrating a configuration of an FSS 104 of the variation 1.

The FSS 104 is configured by using each of conductive patches 109, which are separated from one another, as a unit cell 108 and arraying the unit cells 108 periodically. Although, in the present variation, each conductive patch 109 is a square, the conductive patch 109 may be formed into other shapes, such as a rectangle, a circle, and a triangle. The FSS 104 is capable of changing the frequency of electromagnetic waves to be reflected by changing the size of each conductive patch 109 or the size of each unit cell 108.

<Variation 2>

Figure 7:
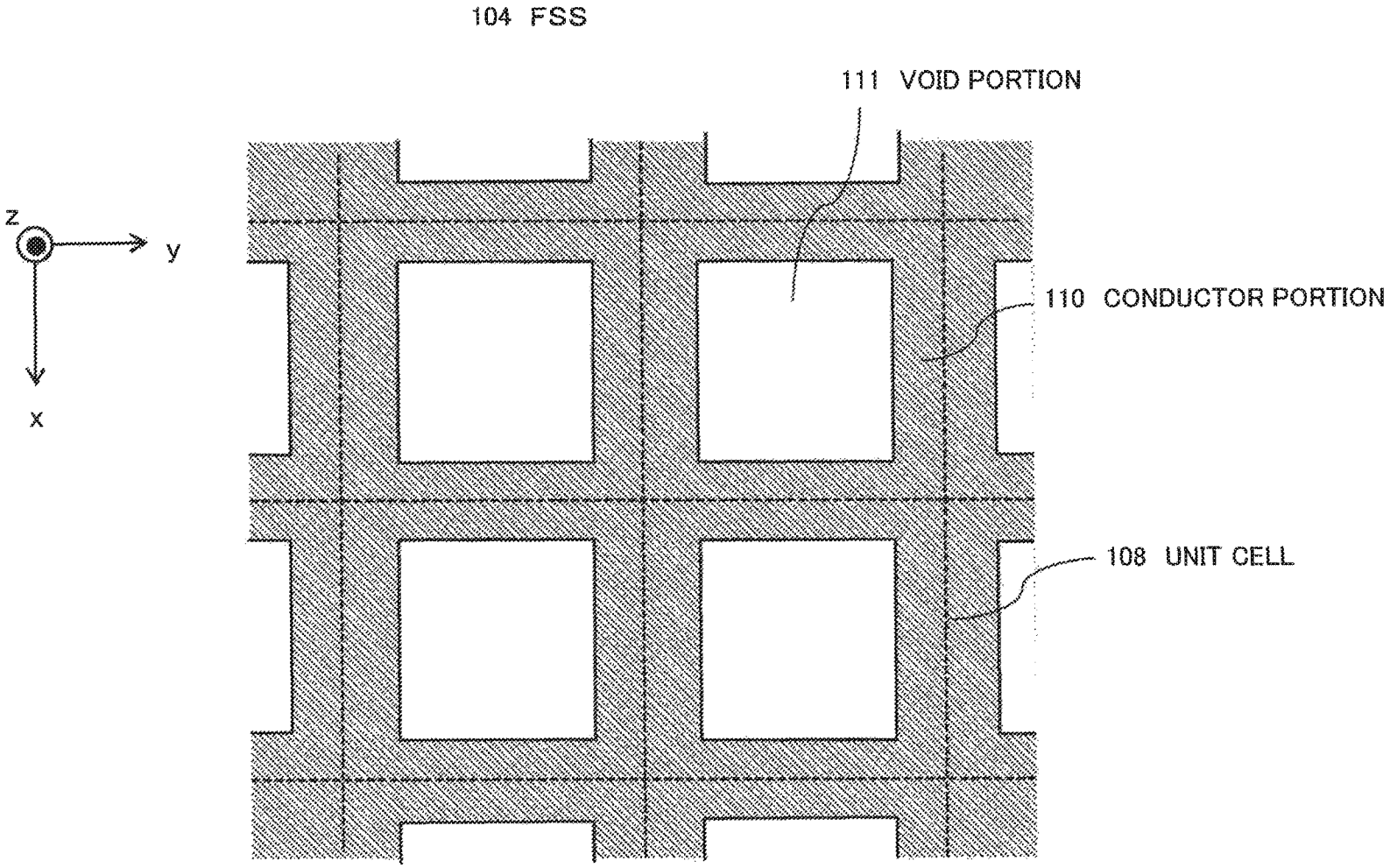
FIG. 7 is a top view illustrating a structure of an FSS 104 in a variation 2 of the present invention.

FIG. 7 is a configuration diagram illustrating a configuration of an FSS 104 of the variation 2.

The FSS 104 is configured into a mesh-shaped structure by periodically arraying unit cells 108 each of which is configured with a conductor portion 110 and a void portion 111 formed in the conductor portion 110. In the present variation, each void portion 111 is formed into a square shape. However, each void portion 111 may be formed into other shapes, such as a rectangle, a circle, and a triangle. In addition, although, in the present variation, it is assumed that each void portion 111 is filled with a dielectric material, the void portion 111 may be filled with air (including a vacuum). Each conductor portion 110 is formed surrounding a void portion 111. The conductor portions 110 and the void portions 111 constitute a resonance structure. The FSS 104 changes the characteristic of the resonance structure by changing the size of each void portion 111 or the size of each unit cell 108. The change of the characteristic of the resonance structure enables the FSS 104 to change a frequency band of electromagnetic waves that are transmitted therethrough.

<Variation 3>

Figure 8:
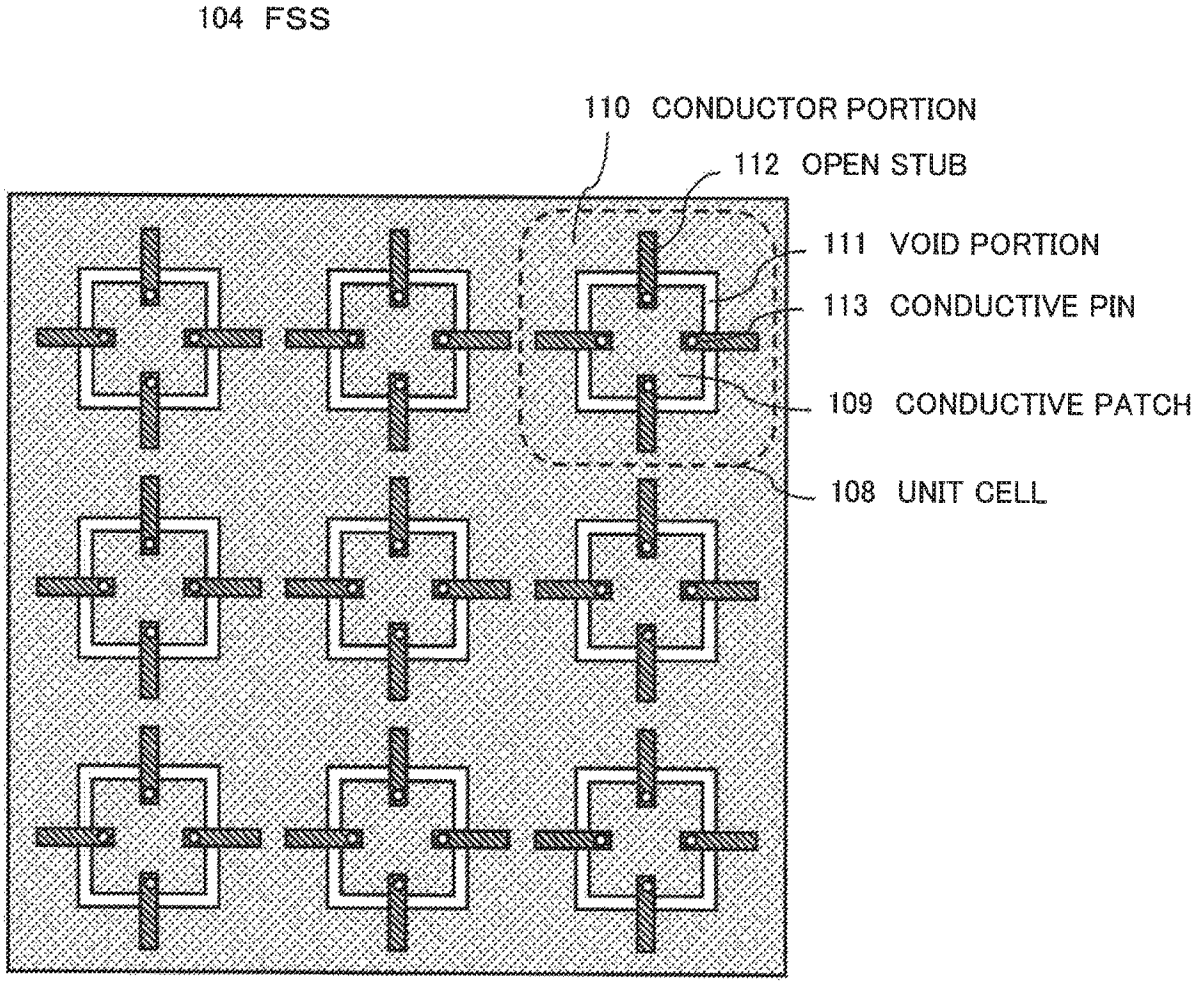
FIG. 8 is a top view illustrating a structure of an FSS 104 in a variation 3 of the present invention.
Figure 8:
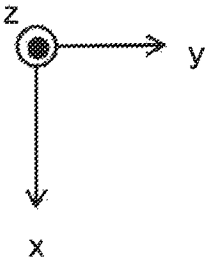

FIG. 8 is a configuration diagram illustrating a configuration of an FSS 104 of the variation 3.

The FSS 104 is configured by using a structure including configurations of the variations 1 and 2, open stubs 112, and conductive pins 113 as a unit cell 108 and arraying the unit cells 108 periodically. Each conductive patch 109 is disposed in the same layer in a void portion 111 as that in which a conductor portion 110 is disposed without being in contact with the conductor portion 110. The open stubs 112 bridge a gap between the conductive patch 109 and the conductor portion 110 and are disposed in a layer different from that in which the conductive patch 109 and the conductor portion 110 are disposed. The conductive pins 113 connect the open stubs 112 and the conductive patch 109 electrically. A capacitance adjustment structure made up of a conductive patch 109, an open stub 112, and a conductive pin 113 assists design of a frequency band of electromagnetic waves that are transmitted through the FSS 104. The capacitance adjustment structure generates capacitance with the conductive patches 109. The FSS 104 may adjust the amount of capacitance by adjusting the length of each open stub 112.

In other words, by adjusting the length of each open stub 112, the FSS 104 may adjust the characteristic of the resonance structure of the FSS 104 without changing the size of each unit cell 108. The change of the characteristic of the resonance structure enables the FSS 104 to change a frequency band of electromagnetic waves that are transmitted therethrough. When the length of each open stub 112 is increased, the capacitance increases and thus the characteristic (resonance frequency) of the resonance structure shifts to low frequencies. At the same time, the frequency band of electromagnetic waves that the FSS 104 transmits therethrough is changed to low frequencies.

Figure 9:
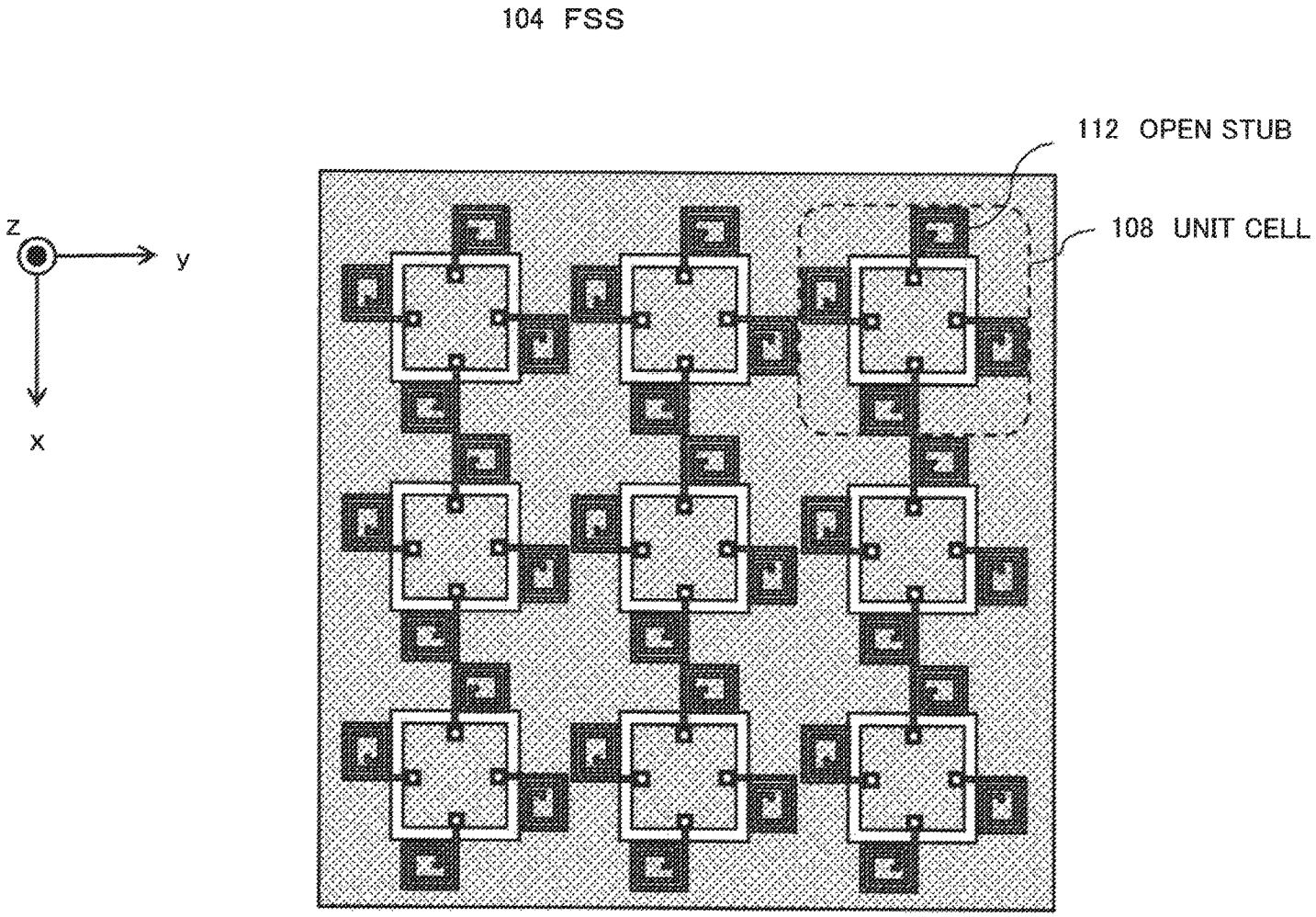
FIG. 9 is a top view illustrating another structure of the FSS 104 in the variation 3 of the present invention.

In the present variation, each open stub 112 is formed into a linear shape. However, each open stub 112 may be formed into a spiral shape as illustrated in FIG. 9 or may be formed into other shapes.

Forming each open stub 112 into a spiral shape enables a sufficient length thereof to be obtained within a limited space.

Although, in the present variation, four capacitance adjustment structures are assumed to be disposed in each unit cell 108, the number of capacitance adjustment structures is not limited to four.

A detailed structure of each first antenna element 101 and each second antenna element 102 will be described below as a variation 4.

<Variation 4>

Figure 10:
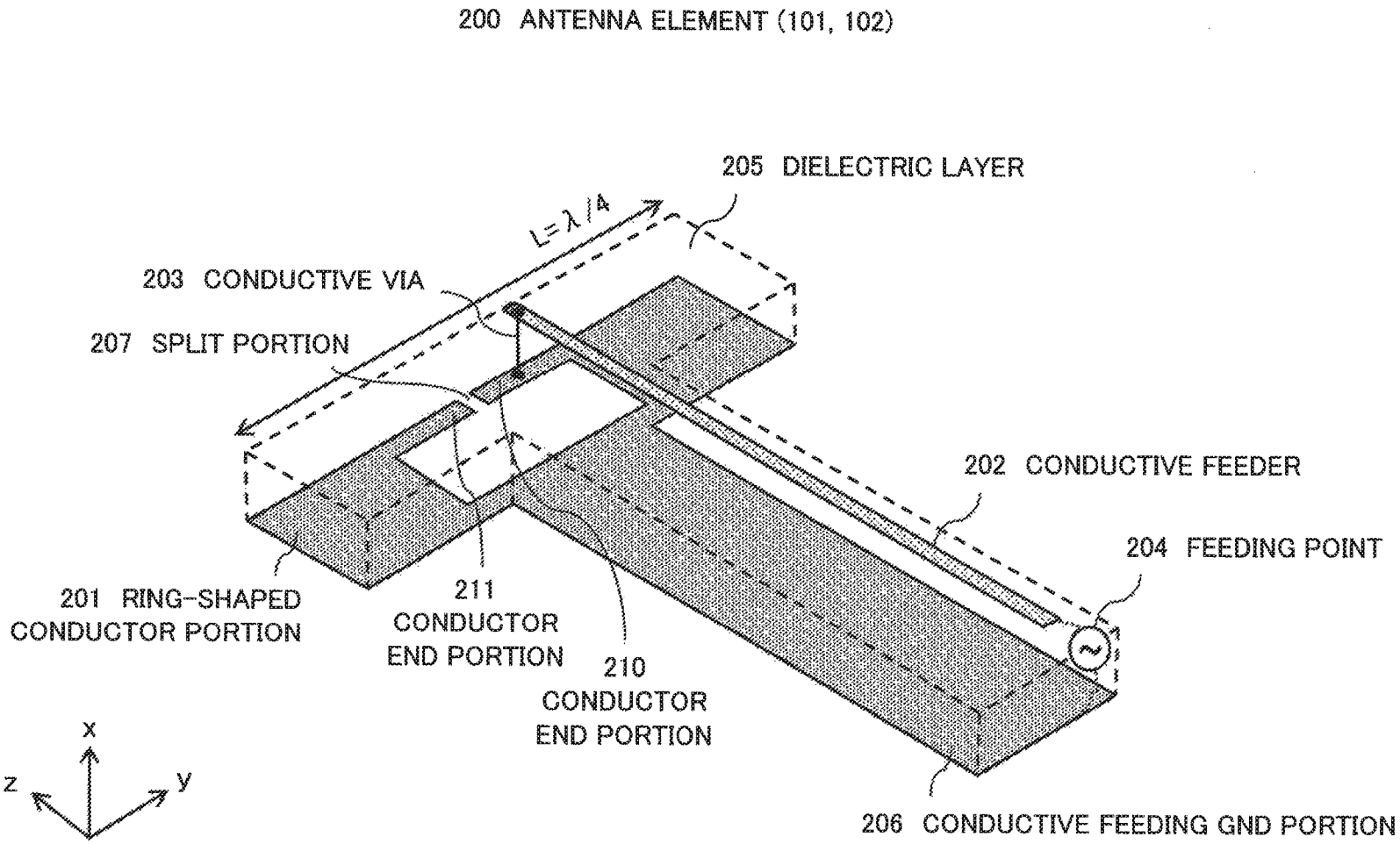
FIG. 10 is a perspective view illustrating a structure of an antenna element 200 in a variation 4 of the present invention.

FIG. 10 is a configuration diagram illustrating a configuration of an antenna element 200 of the variation 4.

Each of the first antenna elements 101 and the antenna elements 102 is configured with the antenna element 200.

As illustrated in FIG. 10, each antenna element 200 includes a ring-shaped conductor portion 201, a conductive feeder 202, a conductive via 203, a feeding point 204, a dielectric layer 205, and a conductive feeding GND portion 206. A transmission line configured with the conductive feeder 202 and the conductive feeding GND portion 206 is equivalent to the feeder 105 and the feeder 106 in the present example embodiment.

The ring-shaped conductor portion 201 is a conductor that is formed into a ring shape on one surface of the dielectric layer 205. More specifically, the ring-shaped conductor portion 201 is formed into a substantially rectangular ring shape the long sides of which extend in a direction along the plate surface α (y-axis direction). Further, the ring-shaped conductor portion 201 includes a split portion 207 that is formed by cutting out a portion in the circumferential direction thereof. The split portion 207 is formed on a portion constituting a long side on the upper side (positive z-axis direction side) out of the constituent portions in the circumferential direction of the ring-shaped conductor portion 201 and at the middle in the extending direction (y-axis direction) of the long side. Note that, out of the ring-shaped conductor portion 201, portions that are in contact with the split portion 207 in the circumferential direction thereof and extend in the extending direction along the plate surface α (y-axis direction) (portions constituting the long side on the upper side of the ring-shaped conductor portion 201) are referred to as a conductor end portion 210 and a conductor end portion 211, respectively. Length L in the extending direction (y-axis direction) of the ring-shaped conductor portion 201 is set at, for example, approximately λ/4. Note that the wavelength λ indicates a wavelength when an electromagnetic wave having an operating frequency f that coincides with the resonant frequency of the antenna element 200 proceeds in a substance filling a region.

The conductive feeder 202 is disposed distanced from the ring-shaped conductor portion 201 by being formed on the other surface (surface opposite the surface on which the ring-shaped conductor portion 201 is formed) of the dielectric layer 205. The conductive feeder 202 constitutes an electrical circuit for feeding from the feeding point 204 to the ring-shaped conductor portion 201. The conductive feeder 202 extends in the perpendicular direction to the plate surface α (z-axis direction) by a length obtained by adding the length in the short side direction (z-axis direction) of the ring-shaped conductor portion 201 to the length of the conductive feeding GND portion 206, which will be described later.

The conductive via 203 penetrates the dielectric layer 205 in the plate thickness direction (x-axis direction) thereof and connects a portion of the ring-shaped conductor portion 201 and one end of the conductive feeder 202 electrically. Specifically, the conductive via 203 is connected to the conductor end portion 210 of the ring-shaped conductor portion 201. Although the conductive via 203 is generally formed by plating a through-hone formed on the dielectric layer 205 by drilling, any via may be used as the conductive via 203 as long as being capable of connecting between layers electrically. For example, the conductive via 203 may be configured with a laser via, which is formed by a laser, or may be configured using a copper wire and the like.

The feeding point 204 applies electrical excitation in a predetermined operating frequency band (operating frequency f) between the other end (end opposite one end at which the conductive via 203 is disposed) of the conductive feeder 202 and the conductive feeding GND portion 206 in a vicinity of the other end. More specifically, the feeding point 204 is a point at which high frequency power from a not-illustrated feeding source is supplied. The feeding point 204 is capable of applying electrical excitation between the other end of the conductive feeder 202 and the conductive feeding GND portion 206, which extends from the long side on the opposite side (lower (negative z-axis direction) side) to the long side on the upper (positive z-axis direction) side, to which the conductive via 203 is connected, of the ring-shaped conductor portion 201. The feeding point 204 is connected to a radio frequency (RF) unit 72, which will be described later, and the like. The above configuration enables the RF unit 72 to transmit and receive wireless communication signals with the multiband antenna 1 via the feeding point 204.

In the present example embodiment, the feeding point 204 is disposed on the side distant from the ring-shaped conductor portion 201 along the transmission line, which is made up of the conductive feeder 202 and the conductive feeding GND portion 206. The configuration enables a transmission line that further continues beyond the feeding point 204 to be distanced from the ring-shaped conductor portion 201. As a result, influence of the transmission line on the ring-shaped conductor portion 201 may be reduced.

The dielectric layer 205 is a plate-shaped dielectric that has the ring-shaped conductor portion 201 and the conductive feeder 202 on both surfaces thereof, respectively. In other words, the ring-shaped conductor portion 201 and the conductive feeder 202 face each other at an interval with the dielectric layer 205 interposed therebetween. Although, in FIG. 10, the dielectric layer 205 is formed into a T-shape into which the ring-shaped conductor portion 201 and the conductive feeding GND portion 206, which will be described later, are combined, the shape of the dielectric layer 205 is not limited to the T-shape.

In the present example embodiment, the surfaces of the dielectric layer 205 are disposed in such a way as to cross (at right angles) with the plate surface α of the conductive reflection plate 103 (disposed along the yz-plane). The above configuration causes the antenna element 200 to be disposed in such a way that a surface that constitutes a ring-shape in the ring-shaped conductor portion 201 is orthogonal to the plate surface α. The dielectric layer 205 may be an air layer (hollow layer). Alternatively, the dielectric layer 205 may be configured with only a supporting member partially made of a dielectric, and at least a portion thereof may be formed hollow.

The conductive feeding GND portion 206 is connected to a portion of the long side on the opposite side (lower (negative z-axis direction) side) to the long side on the upper (positive z-axis direction) side, to which the conductive via 203 is connected, of the ring-shaped conductor portion 201. The conductive feeding GND portion 206 extends from a position at which the ring-shaped conductor portion 201 is disposed to the plate surface α of the conductive reflection plate 103, which is located on the lower (negative z-axis direction) side of the position and is, at the other end thereof, connected to the plate surface α. Note that, although the conductive feeding GND portion 206 is connected to the plate surface α of the conductive reflection plate 103 in this variation, the conductive feeding GND portion 206 does not always have to be connected to the plate surface α.

In the present example embodiment, although the ring-shaped conductor portion 201, the conductive feeder 202, the conductive via 203, and the dielectric layer 205 are, in general, manufactured by means of a regular manufacturing process of a board, such as a printed circuit board and a semiconductor substrate, other methods may also be applied to the manufacturing.

Figure 11:
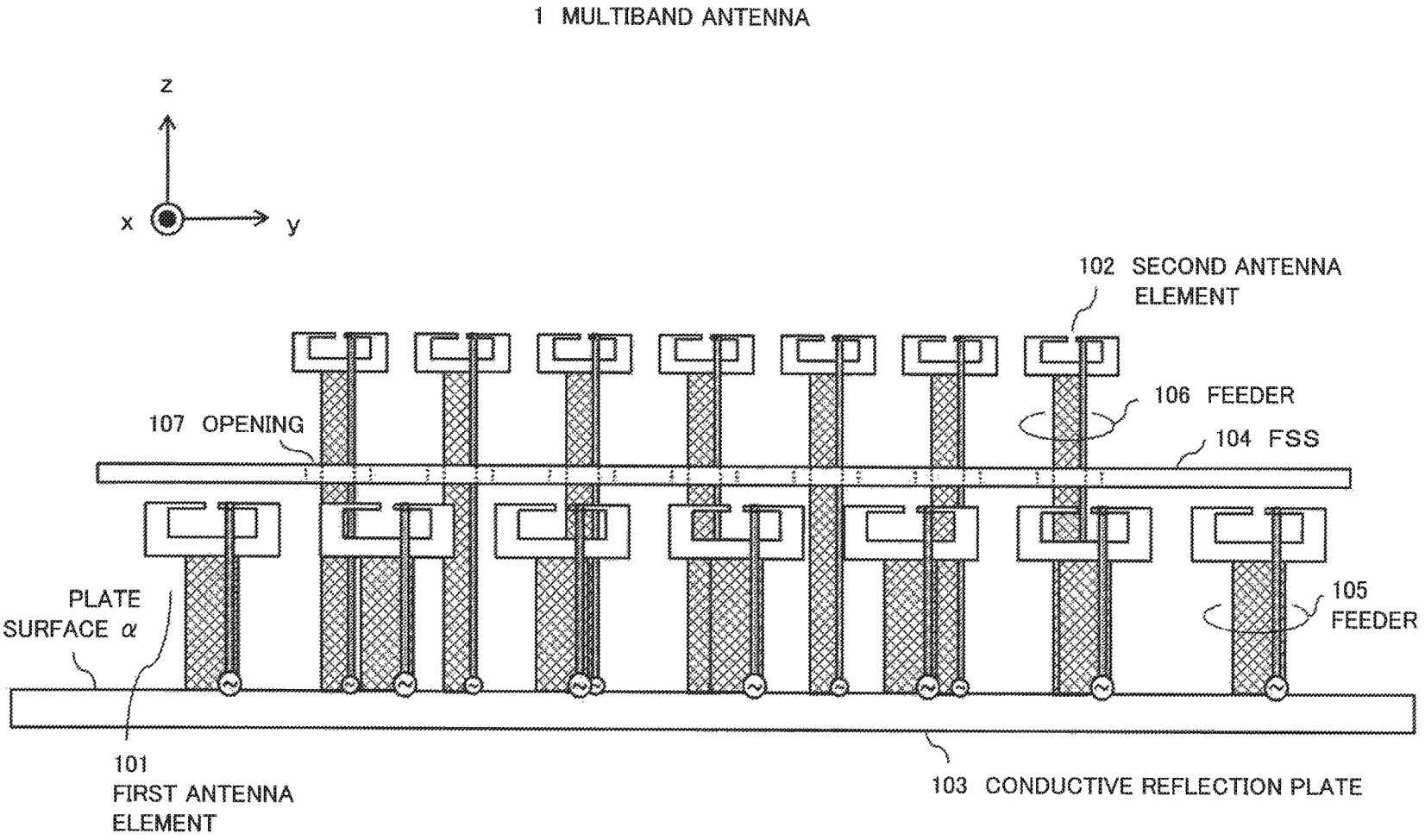
FIG. 11 is a plan view illustrating a structure of a multiband antenna 1 in the variation 4 of the present invention.
Figure 12:
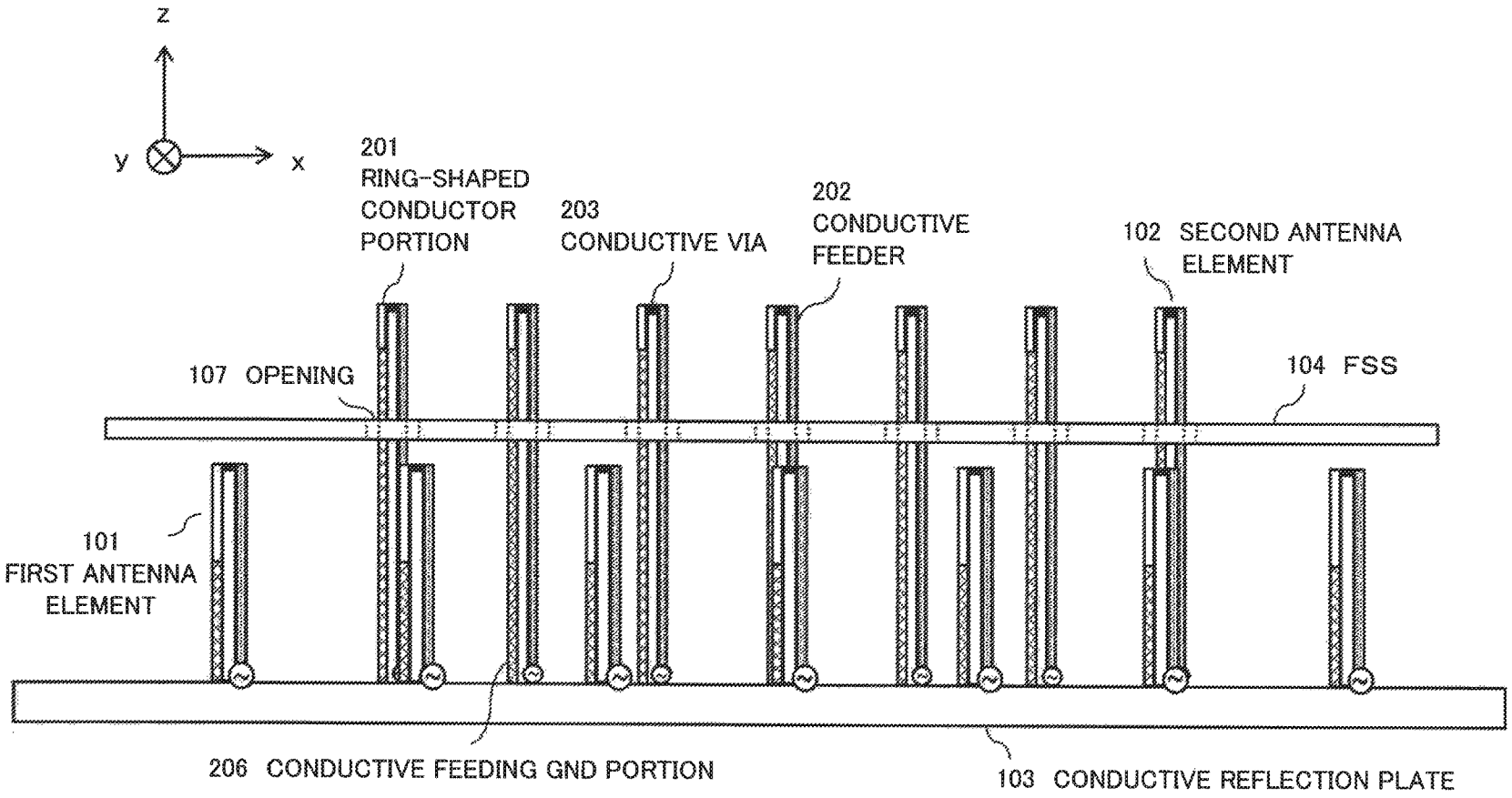
Figure 13:
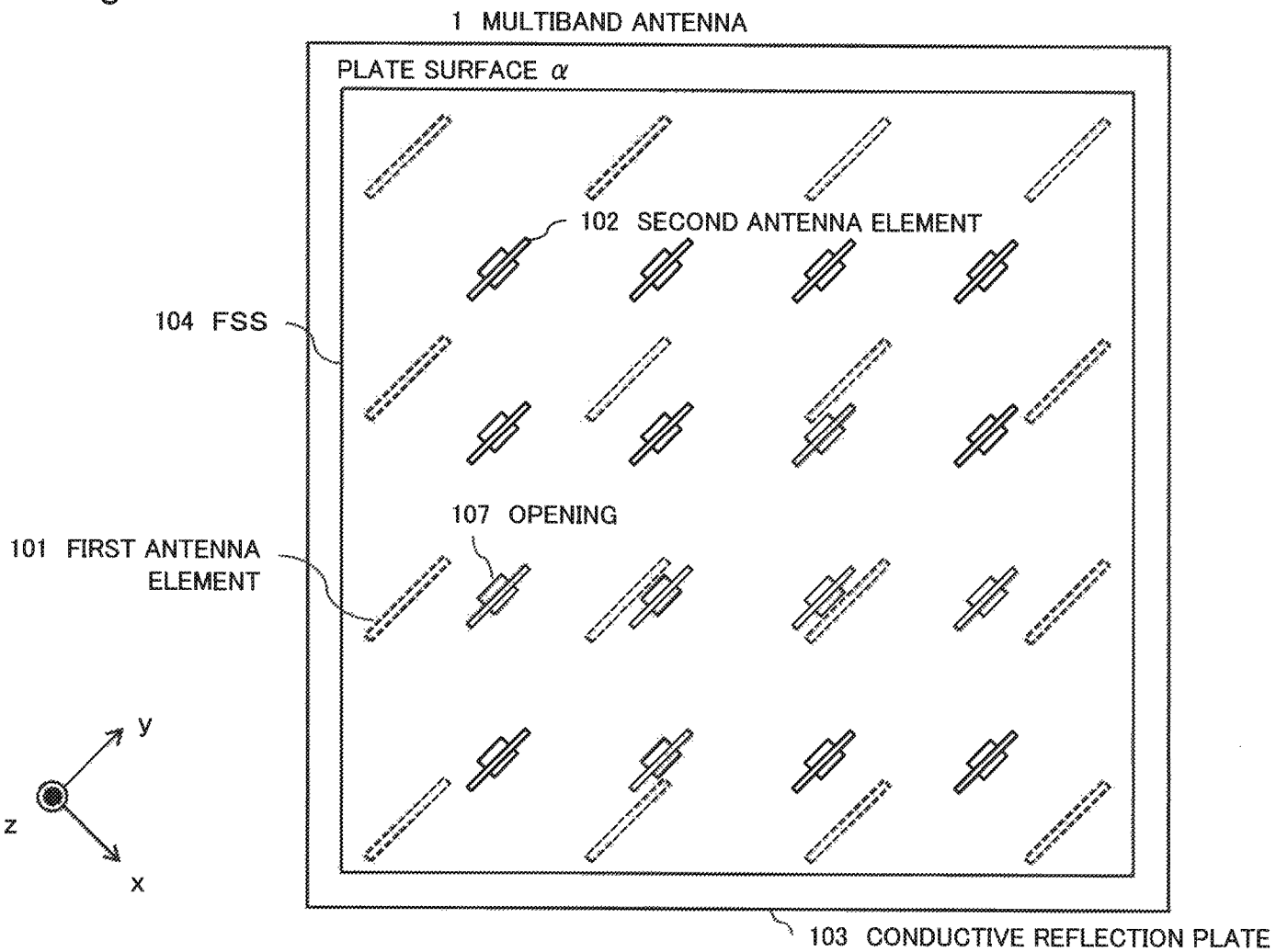
FIG. 13 is a top view illustrating the structure of the multiband antenna 1 in the variation 4 of the present invention.

Configuration diagrams of a multiband antenna 1 using the antenna element 200 of the present variation will now be illustrated in FIGS. 11 to 13. FIGS. 11 to 13 are a yz cross-sectional view, an xz cross-sectional view, and a top view, respectively, of the multiband antenna 1.

Figure 14:
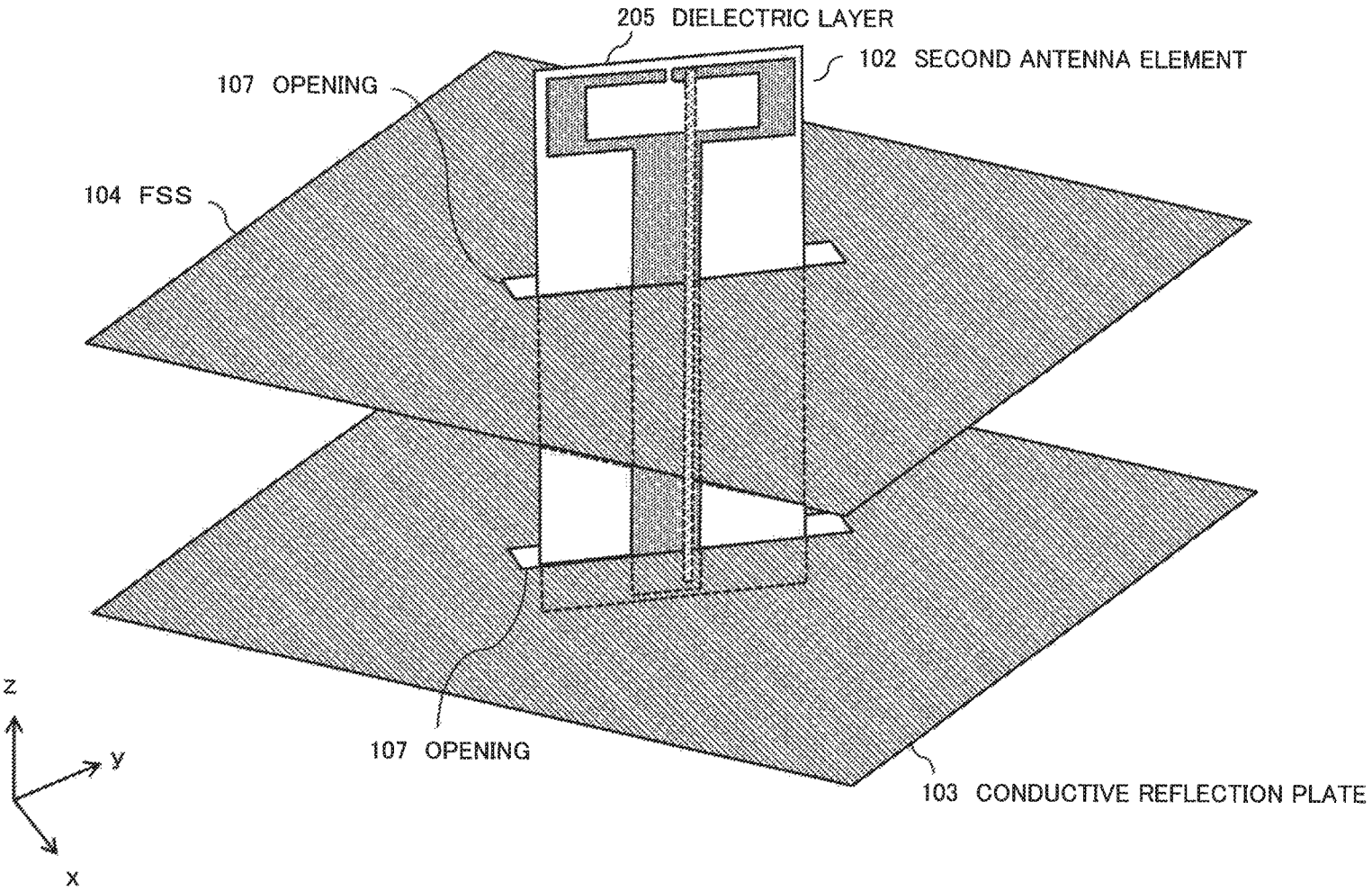
FIG. 14 is a perspective view illustrating a structure of a second antenna element 102 in the variation 4 of the present invention.

Although the multiband antenna 1 illustrated in FIGS. 11 to 13 includes the openings 107 on only the FSS 104, the multiband antenna 1 may also include openings 107 on the conductive reflection plate 103, as illustrated in FIG. 14. In addition, a portion of the transmission line made up of the conductive feeder 202 and the conductive feeding GND portion 206 may be formed in such a way that the portion is coupled to the FSS 104 at a portion around each opening 107.

In the present example embodiment, the dielectric layer 205 of the antenna element 200 may be configured in a rectangle or another shape that includes the ring-shaped conductor portion 201 and the conductive feeding GND portion 206 and the size of which is larger than the combined size of the ring-shaped conductor portion 201 and the conductive feeding GND portion 206, as illustrated in FIG. 14.

Hereinafter, operational effects achieved when the antenna elements 200 are used for the first antenna elements 101 and the second antenna elements 102 of the present example embodiment will be described.

According to the antenna element 200 of the present example embodiment, the ring-shaped conductor portion 201 functions as an LC series resonance circuit (split ring resonator) in which inductance caused by current flowing along the ring and capacitance generated between conductors facing each other at the split portion 107 are connected in series. Around the resonant frequency of the split ring resonator, large current flowing through the ring-shaped conductor portion 201 and a portion of current components contributing to radiation cause the split ring resonator to work as an antenna.

Use of the antenna element 200 of the present example embodiment enables miniaturization to be achieved compared with conventional antennas because the antenna element 200 uses an LC resonance phenomenon in the split ring resonator, differing from a dipole antenna and a patch antenna that use a wavelength resonance phenomenon.

In addition, the inventors have found that, out of current flowing through the ring-shaped conductor portion 201, a current component that mainly contributes to radiation is a current component in the y-axis direction. Therefore, forming the shape of the ring-shaped conductor portion 201 into a rectangle long in the y-axis direction enables the antenna element 200 of the present example embodiment to achieve a good radiation efficiency. However, although, in FIG. 10, the shape of the antenna element 200 is substantially rectangular, the antenna element 200 having another shape does not influence the essential effects of the present example embodiment.

For example, the shape of the antenna element 200 may also be a square, a circle, a triangle, a bowtie shape, and the like.

Further, as a result of detailed examination of electric field distribution in the resonance mode of the ring-shaped conductor portion 201 of the present example embodiment, the inventors have found that a virtual ground surface is formed on a plane that includes a middle portion in the y-axis direction of the ring-shaped conductor portion 201 and is orthogonal to the y-axis.

For this reason, in the antenna element 200 of the present example embodiment, the conductive feeding GND portion 206 is connected to the middle portion in the y-axis direction of the ring-shaped conductor portion 201 so that the conductive feeding GND portion 206 is positioned around the virtual ground surface. Employing such a configuration enables the ring-shaped conductor portion 201 and the conductive reflection plate 103 to be electrically connected to each other without substantially affecting radiation patterns and radiation efficiency.

The conductive feeder 202 forms a transmission line in a region facing the conductive feeding GND portion 206 by capacitively coupling to the conductive feeding GND portion 206. As a result, an RF signal generated in a not-illustrated RF circuit is transmitted by way of the conductive feeder 202 and is fed to the ring-shaped conductor portion 201.

Since a portion of electromagnetic waves radiated from the ring-shaped conductor portion 201 are reflected by the conductive reflection plate 103 or the FSS 104, the antenna element 200 of the present example embodiment has a radiation pattern that has directivity in the positive z-axis direction. This feature enables electromagnetic waves to be radiated in a specific direction efficiently.

Methods for increasing the radiation efficiency of the antenna element 200 will be described in detail in a description of the second example embodiment.

The resonance frequency of a split ring resonator can be shifted to lower frequencies by increasing inductance through lengthening a current path by means of increase in the size of the ring in the ring-shaped conductor portion 201 or by increasing capacitance through narrowing a gap between the conductors facing each other at the split portion 107.

Methods for increasing the capacitance of the antenna element 200 will be described in detail in the description of the second example embodiment.

In the above configuration, it is preferable that the conductive feeding GND portion 206 be coupled to, out of the outer edge on the lower side of the ring-shaped conductor portion 201, a vicinity of the middle in the extending direction (y-axis direction), which constitutes an electrical short-circuit plane when in resonance, as described above.

More in detail, a plane (xz-plane in FIG. 10) that includes the middle in the extending direction (y-axis direction in FIG. 10) of the ring-shaped conductor portion 201 and is perpendicular to the extending direction of the ring-shaped conductor portion 201 constitutes the electrical short-circuit plane when in resonance. If a plane is located, in the extending direction of the ring-shaped conductor portion 201, within a range of a quarter of the length L in the extending direction of the ring-shaped conductor portion 201 from the electrical short-circuit plane, the plane can be considered to approximately constitute a short-circuit plane.

Therefore, it is preferable that the conductive feeding GND portion 206 be coupled to a position within the above range, that is, a range of a half of the length L in the extending direction of the ring-shaped conductor portion 201 centering around the middle (electrical short-circuit plane) in the extending direction of the ring-shaped conductor portion 201 (a range of ±1/4 from the center). In addition, it is preferable that the length in the width direction (y-axis direction) of the conductive feeding GND portion 206 along the extending direction of the ring-shaped conductor portion 201 be shorter than or equal to a half of the length L in the extending direction of the ring-shaped conductor portion 201.

However, even when the conductive feeding GND portion 206 is positioned in a range other than the above-described range, the configuration does not affect the essential operational effects of the present example embodiment. In addition, even when the length in the width direction of the conductive feeding GND portion 206 as viewed in the extending direction of the ring-shaped conductor portion 201 is a length other than the above-described length, the configuration does not affect the essential effects of the present example embodiment.

As described above, the antenna element 200 according to the first example embodiment enables a multiband antenna 1 to be achieved that has a small size and is capable of suppressing, as much as possible, influence of the transmission line on the resonance characteristics of the ring-shaped conductor portion 201, the characteristic of the FSS 104 transmitting therethrough and reflecting thereon electromagnetic waves.

<Variation 5>

A variation of the multiband antenna 1 using the antenna element 200 will be described below as a variation 5.

When the antenna elements 200 are disposed in a posture parallel with the plate surface α of the conductive reflection plate 103, the multiband antenna 1 may, for example, be configured as follows.

Specifically, the antenna elements 200 and the conductive reflection plate 103 are configured in different layers, respectively, in an identical substrate. In addition, each of the conductive feeding GND portions 206 is connected to the layer in which the conductive reflection plate 103 is configured by way of a conductive via in the substrate, and each of the conductive feeders 202 is also connected to the layer in which the conductive reflection plate 103 is configured by way of another conductive via in the substrate. In this way, the whole of the multiband antenna 1 may be formed as an integrated substrate.

In addition, when a plurality of antenna elements 200 are configured in an identical substrate, the respective conductive feeding GND portions 206 may also be configured in the identical substrate in the same manner.

<Variation 6>

A variation of the antenna element 200 will be described below as a variation 6. Note that the multiband antenna 1 may be achieved by appropriately combining various variations that were described above or will be described below.

Figure 15:
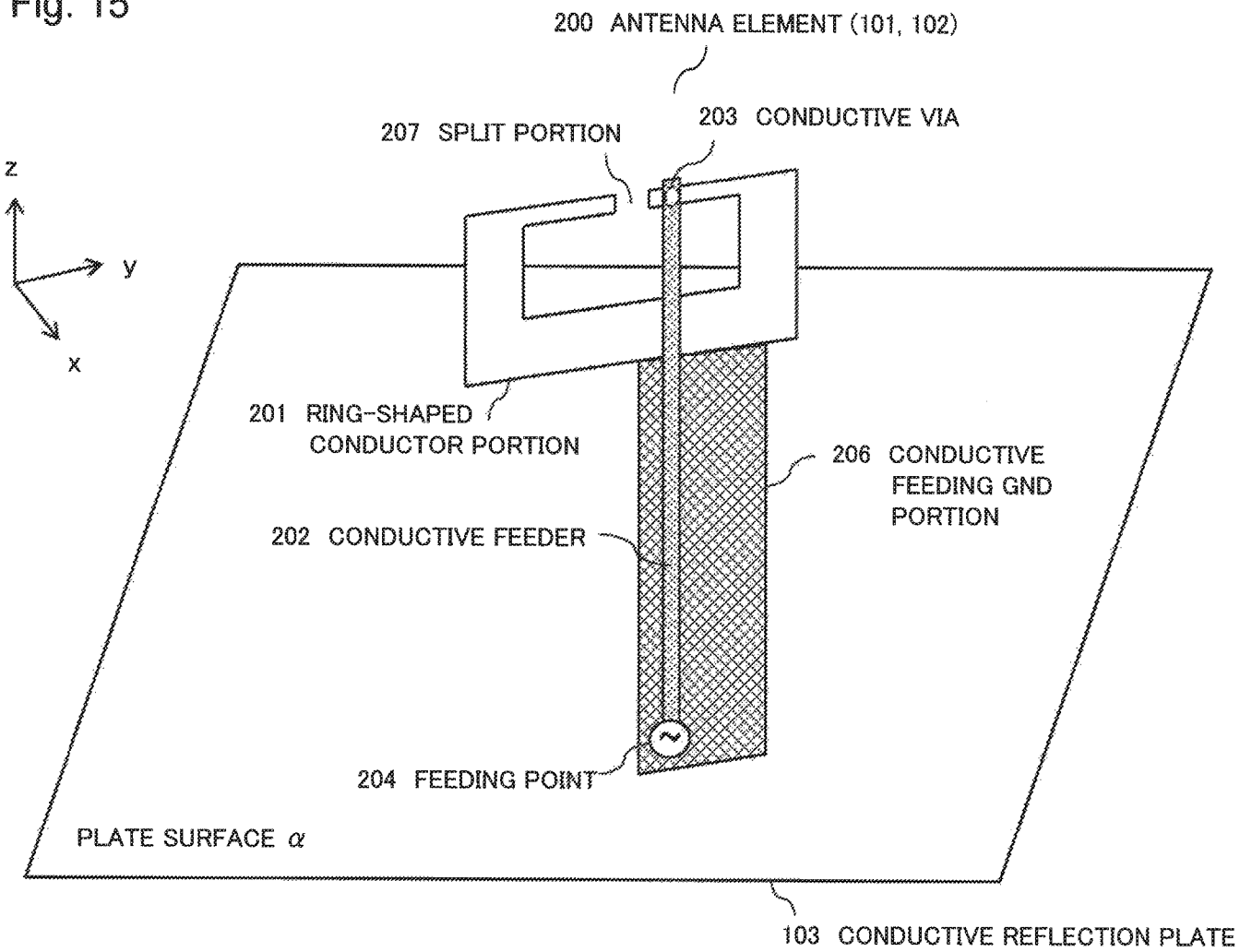
FIG. 15 is a perspective view illustrating a structure of an antenna element 200 in a variation 6 of the present invention.

FIG. 15 is a perspective view of the antenna element 200 of the present variation.

Even when the conductive feeding GND portion 206 is positioned in a range other than the range described in the variation 4 (FIG. 10), the configuration does not affect the essential effects of the present example embodiment. In addition, even when the length in the width direction (y-axis direction) of the conductive feeding GND portion 206 is a length in a range other than the range (length L) described in the variation 4, the configuration does not affect the essential effects of the present example embodiment.

For example, as illustrated in FIG. 15, one end in the width direction (y-axis direction) of the conductive feeding GND portion 206 is in contact with a position within a range of ±1/4 from the middle (electrical short-circuit plane) in the extending direction of the outer edge on the lower side of the ring-shaped conductor portion 201. On the other hand, the other end is in contact with a position outside the range of a quarter of the length L in the extending direction of the antenna element 200 from the above-described electrical short-circuit plane. The antenna element 200 may be configured even in such a mode as long as influence of the conductive feeding GND portion 206 on the antenna element 200 is within an allowable range. In addition, a case may be conceived where, depending on the disposition of the first antenna elements 101 and the second antenna elements 102, the conductive feeding GND portions 206 coupled to the second antenna elements 102 and the conductive feeders 202 paired therewith physically interfere with the first antenna elements 101 disposed on the lower side. In such a case, the interference may be avoided by using a deformed shape as illustrated in FIG. 15. However, when the first antenna elements 101 and the second antenna elements 102 have the structure of the antenna element 200 in FIG. 10 described in the variation 4 or variations thereof, the above-described interference becomes difficult to occur because the size in the uneven distribution direction of each antenna element is as small as approximately λ/4.

In the multiband antenna 1 of the variation 4 (FIGS. 11 to 13), the respective conductive feeding GND portions 206 of the first antenna elements 101 and the second antenna elements 102 are separately formed and are separated from one another. However, in a multiband antenna according to other example embodiments, the conductive feeding GND portions 206 may be coupled to one another within an allowable range of influence of the conductive feeding GND portions 206 on the resonance characteristics of the respective first antenna elements 101 and second antenna elements 102.

Input impedance to the antenna element 200 as viewed from the feeding point 204 depends on a connection position between the conductive via 203 and the ring-shaped conductor portion 201 and characteristic impedance of the transmission line configured with the conductive feeder 202 and the conductive feeding GND portion 206, which extend in the perpendicular direction (z-axis direction). Matching the characteristic impedance of the above-described transmission line with the input impedance of the split ring resonator enables wireless communication signals to be fed to the antenna without reflection between the above-described transmission line and the split ring resonator. However, even when the impedances are not matched with each other, the impedance mismatch does not affect the essential effects of the present invention.

<Variation 7>

Figure 16:
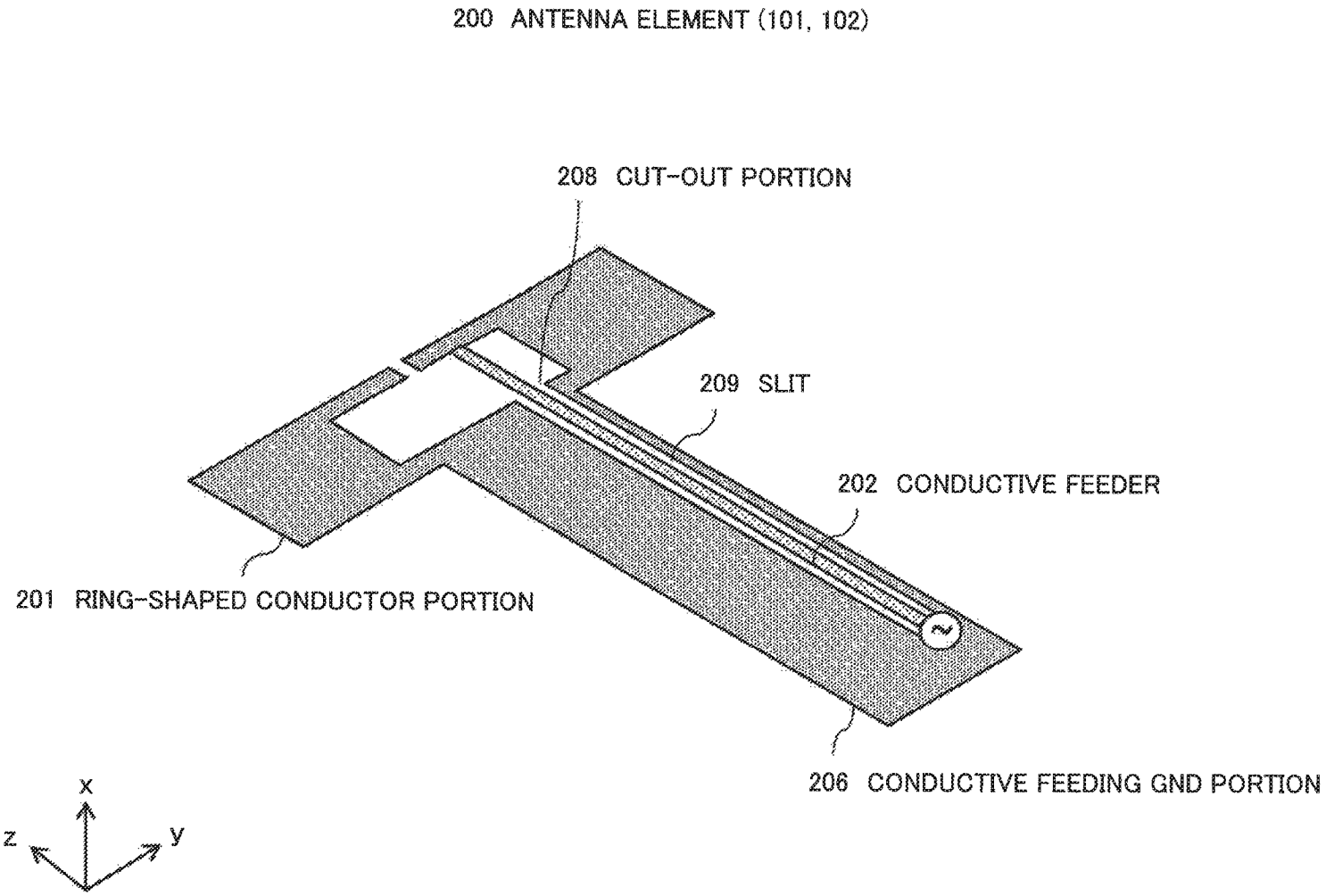
FIG. 16 is a perspective view illustrating a structure of an antenna element 200 in a variation 7 of the present invention.

FIG. 16 is a diagram illustrating a structure of an antenna element 200 of a variation 7.

As illustrated in FIG. 16, the antenna element 200 may be formed in a mode in which a transmission line configured with the extending conductive feeder 202 and conductive feeding GND portion 206 is formed into a coplanar line and the ring-shaped conductor portion 201, the conductive feeder 202, and the conductive feeding GND portion 206 are formed in an identical layer.

Specifically, the antenna element 200 has, out of the sides in the circumferential direction of the ring-shaped conductor portion 201, a portion of the long side on the side closer (negative z-axis direction) to the conductive reflection plate 103 cut out and has the conductive feeder 105 passing through the cut out portion (cut-out portion 208). The cut-out portion 208 is continuously communicated with a slit 209, which is formed by cutting out a portion in the surface of the conductive feeding GND portion 206. The conductive feeder 202 being inserted through the inside of the slit 209 toward the plate surface α of the conductive reflection plate 103 (negative z-axis direction) enables a transmission line configured with the above-described conductive feeder 202 and conductive feeding GND portion 206 to be formed into a coplanar line.

<Variation 8>

Figure 17:
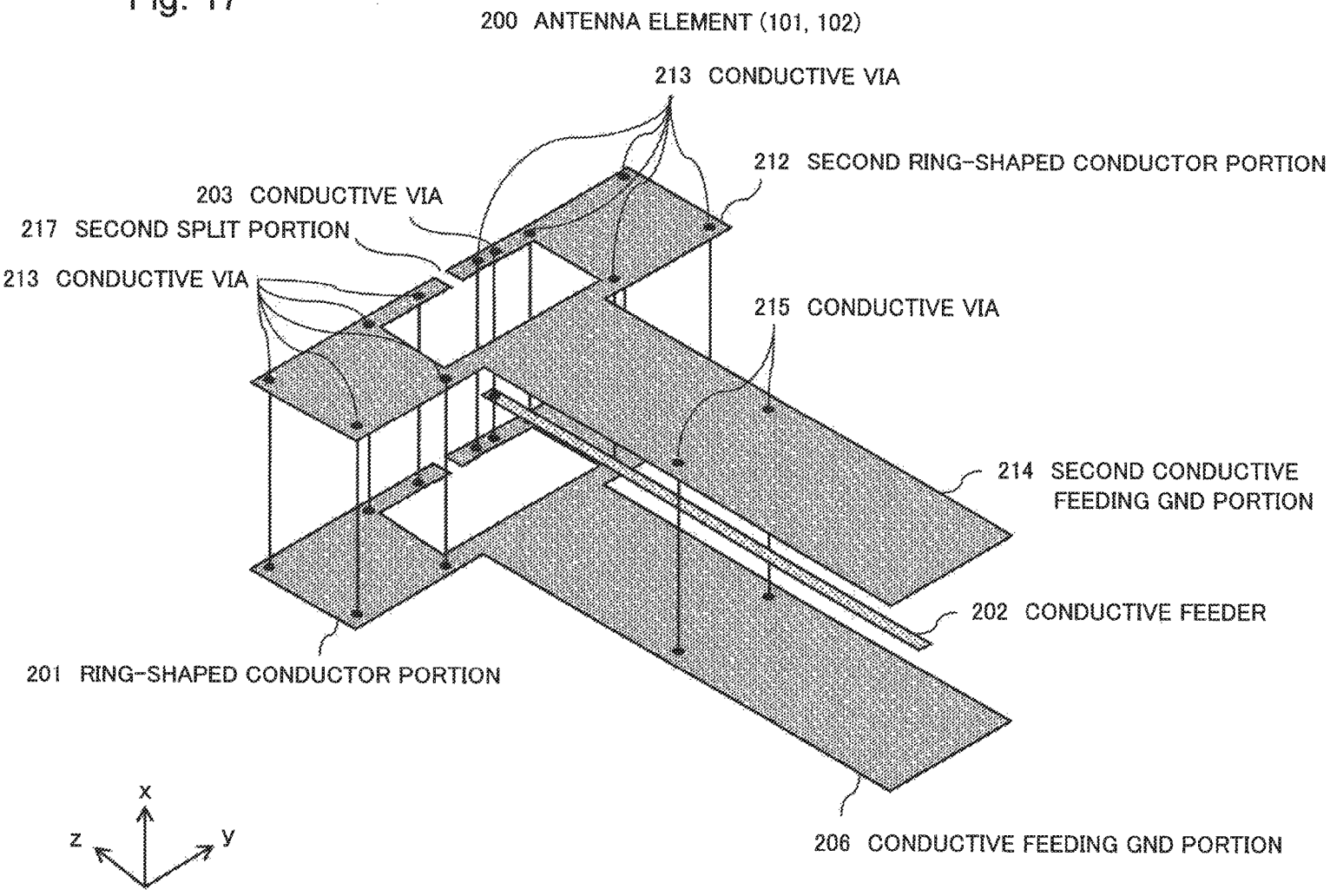
FIG. 17 is a perspective view illustrating a structure of an antenna element 200 in a variation 8 of the present invention.

FIG. 17 is a diagram illustrating a structure of an antenna element 200 of a variation 8.

As illustrated in FIG. 17, the antenna element 200 may further include, in addition to the configuration of the variation 4, a second ring-shaped conductor portion 212, a plurality of conductive vias 213, a second conductive feeding GND portion 214, and a plurality of conductive vias 215. In the example illustrated in FIG. 17, the second ring-shaped conductor portion 212 and the second conductive feeding GND portion 214 are disposed in a layer that is different from the layers in which the ring-shaped conductor portion 201 and the conductive feeder 202 are respectively disposed. In this case, a position at which the split portion 207 is disposed in the circumferential direction of the ring-shaped conductor portion 201 and a position at which a second split portion 217 is disposed in the circumferential direction of the second ring-shaped conductor portion 212 coincide with each other as viewed from the direction (x-axis direction) perpendicular to a plane on which the ring-shaped conductor portion 201 is disposed. The ring-shaped conductor portion 201 and the second ring-shaped conductor portion 212 work as a single split ring resonator.

The second conductive feeding GND portion 214 is, in the same manner that the conductive feeding GND portion 206 is connected to the ring-shaped conductor portion 201, connected to the second ring-shaped conductor portion 212 in the same layer as that in which the second ring-shaped conductor portion 212 is disposed. The second ring-shaped conductor portion 212 and the second conductive feeding GND portion 214 face the ring-shaped conductor portion 201 and the conductive feeding GND portion 206 with the conductive feeder 202 interposed therebetween.

The plurality of conductive vias 213 connect the ring-shaped conductor portion 201 and the second ring-shaped conductor portion 212 electrically.

The plurality of conductive vias 215 connect the conductive feeding GND portion 206 and the second conductive feeding GND portion 214 electrically.

In this case, the conductive feeder 202 has a large portion of the periphery thereof surrounded by the conductive feeding GND portion 206, the second conductive feeding GND portion 214, and the plurality of conductive vias 215 in addition to the ring-shaped conductor portion 201, the second ring-shaped conductor portion 212, and the plurality of conductive vias 213, which are conductors that are conductive with each other. The above configuration enables radiation of unnecessary signal electromagnetic waves from the conductive feeder 202 to be reduced. In addition, in the second antenna elements 102, it is possible to reduce influence that the transmission lines penetrating the FSS 104 receive from the FSS 104 therearound.

Figure 18:
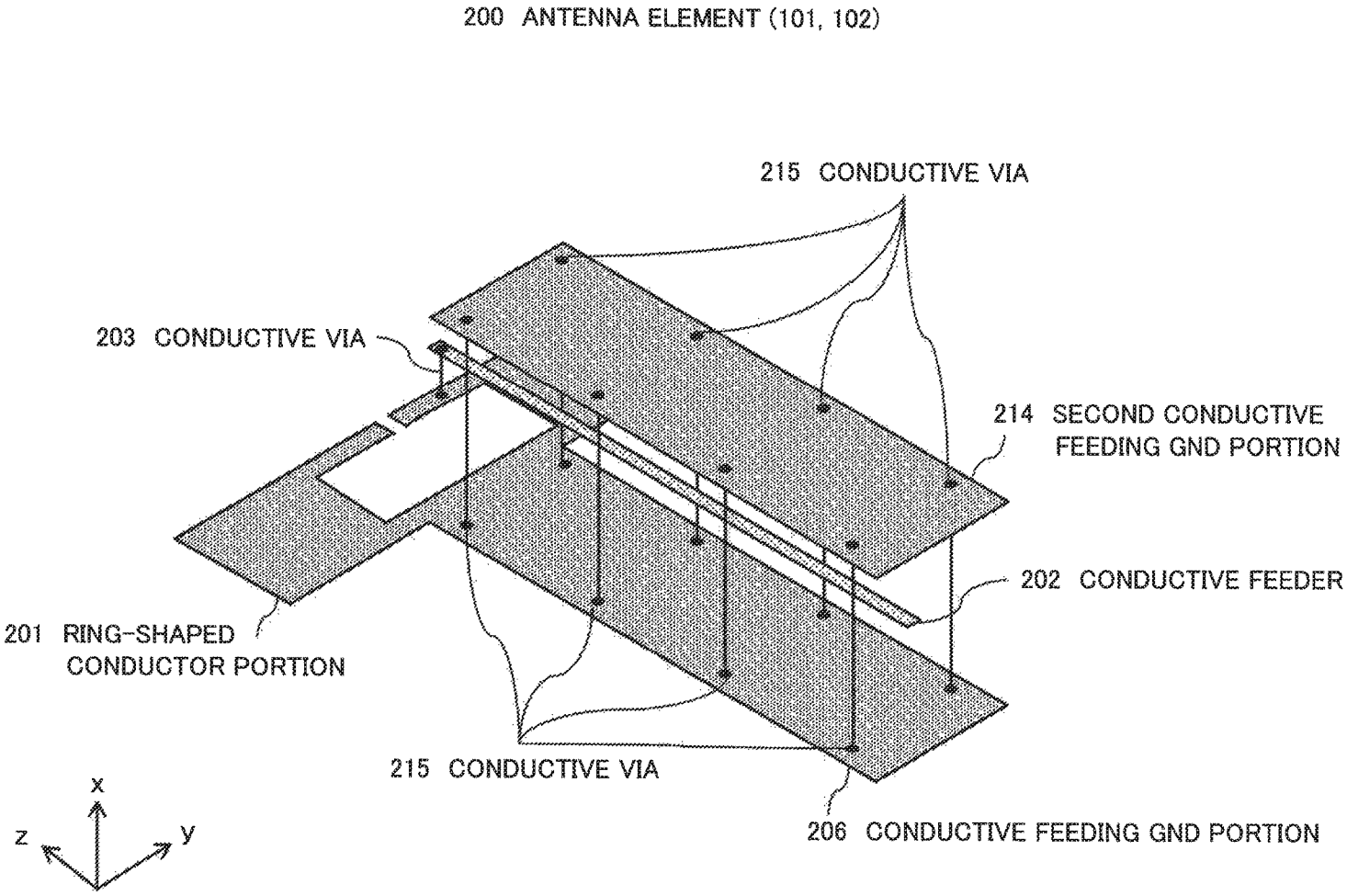
FIG. 18 is a perspective view illustrating another structure of the antenna element 200 in the variation 8 of the present invention.

In FIG. 17, a configuration in which both the second ring-shaped conductor portion 212 and the second conductive feeding GND portion 214 are included is illustrated. However, a configuration in which only either the second ring-shaped conductor portion 212 or the second conductive feeding GND portion 214 is included may be considered. For example, in the case of a configuration in which only the second conductive feeding GND portion 214 is included as illustrated in FIG. 18, it is possible to, as with the configuration in FIG. 17, confine electromagnetic waves transmitted by the conductive feeder 202 by the plurality of conductive vias 215, the conductive feeding GND portion 206, and the second conductive feeding GND portion 214. For this reason, it is possible to reduce radiation of unnecessary signal electromagnetic waves from the conductive feeder 202. In addition, in the second antenna elements 102, it is possible to reduce influence that the transmission lines penetrating the FSS 104 receive from the FSS 104 therearound.

Figure 67:
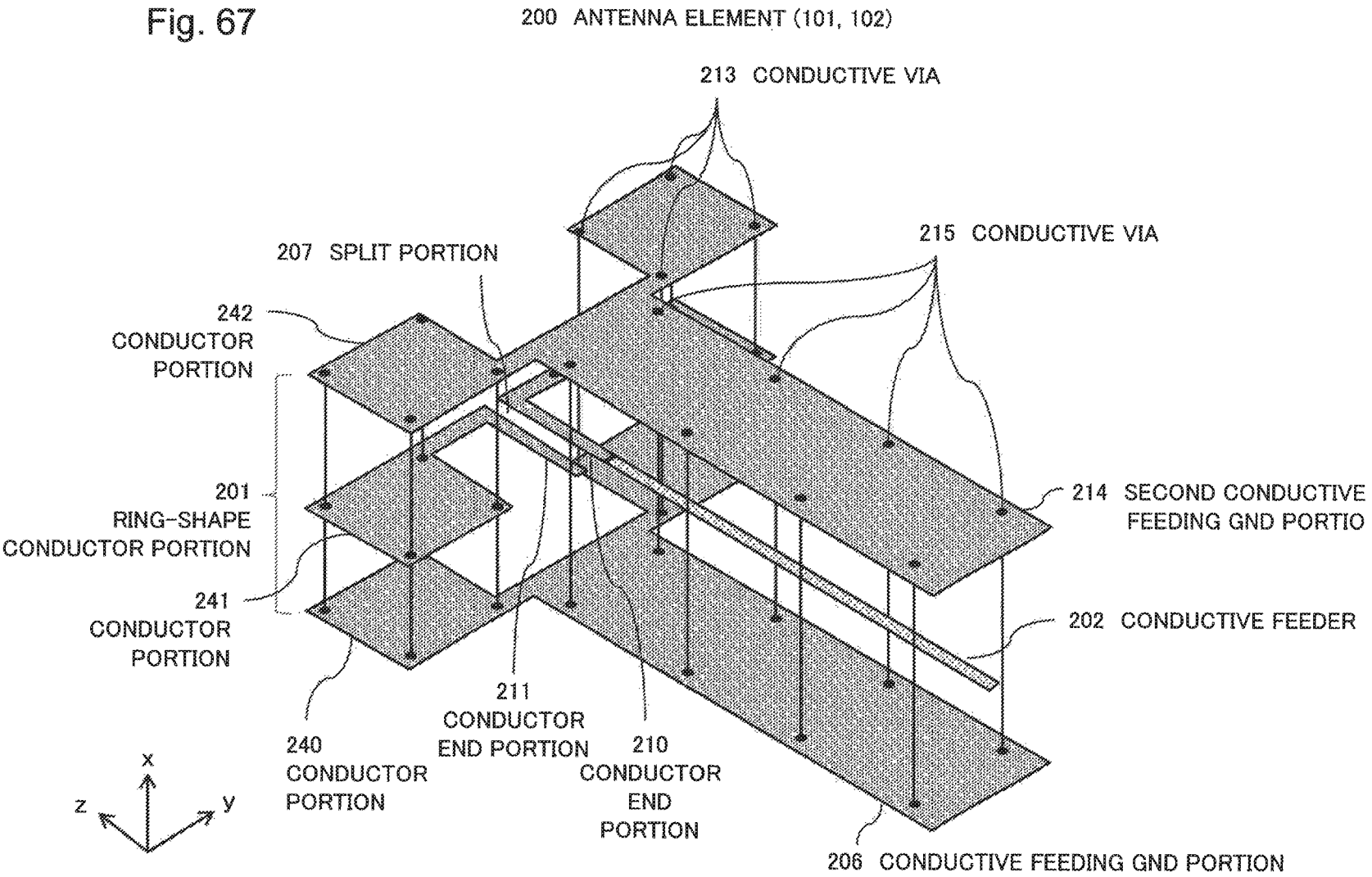
FIG. 67 is a perspective view illustrating still another structure of the antenna element 200 in the variation 8 of the present invention.

In addition, the antenna element 200 may use three-layered conductor portions 240 to 242 in place of the ring-shaped conductor portion 201 in FIG. 18, as illustrated in FIG. 67.

The conductor portions 240 to 242 are configured so that the three layers work as a single ring-shaped conductor.

The conductor portions 241, which are the second layer, are configured in such a manner that a long side portion facing the split portion 207 with a void space interposed therebetween is removed from the ring-shaped conductor portion 201. The conductor portions 241 are disposed in the same layer as the conductive feeder 202. The conductive feeder 202 is directly connected to the conductor end portion 210 or the conductor end portion 211, both of which form the split portion 207 of the conductor portions 241, without the conductive via 203 interposed therebetween (in FIG. 67, connected to the conductor end portion 210).

The conductor portion 240, which is the first layer, and the conductor portion 242, which is the third layer, that sandwich the conductor portions 241 therebetween are configured in such a manner that a long side portion including the split portion 207 is removed from the ring-shaped conductor portion 201.

The conductor portion 240 is disposed at the position of the ring-shaped conductor portion 201 in FIG. 17. The conductor portion 242 is disposed at the position of the second ring-shaped conductor portion 212 in FIG. 17.

Employing the configuration described above enables the conductor end portions 210 and 211, which constitute the split portion 207, to bend in a direction (negative z-axis direction) that is substantially orthogonal to the direction in which the conductor end portions 210 and 211 face each other and to extend in the direction in which the conductive feeding GND portion 206 and the second conductive feeding GND portion 214 extend. Since such a configuration increases the facing area of the conductor end portions 210 and 211, which face each other with the split portion 207 interposed therebetween, capacitance at the split portion 207 may be increased.

In addition, employing the configuration as described above causes the split portion 207 to be formed inside the dielectric layer 205 (not illustrated). For this reason, the antenna element 200 in which influence of an object present outside the dielectric layer 205 on capacitance generated at the split portion 207 is reduced is achieved.

<Variation 9>

Figure 19:
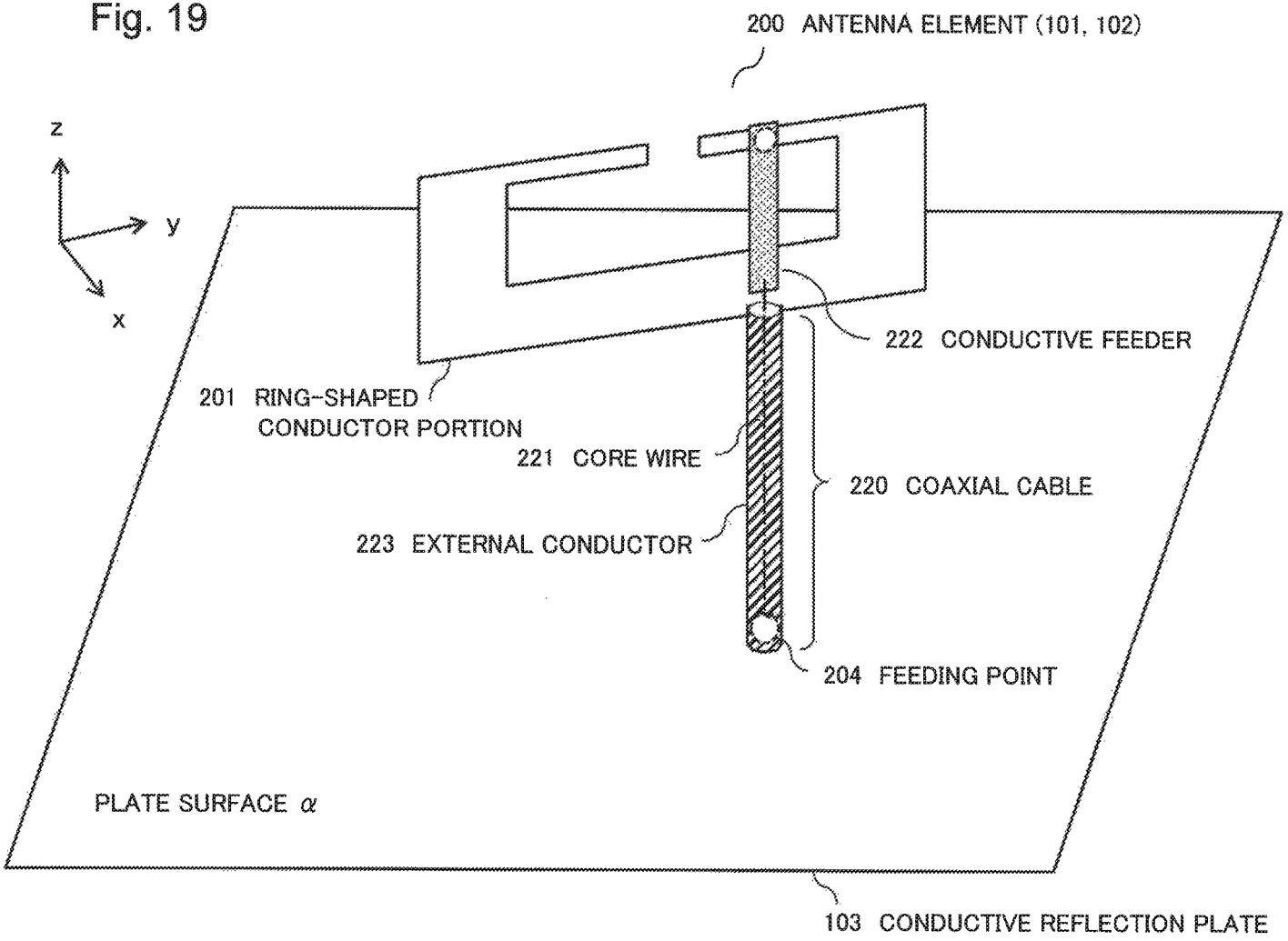
FIG. 19 is a perspective view illustrating a structure of an antenna element 200 in a variation 9 of the present invention.

FIG. 19 is a diagram illustrating a structure of an antenna element 200 of a variation 9.

The transmission line described in the variation 4, which is configured with the conductive feeder 202 and the conductive feeding GND portion 206, may be a coaxial line.

As illustrated in FIG. 19, the antenna element 200 includes a conductive feeder 222 that has a similar configuration to the conductive feeder 202. In addition, a coaxial cable 220 is coupled to the antenna element 200. The coaxial cable 220 is configured with a core wire 221 and an external conductor 223. In the configuration, the core wire 221 is connected to the conductive feeder 222, and the external conductor 223 is connected to the outer edge on the lower side of the ring-shaped conductor portion 201. In addition, the feeding point 204 is placed so as to apply electrical excitation between the core wire 221 and the external conductor 223. In the above configuration, the core wire 221 and the conductive feeder 222, which are connected to each other, are equivalent to the conductive feeder 202, and the external conductor 223 is equivalent to the conductive feeding GND portion 206 that is formed cylindrically.

Figure 20:
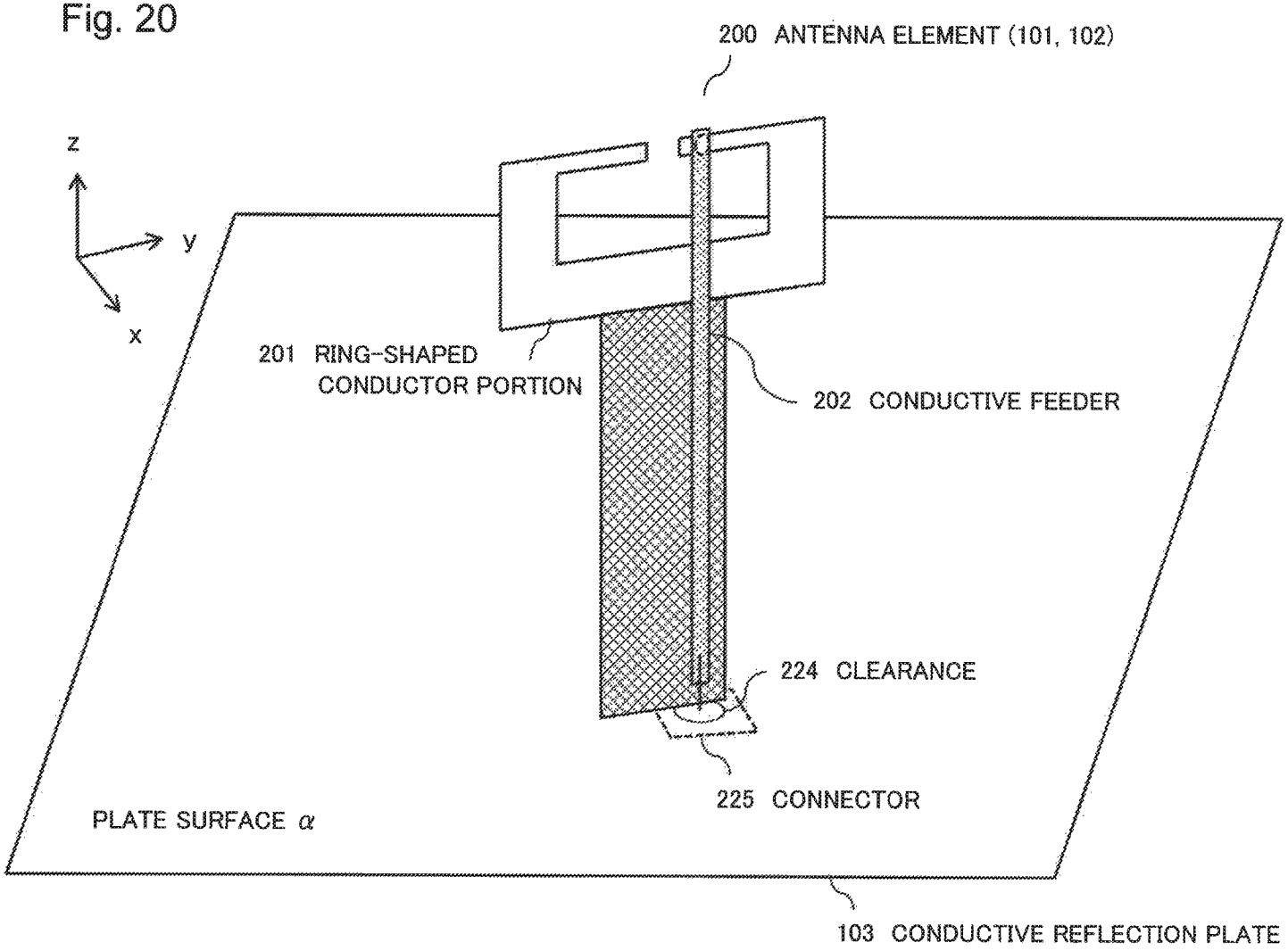
FIG. 20 is a perspective view illustrating another structure of the antenna element 200 in the variation 9 of the present invention.
Figure 21:
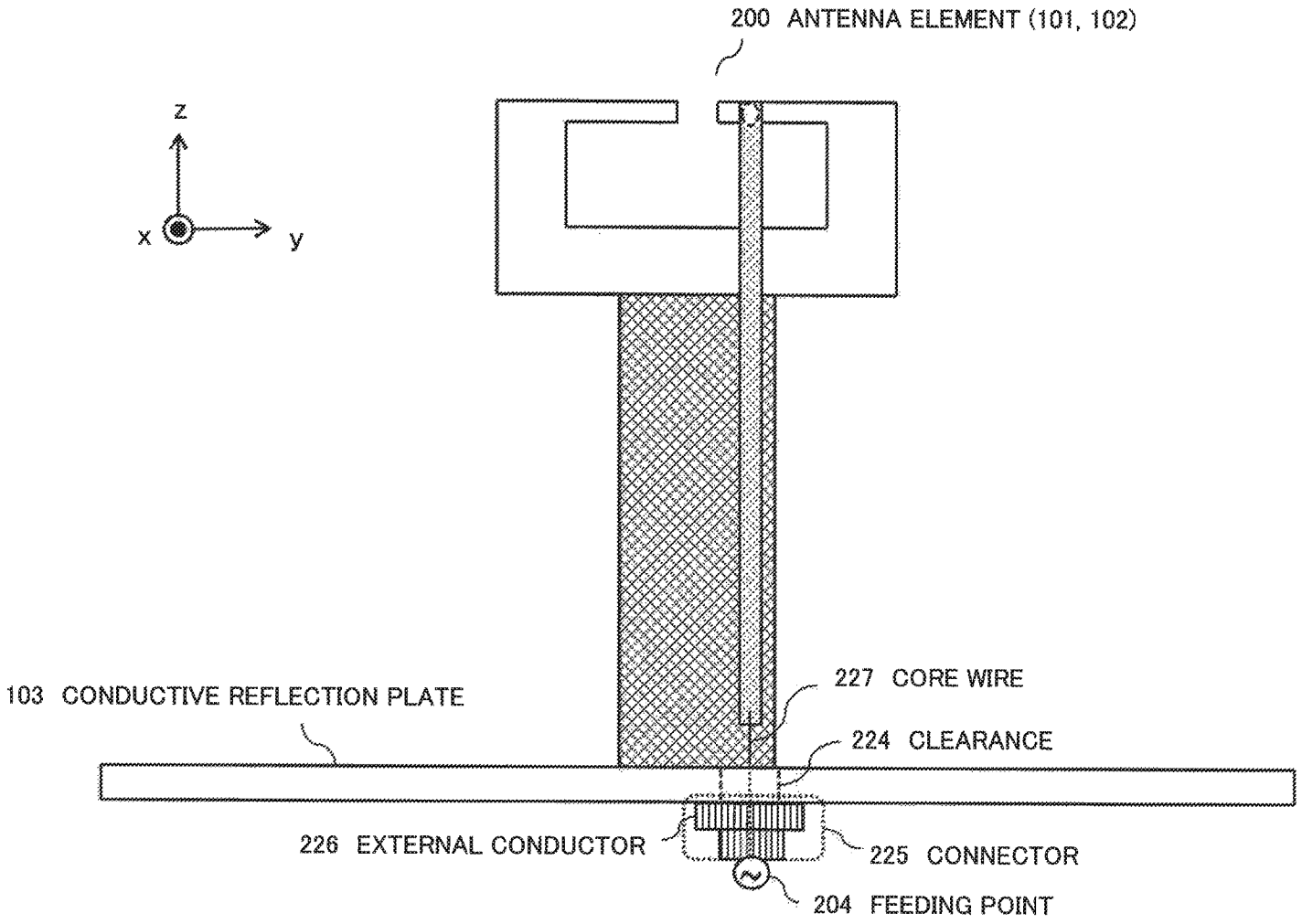
FIG. 21 is a plan view illustrating the another structure of the antenna element 200 in the variation 9 of the present invention.

When a coaxial cable is used, a connector 225 may be placed on the backside (negative z-axis direction side) of the plate surface α of the conductive reflection plate 103 (see FIGS. 20 and 21).

As illustrated in FIG. 20, a clearance 224, which serves as a through-hole, is formed on the conductive reflection plate 103. In addition, at a position on the backside (negative z-axis direction side) of the plate surface α of the conductive reflection plate 103 corresponding to the position of the clearance 224, the connector 225 is placed. The connector 225 is a connector to which a not-illustrated coaxial cable is connected.

In the above configuration, an external conductor 226 of the connector 225 is electrically connected to the conductive reflection plate 103, as illustrated in FIG. 21. A core wire 227 of the connector 225 is inserted into the inside of the clearance 224, penetrates the plate surface α of the conductive reflection plate 103 to the upper side (positive z-axis direction side) thereof, and is electrically connected to the conductive feeder 202 of the antenna element 200. Further, the feeding point 204 is capable of applying electrical excitation between the core wire 227 and the external conductor 226 of the connector 225.

Employing the configuration described above enables the antenna element 200 on the upper side of the conductive reflection plate 103 to be fed from a wireless communication circuit (the above-described RF unit 72), a digital circuit, or the like disposed on the backside of the conductive reflection plate 103. For this reason, a wireless communication device 1 may be configured without substantially influencing radiation patterns and radiation efficiency.

Note that, although, in the example illustrated in FIGS. 20 and 21, a coaxial cable is placed on the backside of the conductive reflection plate 103, it is sufficient that a conductor composing a transmission line is placed on the backside of the conductive reflection plate 103, and the conductor does not always have to be a core wire of a coaxial cable.

<Variation 10>

Figure 22:
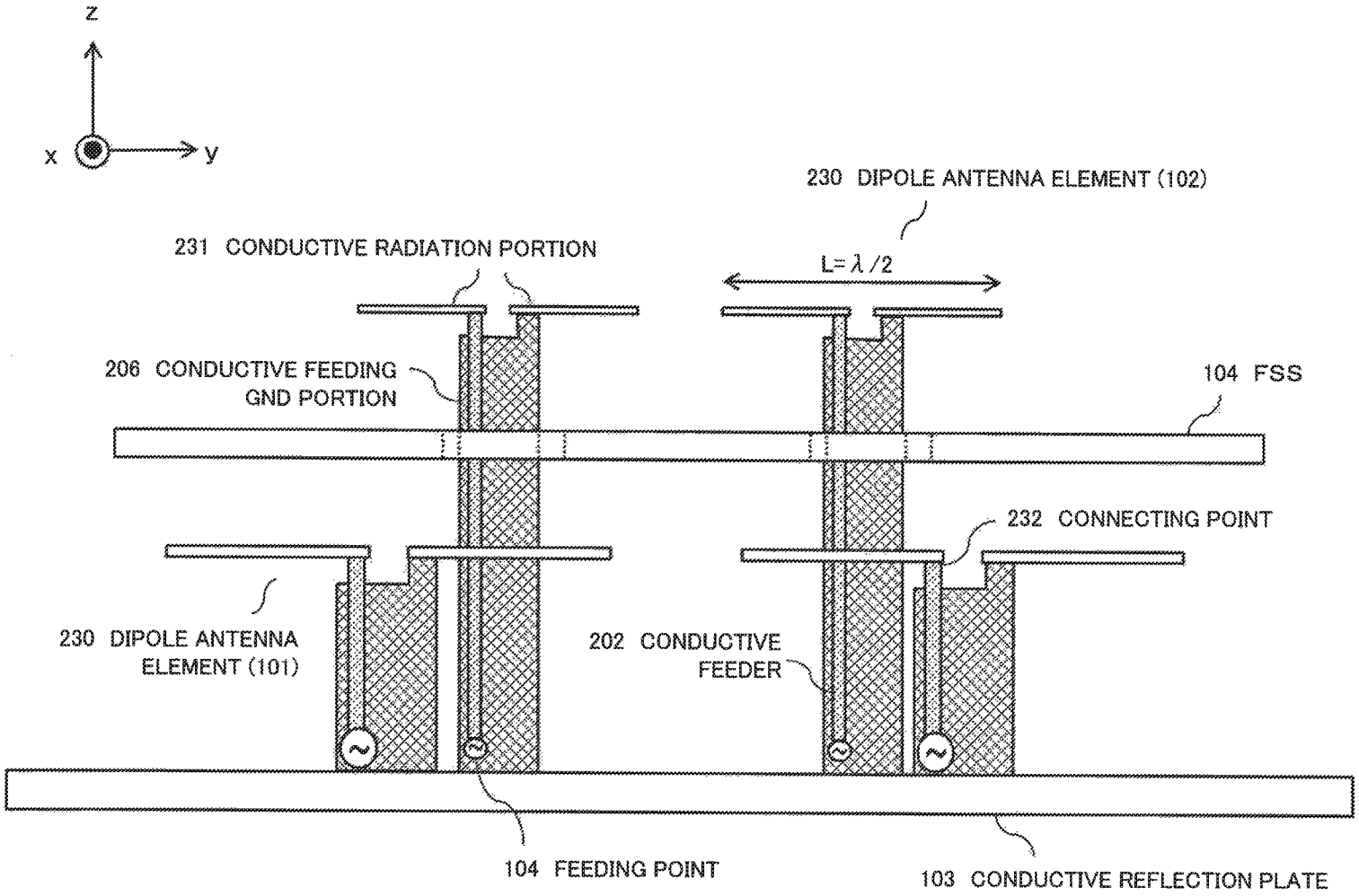
FIG. 22 is a plan view illustrating a structure of a multiband antenna 1 in a variation 10 of the present invention.

FIG. 22 is a diagram illustrating a structure of a multiband antenna 1 of a variation 10.

In the present variation, each antenna element 200 is configured with a dipole antenna element 230.

The dipole antenna element 230 includes two pole-shaped conductive radiation portions 231 that extend on an identical axis (on the y-axis) along the plate surface α and a feeding point 104. The length L in the extending direction of the two conductive radiation portions 231 of the dipole antenna element 230 is set at approximately a half of wavelength λ.

Even when the antenna element 200 is a dipole antenna element, vicinities of both ends and a vicinity of the middle in the extending direction can be considered to constitute electrical open-circuit planes and an electrical short-circuit plane, respectively, when in resonance.

Specifically, connecting the conductive feeding GND portion 206 to the vicinity of the middle in the extending direction of the dipole antenna element 230 enables a transmission line connected to the dipole antenna element 230 to be formed without influencing the resonance characteristics.

Specifically, as illustrated in FIG. 22, the conductive feeder 202 is, at one end thereof, connected to one of two conductive radiation portions 231 that are disposed on the identical axis via a connecting point 232. In addition, the conductive feeder 202 extends to a vicinity of the plate surface α on the lower (negative z-axis direction) side of the connecting point 232 and is, at the other end thereof, connected to the feeding point 204.

In addition, the conductive feeder 206 is, at one end thereof, connected to the other of the two conductive radiation portions 231 that are disposed on the identical axis. The conductive feeding GND portion 206 extends from the conductive radiation portion 231 to the plate surface α on the lower side and is, at the other end thereof, connected to the plate surface α.

The conductive feeder 202 and the conductive feeding GND portion 206 extend collaterally in an identical direction (z-axis direction) with a space therebetween.

The feeding point 204 applies electrical excitation between the above-described other end of the conductive feeder 202 and the conductive feeding GND portion 206 in a vicinity of the other end.

Although, in the present example embodiment, the antenna element 200 is assumed to be an antenna element that works as a split ring resonator or a dipole antenna element, other antenna structures, such as a patch antenna, may also be employed. When the antenna elements 200 are patch antennas, the distance $T_1$ of the first antenna elements 101 from the conductive reflection plate 103 and the distance $T_2$ of the second antenna elements 102 from the FSS 104 are generally reduced to substantially less than a quarter of the wavelengths of electromagnetic waves having the operating frequencies of the respective antenna elements. However, it is desirable to avoid physical interference of transmission line structures including the conductive feeding GND portions 206 that the second antenna elements 102 include with the first antenna elements 101. For this purpose, each of the first antenna elements 101 is formed into a shape that can be considered to be a substantially linear shape as viewed in plan view, such as an antenna structure that was described in the variation 4 (and stands perpendicularly to the plate surface α) and a dipole antenna element of the present variation. Employing such a structure causes the antenna elements to be separated wider from each other and to become difficult to interfere with the transmission line structures. In addition, in order to suppress influence of the second antenna elements 102 as metal objects on the first antenna elements 101, it is more desirable that each second antenna element 102 have a structure constituting a split ring resonator of the variation 4 and the like that has a small antenna element size.

Second Example Embodiment

Figure 23:
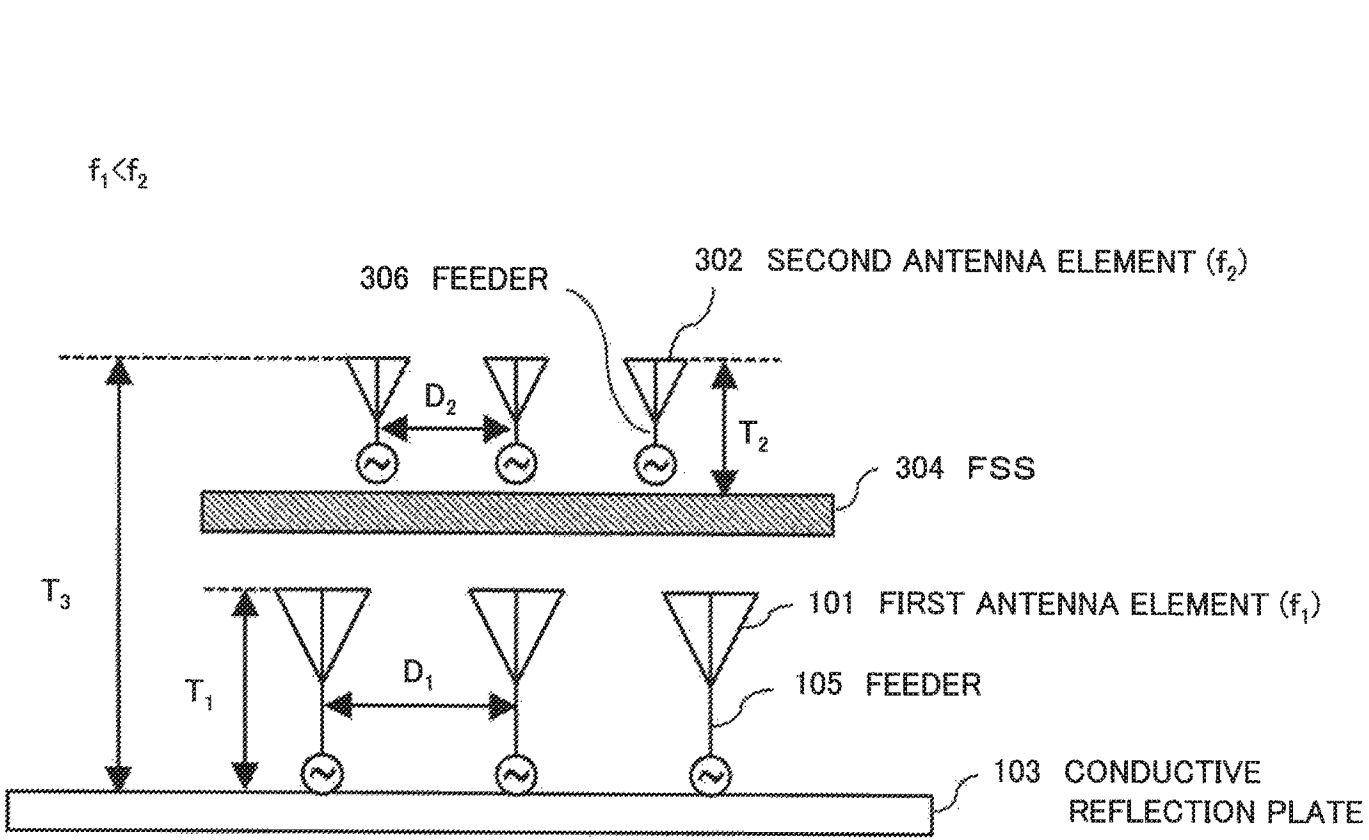
FIG. 23 is a diagram illustrating a configuration of a multiband antenna 2 in a second example embodiment of the present invention.

FIG. 23 is a configuration diagram illustrating a configuration of a multiband antenna 3 in a second example embodiment of the present invention.

Referring to FIG. 23, the multiband antenna 3 in the second example embodiment of the present invention includes a plurality of first antenna elements 101, a plurality of second antenna elements 302, a conductive reflection plate 103, and an FSS 304. Each of the first antenna elements 101 includes a feeder 105. Similarly, each of the second antenna elements 302 includes a feeder 306. The multiband antenna 3 of the present example embodiment differs from the multiband antenna 1 of the first example embodiment in that the feeders 306 of the second antenna elements 302 do not pass through the FSS 304, that is, the FSS 304 does not include any openings 107. Since the configuration is the same as the first example embodiment except the above-described difference, a detailed description thereof will be omitted.

The multiband antenna 3 of the second example embodiment is configured by stacking the conductive reflection plate 103, the first antenna elements 101, the FSS 304, and the second antenna elements 302 in this sequence. In the configuration, an operating frequency $f_1$ of the first antenna elements 101 is set lower than an operating frequency $f_2$ of the second antenna elements 102. The configuration described above enables distances between the first antenna elements 101 and the second antenna elements 302, which are tuned to different frequencies, in the multiband antenna 3 to be reduced.

A detailed structure of an antenna element 400 that constitutes the first antenna elements 101 and the second antenna elements 302 will be described below as a variation 11.

<Variation 11>

Figure 24:
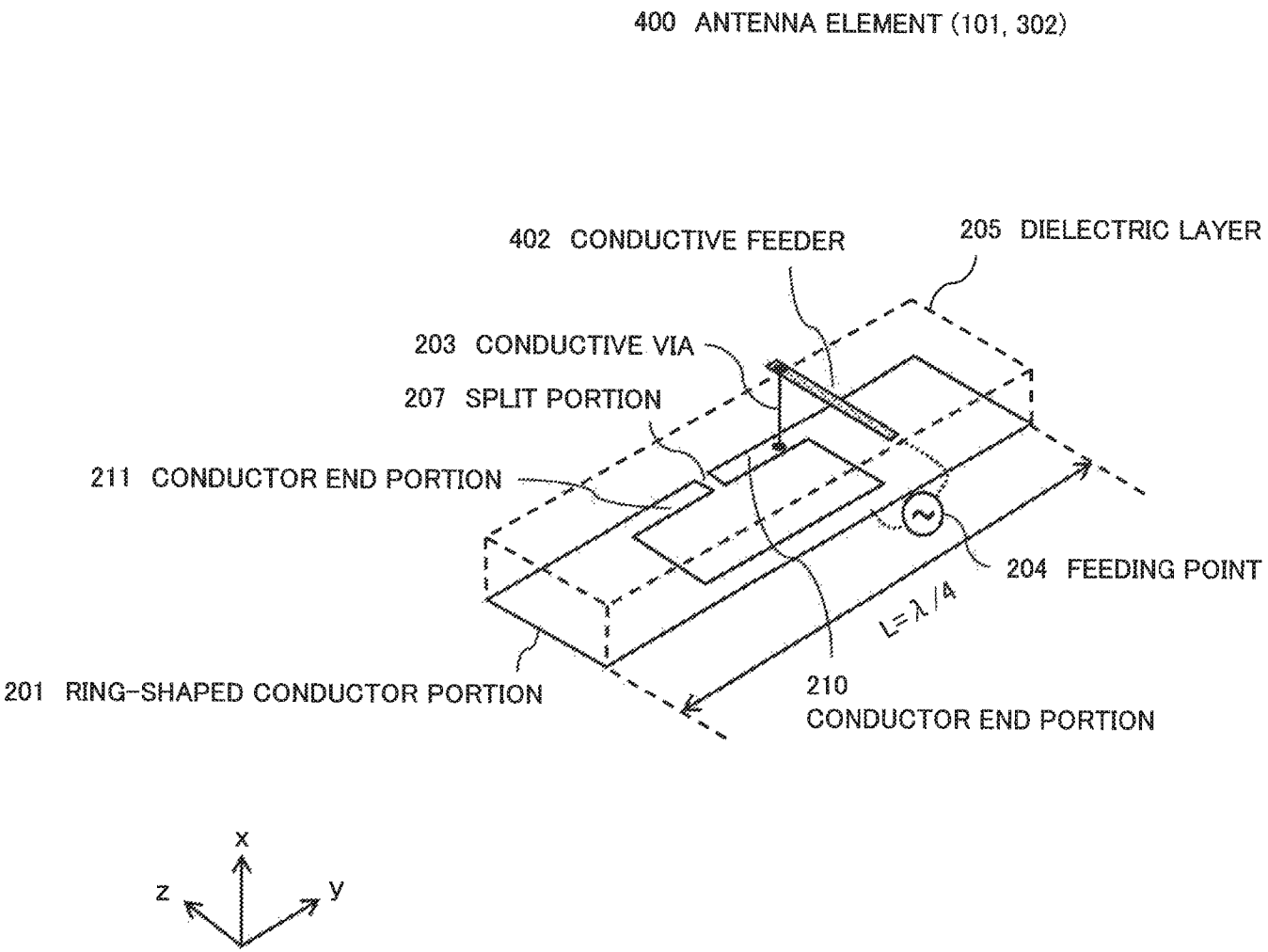
FIG. 24 is a perspective view illustrating a structure of an antenna element 400 in a variation 11 of the present invention.

FIG. 24 is a diagram illustrating a structure of an antenna element 400 of the variation 11. Each of the first antenna elements 101 and the antenna elements 302 is configured with the antenna element 400.

The antenna element 400 includes a ring-shaped conductor portion 201, a conductive feeder 402, a conductive via 203, a feeding point 204, and a dielectric layer 205. The conductive feeder 202 is equivalent to the feeder 105 and the feeder 306 in the present example embodiment. The antenna element 400 of the present variation differs from the antenna element 200 of the variation 4 in that the conductive feeding GND portion 206 is omitted from the antenna element 200. In other words, the length of the conductive feeder 402 of the present variation is equal to the length of a short side (length in the z-axis direction) of the ring-shaped conductor portion 201. Since the configuration is the same as the antenna element 400 of the variation 4 except the above-described difference, a detailed description thereof will be omitted.

Figure 25:
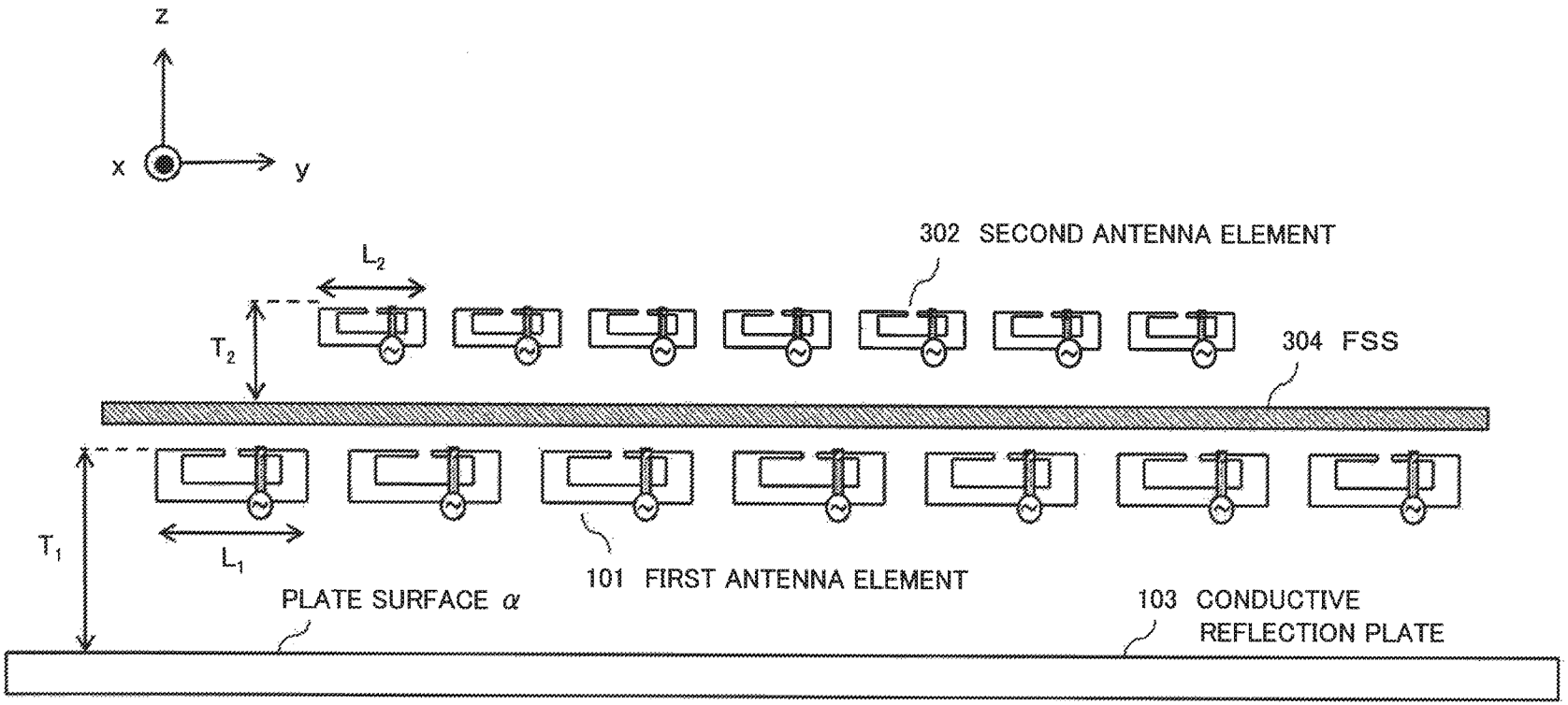
FIG. 25 is a plan view illustrating a structure of a multiband antenna 3 in the variation 11 of the present invention.
Figure 26:
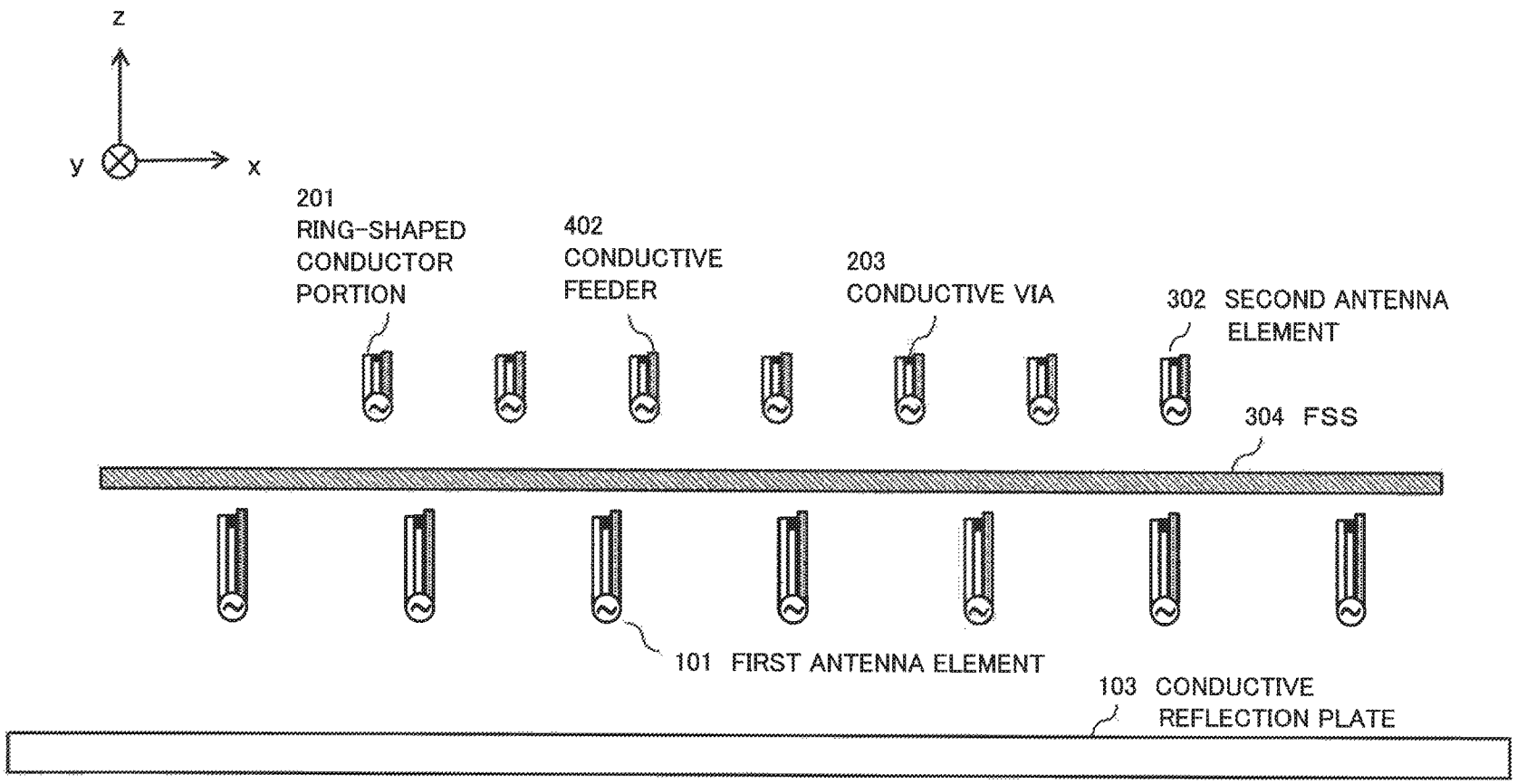
FIG. 26 is another plan view illustrating the structure of the multiband antenna 3 in the variation 11 of the present invention.
Figure 27:
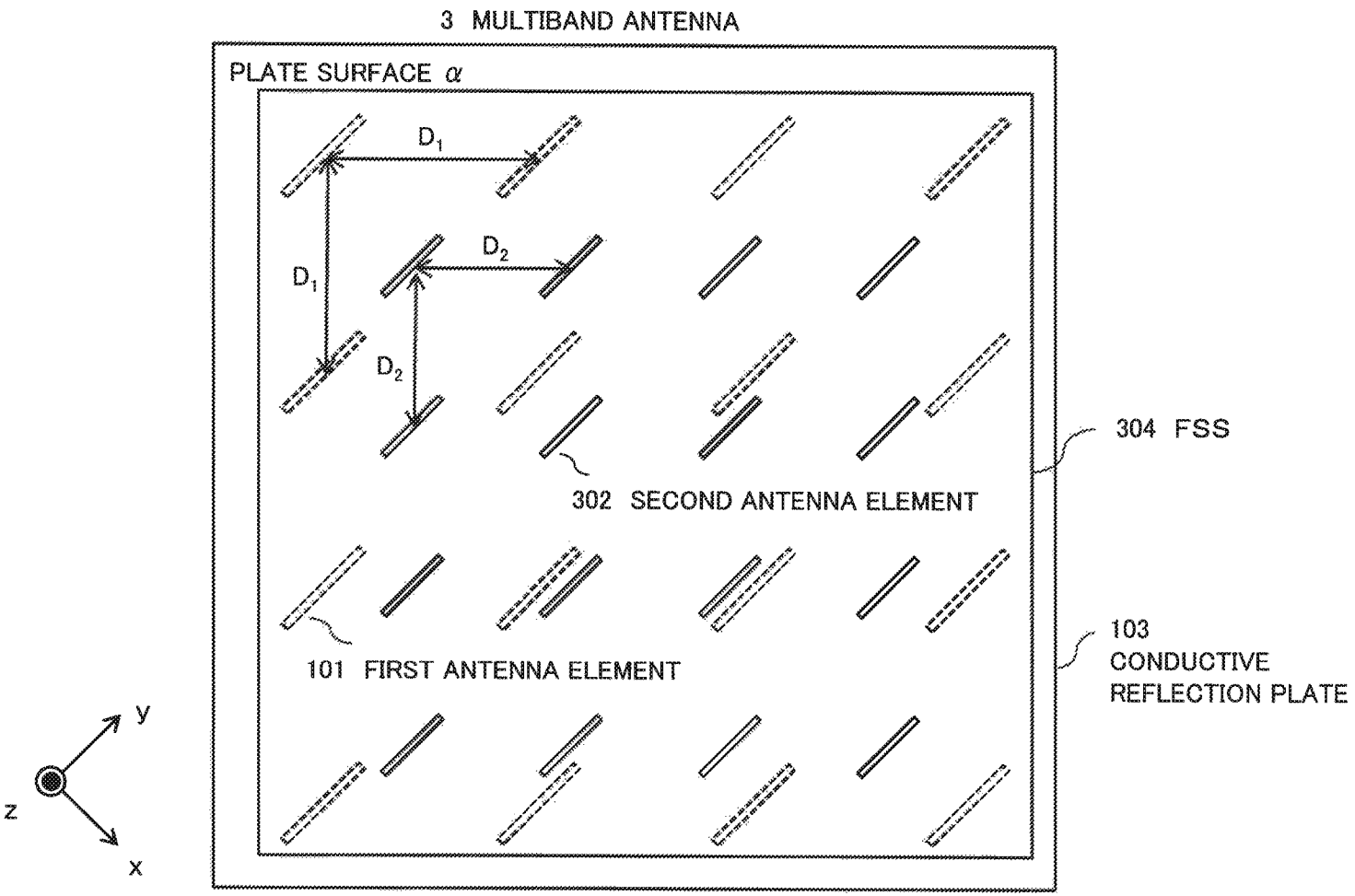
FIG. 27 is a top view illustrating the structure of the multiband antenna 3 in the variation 11 of the present invention.

Configuration diagrams of the multiband antenna 3 in which the antenna element 400 of the present variation is used for the first antenna elements 101 and the second antenna elements 302 will now be illustrated in FIGS. 25 to 27. FIGS. 25 to 27 are a yz cross-sectional view of the multiband antenna 3, an xz cross-sectional view of the multiband antenna 1, and a top view of the multiband antenna 1, respectively. In the configuration, the length $L_1$ of a long side of each first antenna element 101 and the length $L_2$ of a long side of each second antenna element are approximately a quarter of the wavelengths of the operating frequencies of the respective antenna elements.

Figure 28:
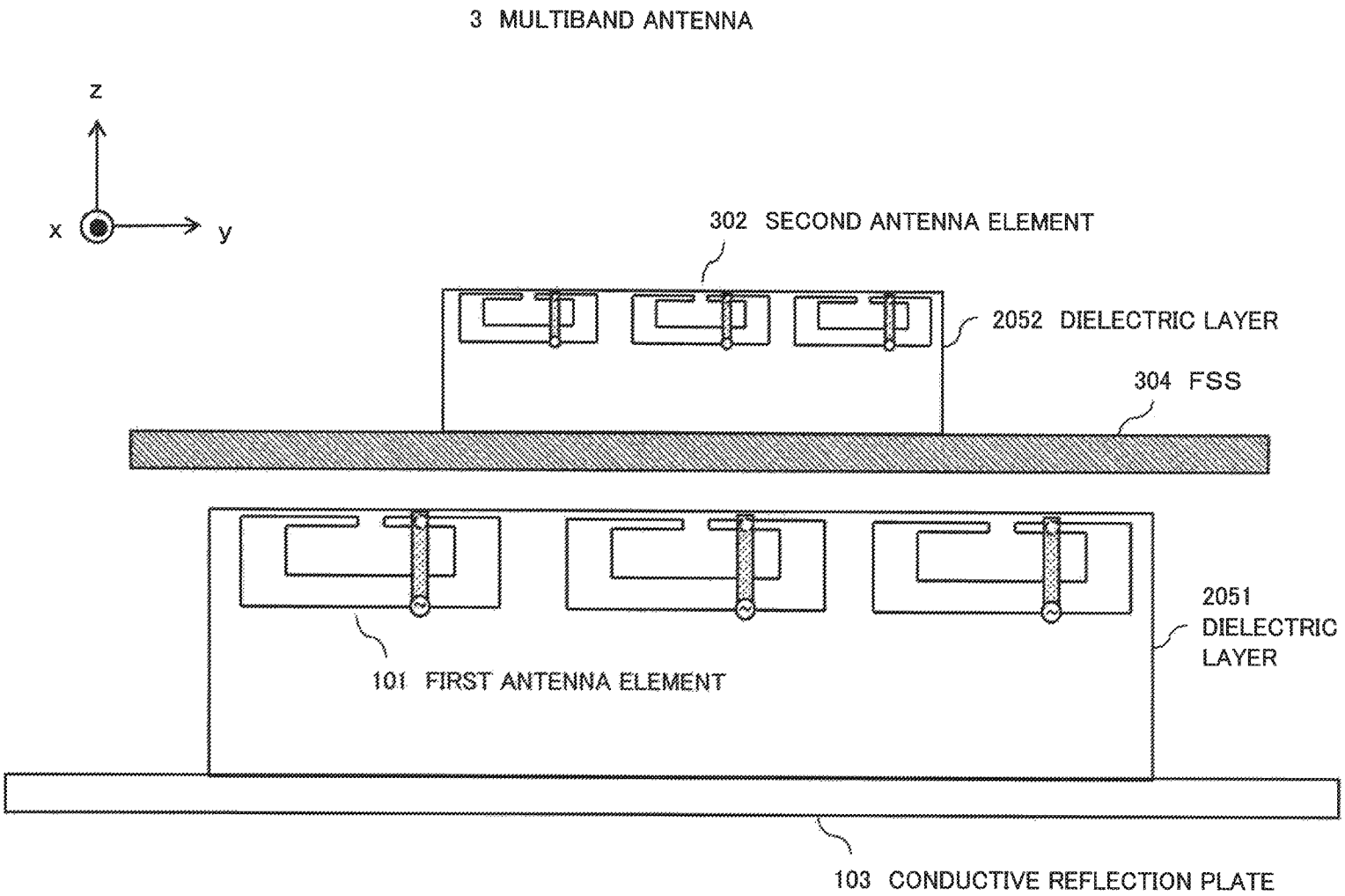
FIG. 28 is a plan view illustrating another structure of the multiband antenna 3 in the variation 11 of the present invention.

Although, in the present variation, it is assumed that each of the plurality of first antenna elements 101 and the plurality of second antenna elements 302 are independently disposed at an interval, the configuration thereof is not limited to the above configuration. For example, as illustrated in FIG. 28, it may be assumed that the plurality of first antenna elements 101 are disposed in an identical dielectric layer 2051 and the plurality of second antenna elements 102 are disposed in another dielectric layer 2052.

In addition, although each antenna element 400 of the present variation is assumed to be disposed in a posture of standing perpendicular to a plate surface α of the conductive reflection plate 103 (a posture in which the surfaces of the dielectric layer 205 are perpendicular to the plate surface α) (see FIG. 25), the posture of the antenna element 400 is not limited thereto.

Figure 29:
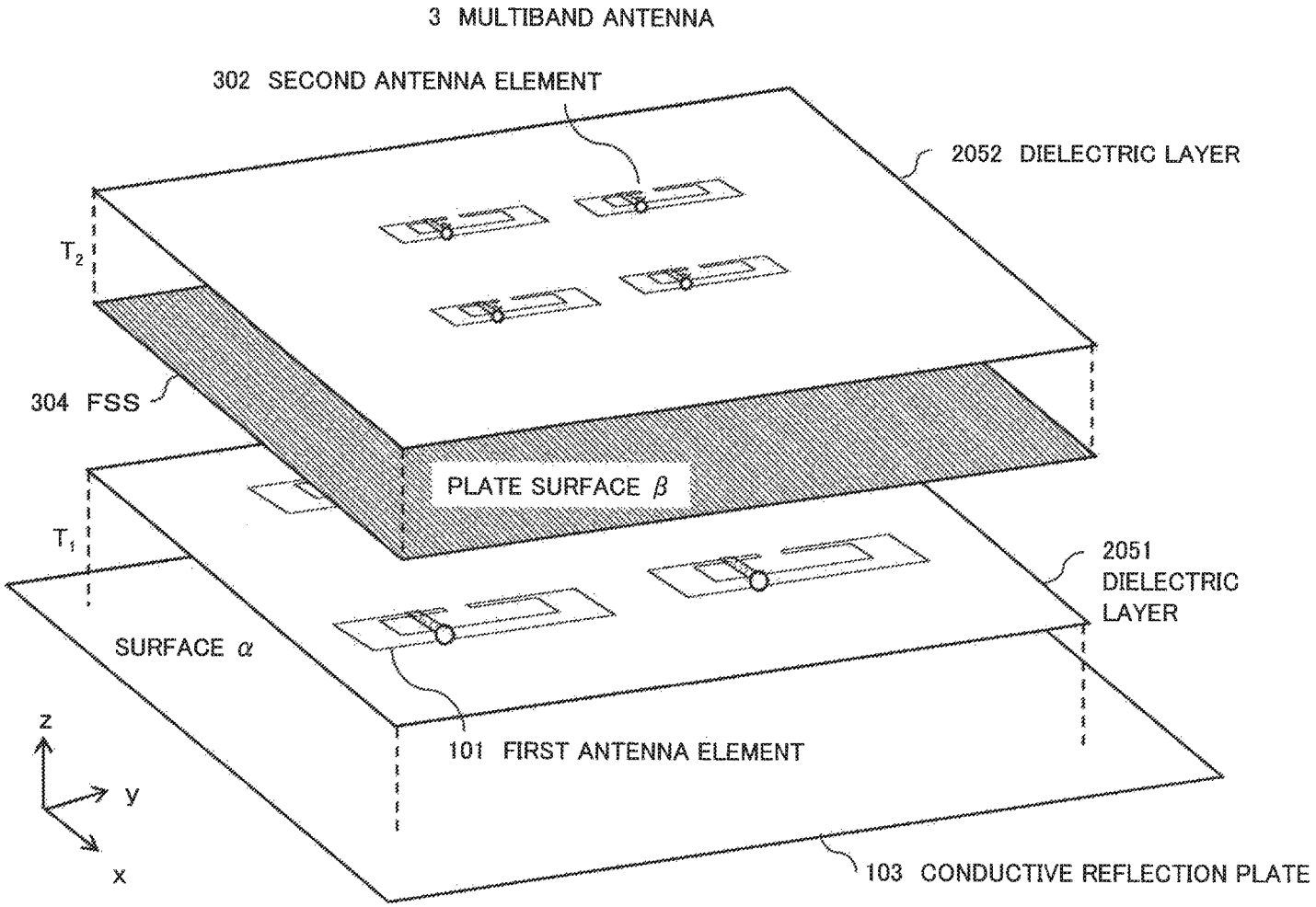
FIG. 29 is an exploded view illustrating still another structure of the multiband antenna 3 in the variation 11 of the present invention.

For example, as illustrated in FIG. 29, the first antenna elements 101 and the second antenna elements 302 may be disposed in a posture parallel with the plate surface α of the conductive reflection plate 103 and a plate surface β of the FSS 304 (a posture in which the surfaces of the dielectric layer 205 are parallel with the plate surfaces α and β). In this case, the plurality of first antenna elements 101 and the plurality of second antenna elements 302 may also be formed on identical substrates, sharing the dielectric layers 2051 and 2052 for the respective antenna elements that are disposed in parallel with and distanced from the plate surface α and the plate surface β by predetermined distances $T_1$ and $T_2$, respectively.

Hereinafter, operational effects in the case where the antenna elements 400 are used for the first antenna elements 101 and the second antenna elements 302 of the present example embodiment will be described.

According to the antenna element 400 of the present example embodiment, the ring-shaped conductor portion 201 functions as an LC series resonance circuit (split ring resonator) in which inductance caused by current flowing along the ring and capacitance generated between conductors facing each other at the split portion 107 are connected in series. Around the resonant frequency of the split ring resonator, large current flowing through the ring-shaped conductor portion 201 and a portion of current components contributing to radiation cause the split ring resonator to work as an antenna.

Use of the antenna element 400 of the present example embodiment enables miniaturization to be achieved compared with conventional antennas because the antenna element 400 uses an LC resonance phenomenon in the split ring resonator, differing from a dipole antenna and a patch antenna that use a wavelength resonance phenomenon.

In addition, the inventors have found that, out of current flowing through the ring-shaped conductor portion 201, a current component that mainly contributes to radiation is a current component in the y-axis direction. Therefore, forming the shape of the ring-shaped conductor portion 201 into a rectangle long in the y-axis direction enables the antenna element 400 of the present example embodiment to achieve a good radiation efficiency. However, although, in FIG. 24, the shape of the antenna element 400 is substantially rectangular, the antenna element 400 having another shape does not influence the essential effects of the present example embodiment.

For example, the shape of the antenna element 400 may also be a square, a circle, a triangle, a bowtie shape, and the like.

Methods for increasing the radiation efficiency of the antenna element 400 will be described in detail in the following description of variations.

Since a portion of electromagnetic waves radiated from the ring-shaped conductor portion 201 are reflected by the conductive reflection plate 103 or the FSS 304, the antenna element 400 of the present example embodiment has a radiation pattern that has directivity in the positive z-axis direction. This feature enables electromagnetic waves to be radiated in a specific direction efficiently.

The resonance frequency of a split ring resonator can be shifted to lower frequencies by increasing inductance through lengthening a current path by means of increase in the size of the ring in the ring-shaped conductor portion 201 or by increasing capacitance through narrowing a gap between the conductors facing each other at the split portion 107.

Methods for increasing the capacitance of the antenna element 400 will be described in detail in the following description of variations.

Variations of the antenna element 400 will be described below as variations 12 to 19. Note that the multiband antenna 3 may be achieved by appropriately combining various variations that were described above or will be described below.

<Variation 12>

Figure 30:
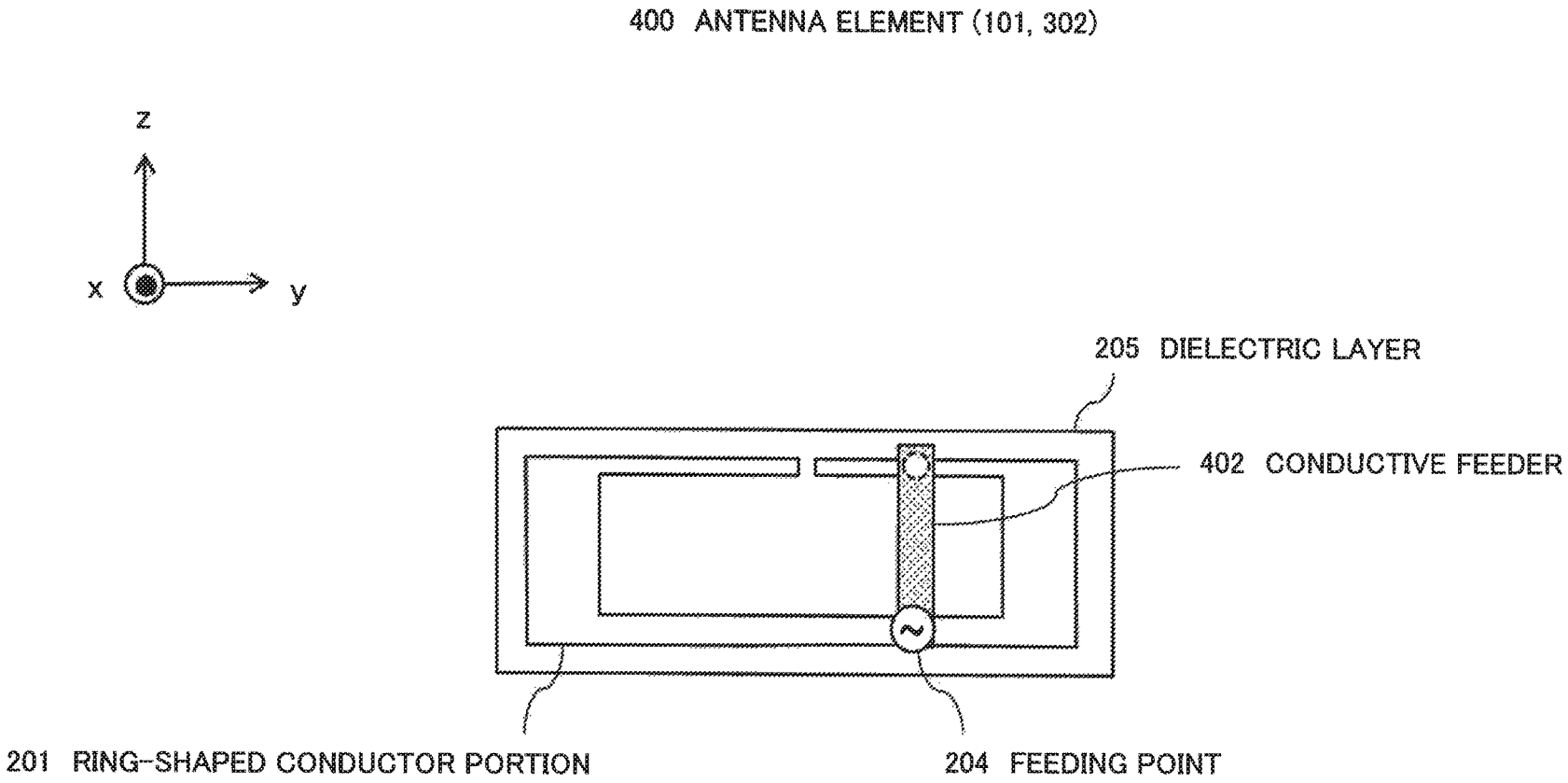
FIG. 30 is a plan view illustrating a structure of an antenna element 400 in a variation 12 of the present invention.

FIG. 30 is a plan view of an antenna element 400 of the variation 12.

As illustrated in FIG. 30, the antenna element 400 of the present variation may be configured in such a way that the surface of the dielectric layer 205 is larger than the rectangular ring-shaped surface of the ring-shaped conductor portion 201. When the dielectric layer 205 is allowed to be larger than the ring-shaped conductor portion 201 as described above, dimensional accuracy of the ring-shaped conductor portion 201 may be prevented from deteriorating due to cutting of the dielectric layer 205 at the outer edge thereof in a formation process of the dielectric layer 205.

<Variation 13>

Figure 31:
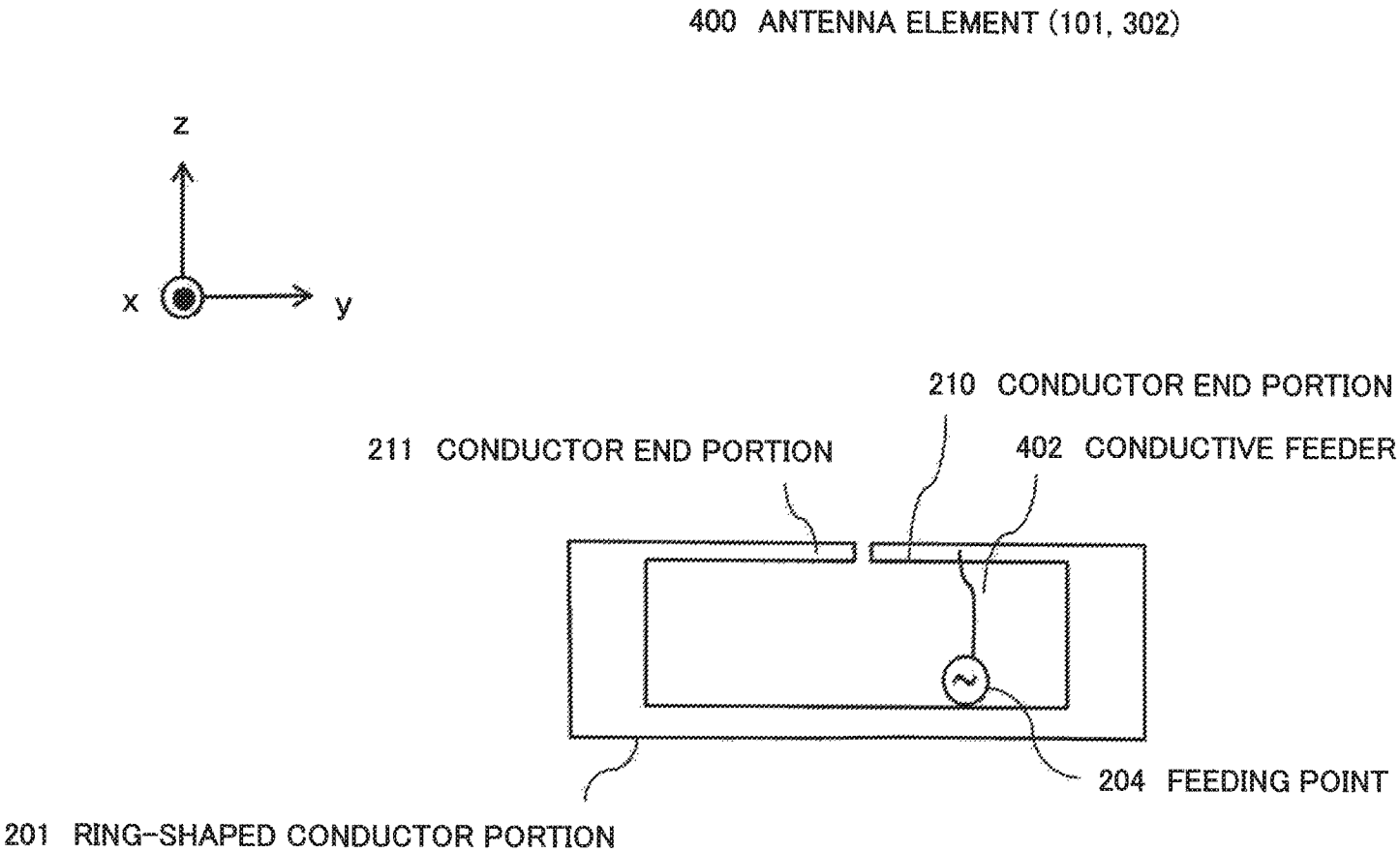
FIG. 31 is a plan view illustrating a structure of an antenna element 400 in a variation 13 of the present invention.

FIG. 31 is a plan view of an antenna element 400 of the variation 13.

The antenna element 400 of the present variation may be configured in a mode in which connection of one end of the conductive feeder 402 to a position on the long side on the upper side (conductor end portion 210) of the ring-shaped conductor portion 201 in an electrically conductive manner causes the conductive via 203 to be omitted. Specifically, as illustrated in FIG. 31, the conductive feeder 402 may be a linear shaped conductor, such as a copper wire. Employing such a configuration enables the configuration of the antenna element 400 to be simplified. In FIG. 31, an illustration of the dielectric layer 205 is omitted in order to make understanding of the disposition of the other components easier. The illustration of the dielectric layer 205 will also be omitted in the following drawings.

<Variation 14>

Figure 32:
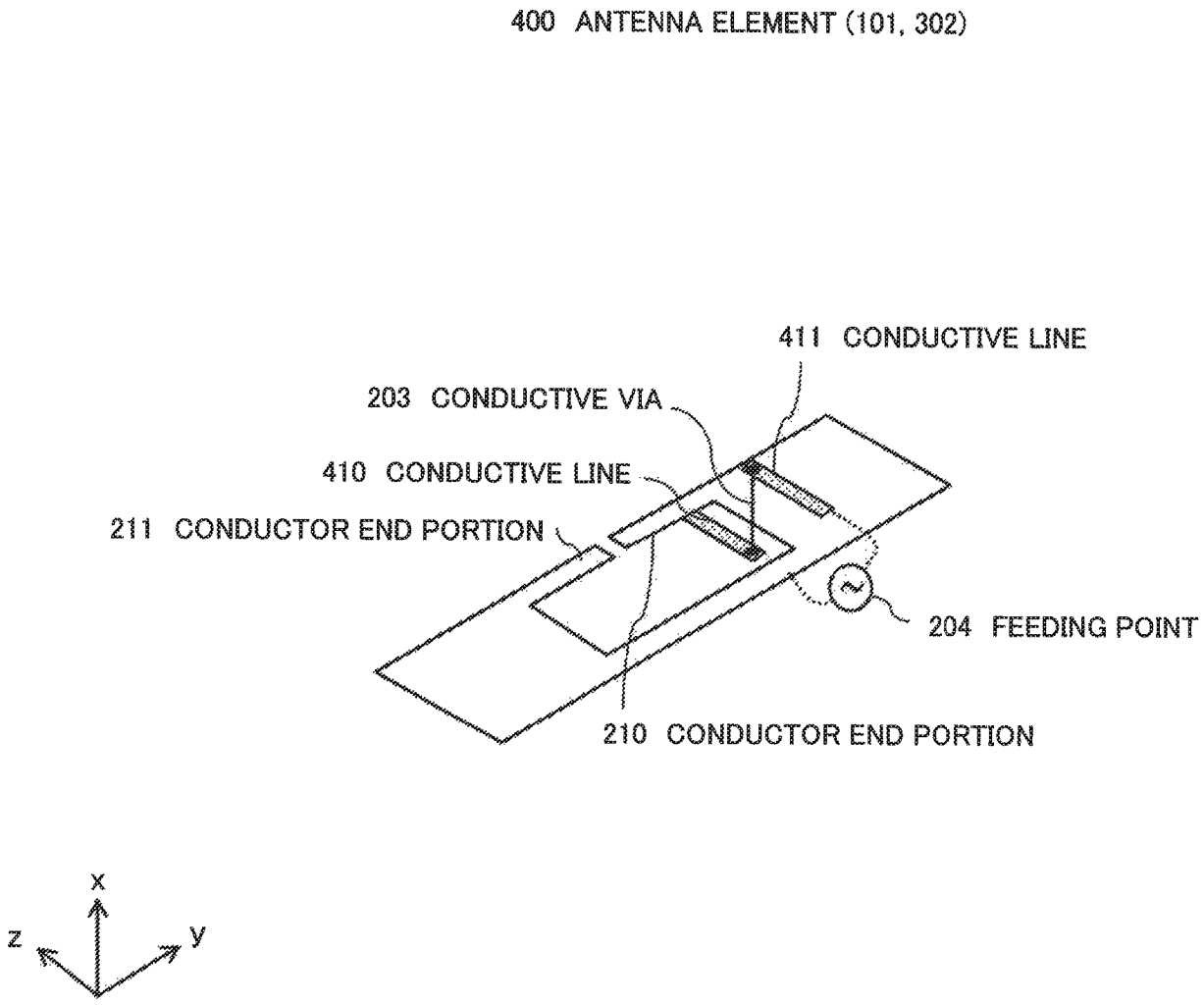
FIG. 32 is a perspective view illustrating a structure of an antenna element 400 in a variation 14 of the present invention.

FIG. 32 is a perspective view of an antenna element 400 of the variation 14.

The antenna element 400 of the present variation has a configuration in which the conductive feeder 402, which connects the conductor end portion 210 and the feeding point 204, is configured with a plurality of conductive lines 410 and 411, which are respectively formed in a plurality of layers, and a conductive via 203. In the configuration, the conductive via 203 connects the conductive line 410 and the conductive line 411, which are formed in different layers.

Employing such a configuration enables contact between the other end (end portion opposite the one end connected to the conductor end portion 210) of the conductive feeder 402 and the ring-shaped conductor portion 201 to be avoided.

<Variation 15>

Figure 33:
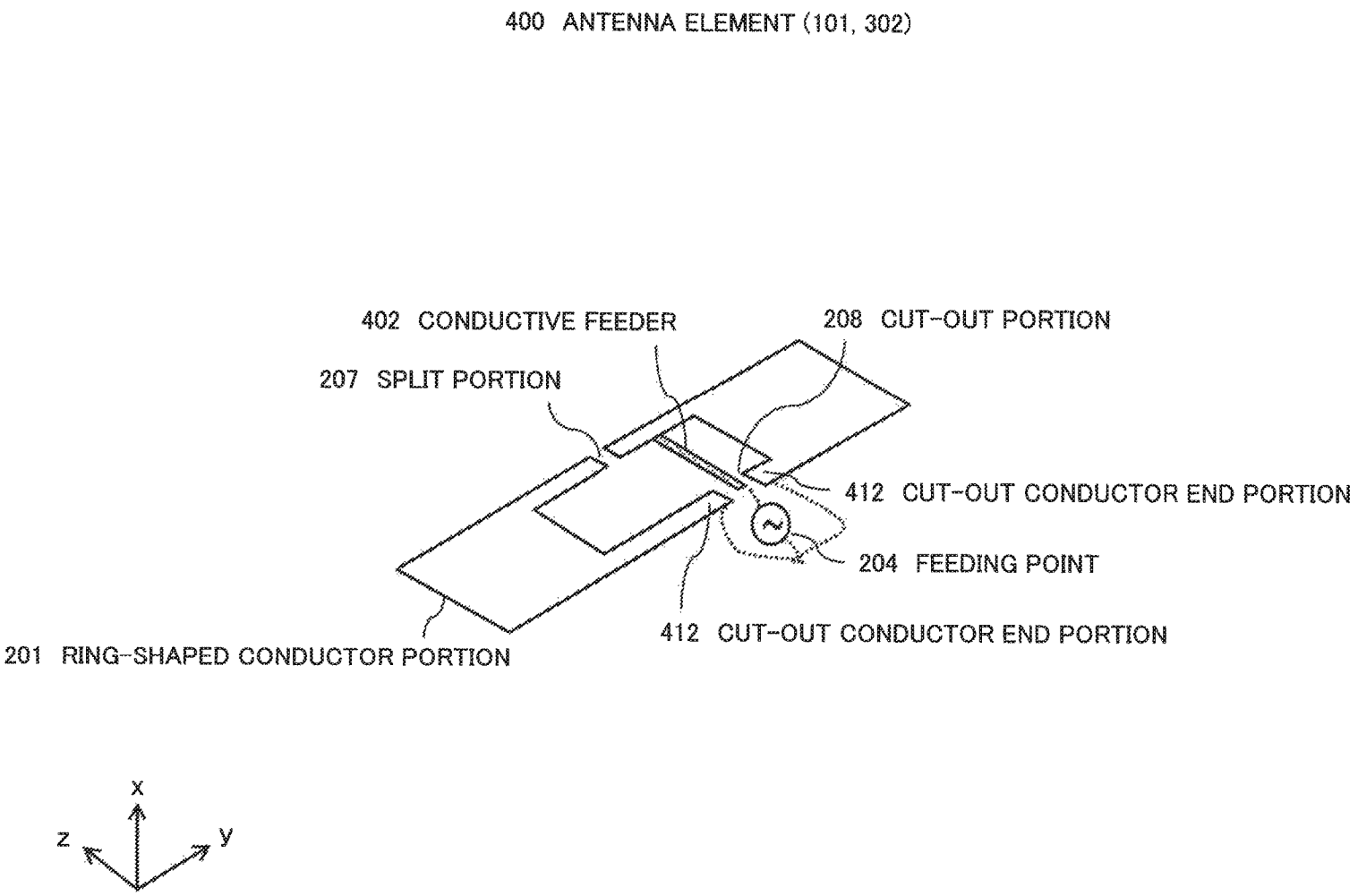
FIG. 33 is a perspective view illustrating a structure of an antenna element 400 in a variation 15 of the present invention.

FIG. 33 is a perspective view of an antenna element 400 of the variation 15.

In the antenna element 400 of the present variation, out of the sides in the circumferential direction of the ring-shaped conductor portion 201, a portion of the long side on the opposite side (lower (negative z-axis direction) side) to the long side on the upper (positive z-axis direction) side on which the split portion 207 is formed is cut out and the conductive feeder 402 is passed through the cut out portion (cut-out portion 208). In this case, the feeding point 204 is placed so as to apply electrical excitation between the conductive feeder 402 and end portions (cut-out conductor end portions 412) in the circumferential direction of the ring-shaped conductor portion 201 that form the cut-out portion 208.

Configuring the antenna element 400 of the present variation in the above-described manner enables the ring-shaped conductor portion 201 and the conductive feeder 402 to be formed in an identical layer. Therefore, an antenna element 400 that is easy to manufacture is achieved.

Figure 34:
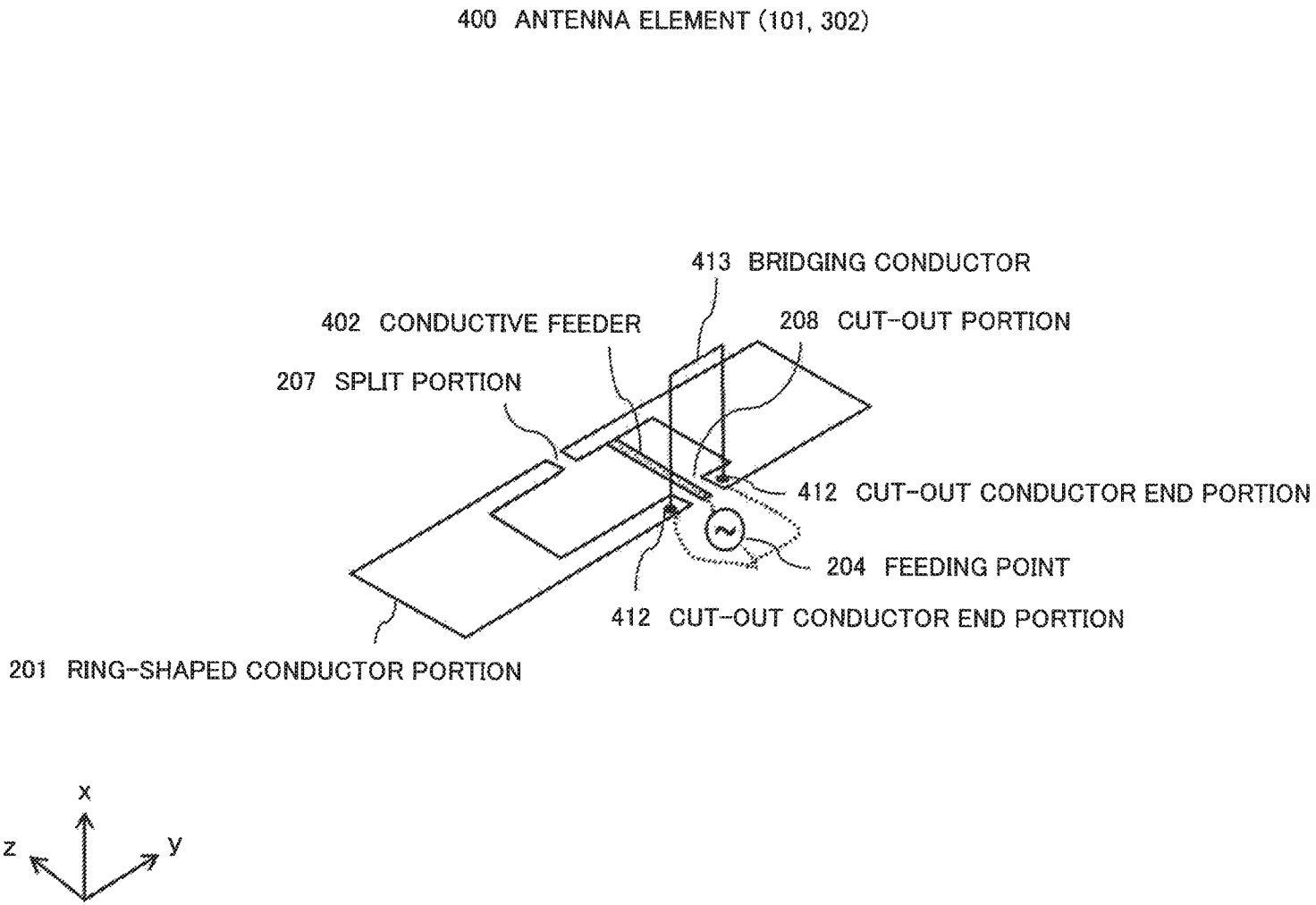
FIG. 34 is a perspective view illustrating another structure of the antenna element 400 in the variation 15 of the present invention.

In the example illustrated in FIG. 33, however, deterioration in the resonance characteristics of the antenna element 400 as a split ring resonator is expected to occur due to a portion of the ring-shaped conductor portion 201 being cut out. Thus, in order to make up for the deterioration in the resonance characteristics, the antenna element 400 may include a bridging conductor 413 that makes the cut out portion (cut-out portion 208) of the ring-shaped conductor 201 electrically conductive without coming into contact with the conductive feeder 402, as illustrated in FIG. 34.

Figure 68:
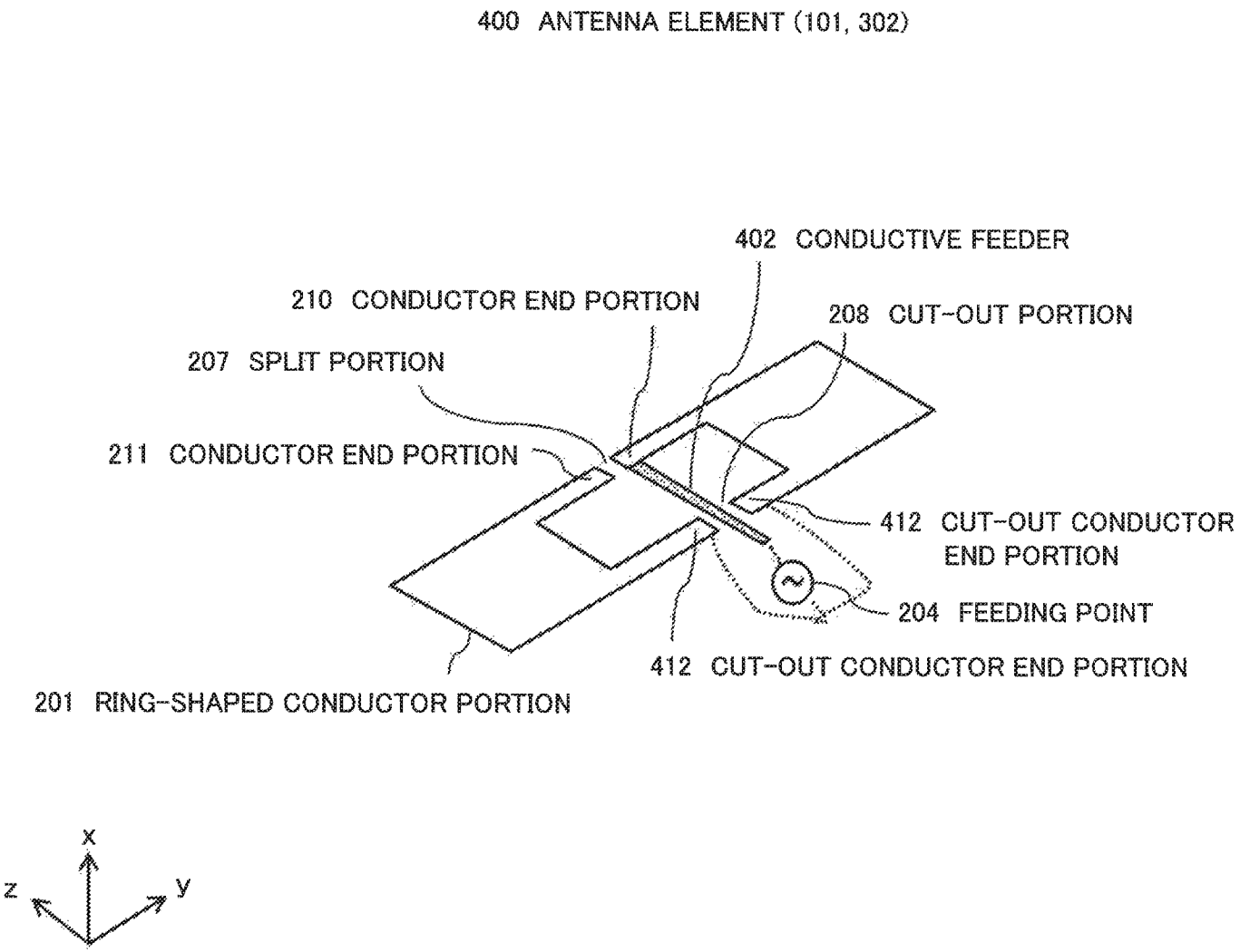
FIG. 68 is a perspective view illustrating still another structure of the antenna element 400 in the variation 15 of the present invention.

In addition, as illustrated in FIG. 68, the conductive feeder 402 of the present variation may be connected to an end portion of either of the two conductor end portions 210 and 211 (the conductor end portion 210 in FIG. 68), which face each other with the split portion 207 interposed therebetween.

<Variation 16>

Figure 35:
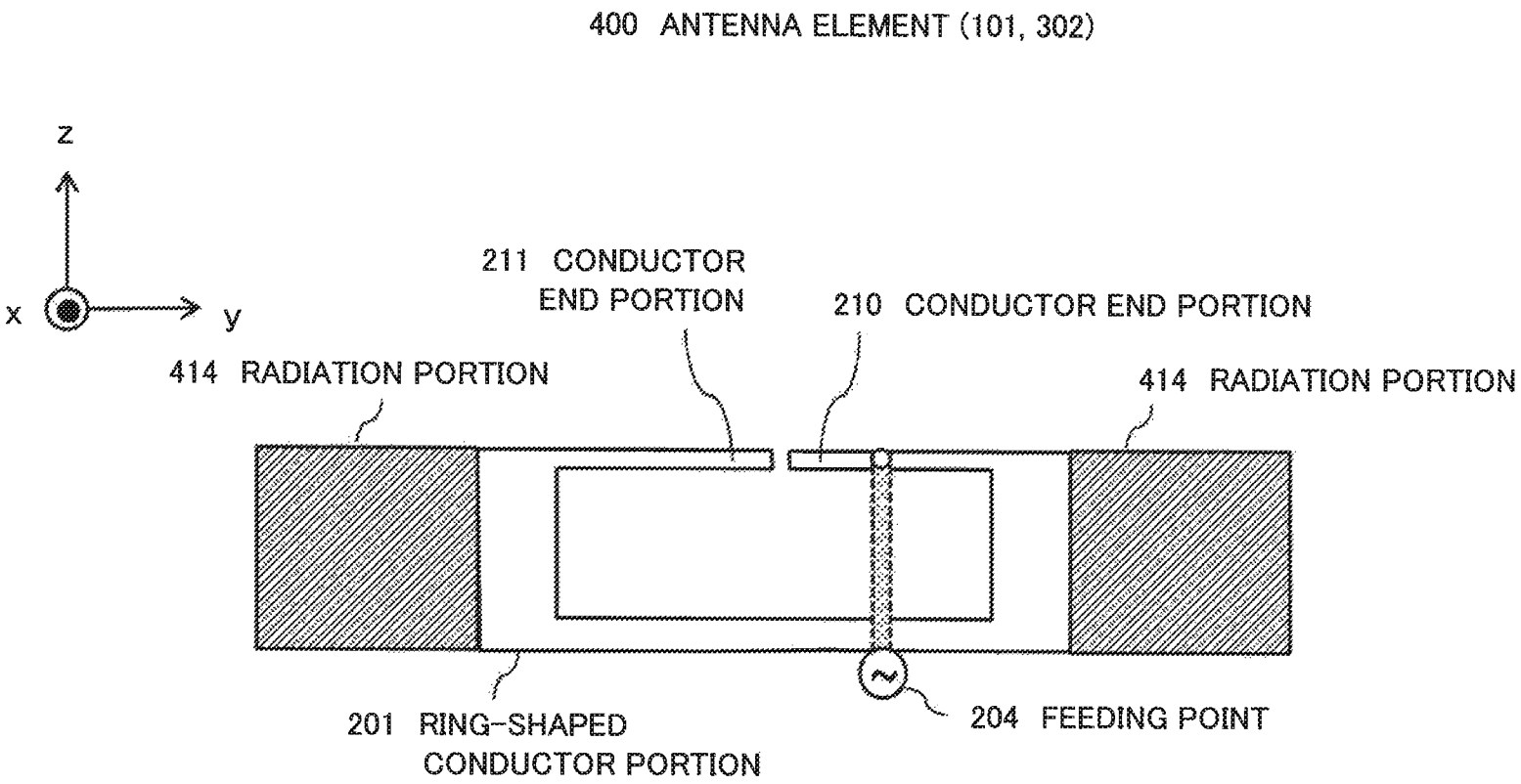
FIG. 35 is a plan view illustrating a structure of an antenna element 400 in a variation 16 of the present invention.

FIG. 35 is a plan view of an antenna element 400 of the variation 16.

The antenna element 400 of the present variation includes conductive radiation portions 414 at both ends in the extending direction (y-axis direction) of the ring-shaped conductor portion 201. Since the configuration as described above enables a longitudinal current component, which contributes to radiation, in the ring-shaped conductor portion 201 to be induced to the radiation portions 414, it becomes possible to improve radiation efficiency.

Although, in the example illustrated in FIG. 35, a case where the lengths of the sides of portions of each radiation portion 414 and the ring-shaped conductor portion 201 where the radiation portion 414 and the ring-shaped conductor portion 201 connect to each other coincide with each other is described, the shape of each radiation portion 414 is not limited to such a shape.

Figure 36:
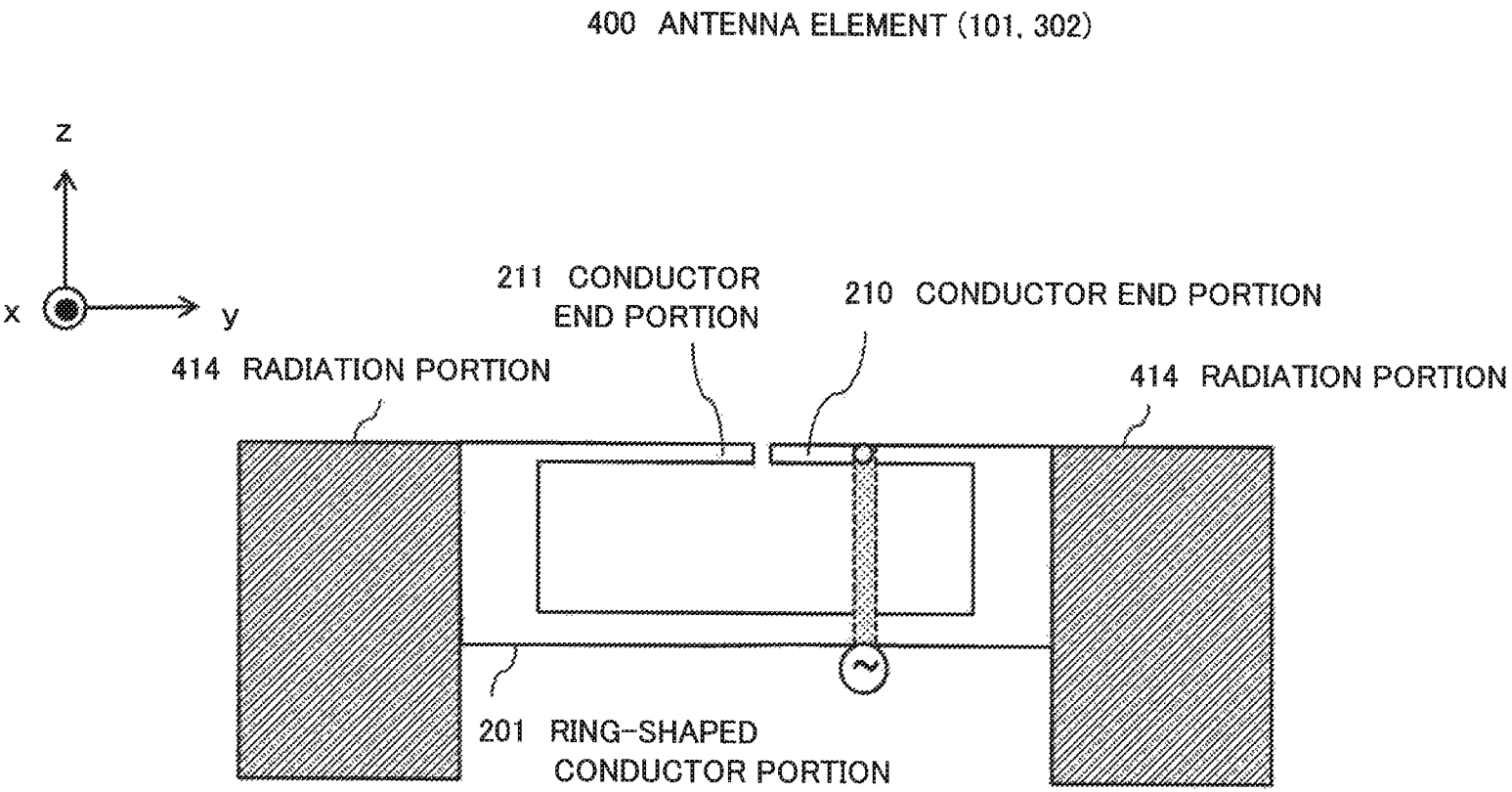
FIG. 36 is a plan view illustrating another structure of the antenna element 400 in the variation 16 of the present invention.
Figure 37:
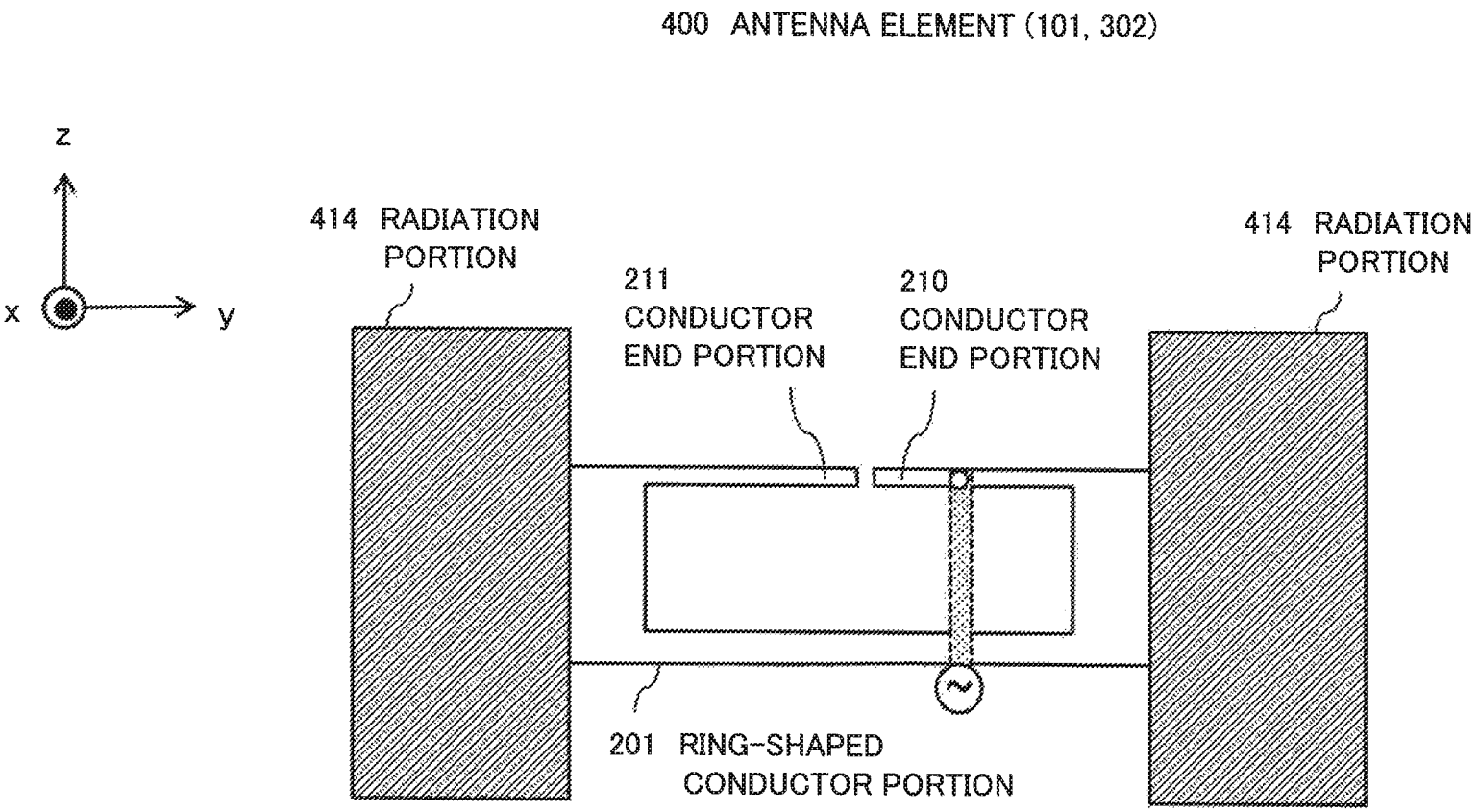
FIG. 37 is a plan view illustrating still another structure of the antenna element 400 in the variation 16 of the present invention.

For example, as illustrated in FIGS. 36 and 37, a configuration where, regarding the lengths of the sides of portions where each radiation portion 414 and the ring-shaped conductor portion 201 connect to each other, the length with respect to the radiation portion 414 is longer than the length with respect to the ring-shaped conductor portion 201 is conceivable. In the case of a configuration including the radiation portions 414, if the ring-shaped conductor portion 201 and the radiation portions 414, in combination, constitute a shape that has the longitudinal direction in the extending direction (y-axis direction) of the antenna element 400, better radiation efficiency may be achieved.

Figure 38:
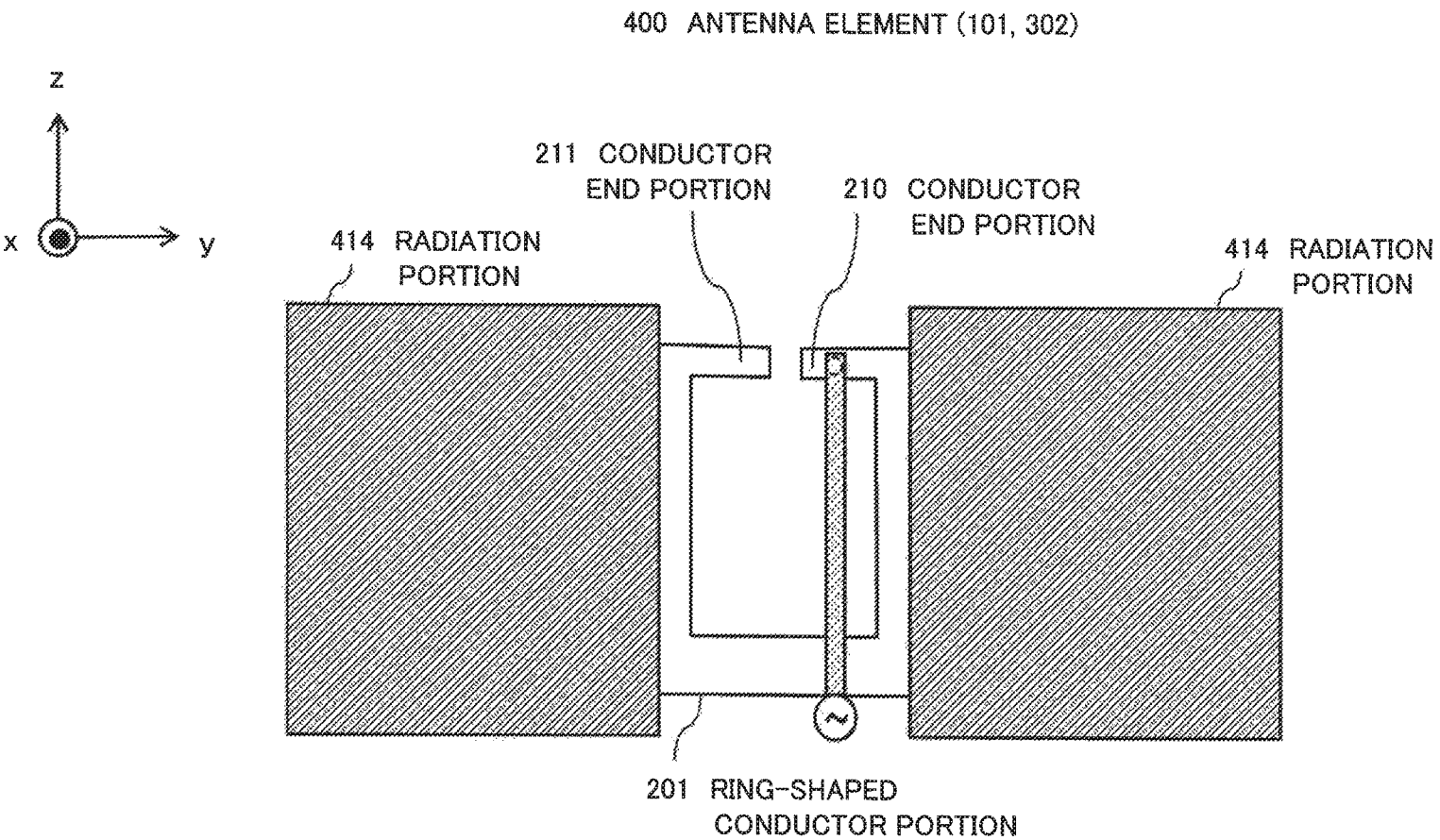
FIG. 38 is a plan view illustrating still another structure of the antenna element 400 in the variation 16 of the present invention.

In this case, the ring-shaped conductor portion 201 does not always have to be formed into a rectangle that has the long sides in the extending direction of the antenna element 400. For example, the shape of the ring-shaped conductor portion 201 may be a rectangle that has the long sides in the perpendicular direction (z-axis direction) as illustrated in FIG. 38, or a configuration in which the shape of the ring-shaped conductor portion 201 is a square, a circle, or a triangle is conceivable.

Figure 39:
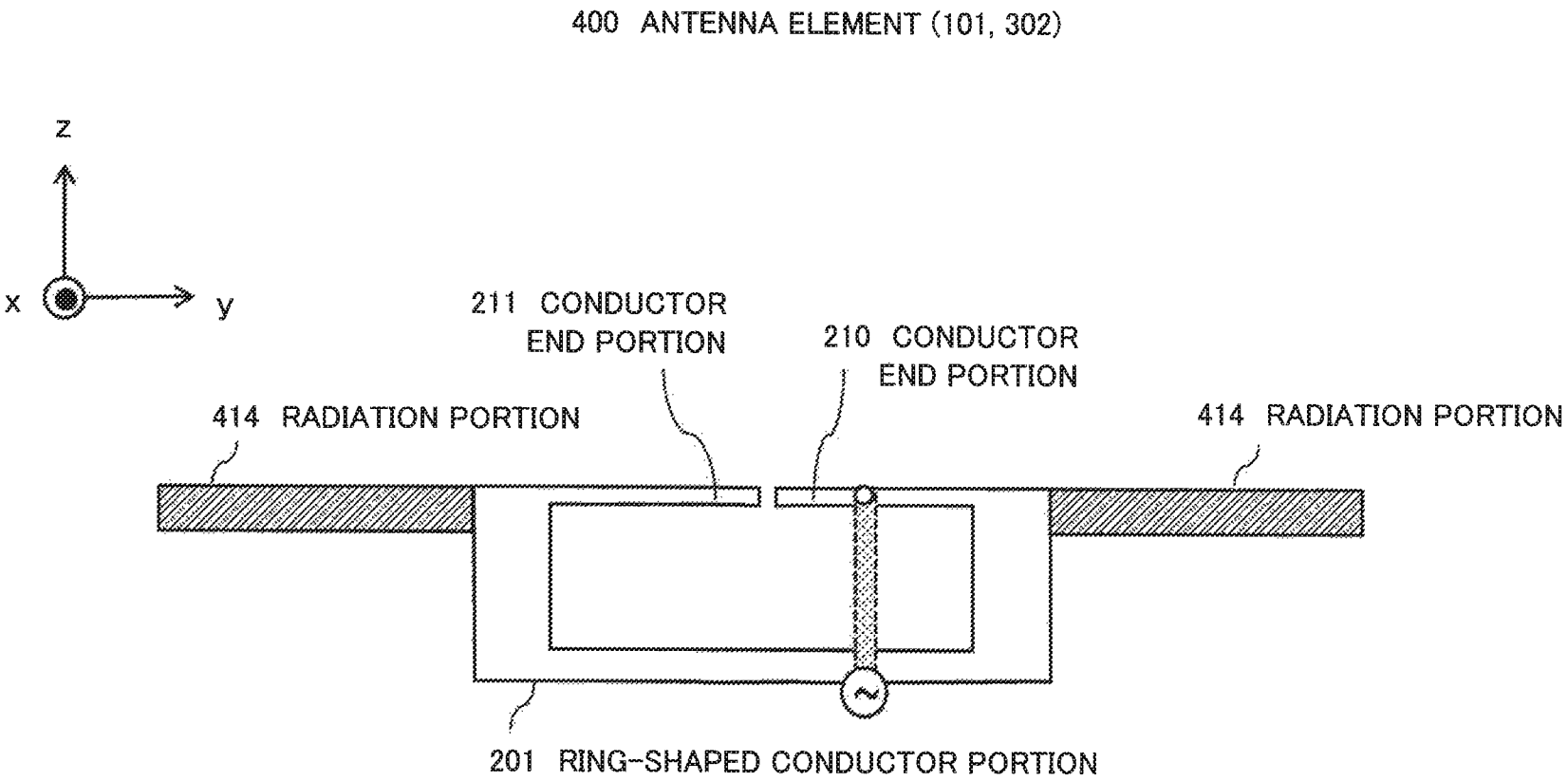
FIG. 39 is a plan view illustrating still another structure of the antenna element 400 in the variation 16 of the present invention.

In addition, as illustrated in FIG. 39, a configuration in which the size in the z-axis direction of each radiation portion 414 is smaller than the size in the z-axis direction of the ring-shaped conductor portion 201 is also conceivable.

As described above, the radiation portions 414 are electrically connected to both ends of the ring-shaped conductor portion 201 in the direction in which the conductor end portions 210 and 211 extend in the ring-shaped conductor portion 201.

<Variation 17>

Figure 40:
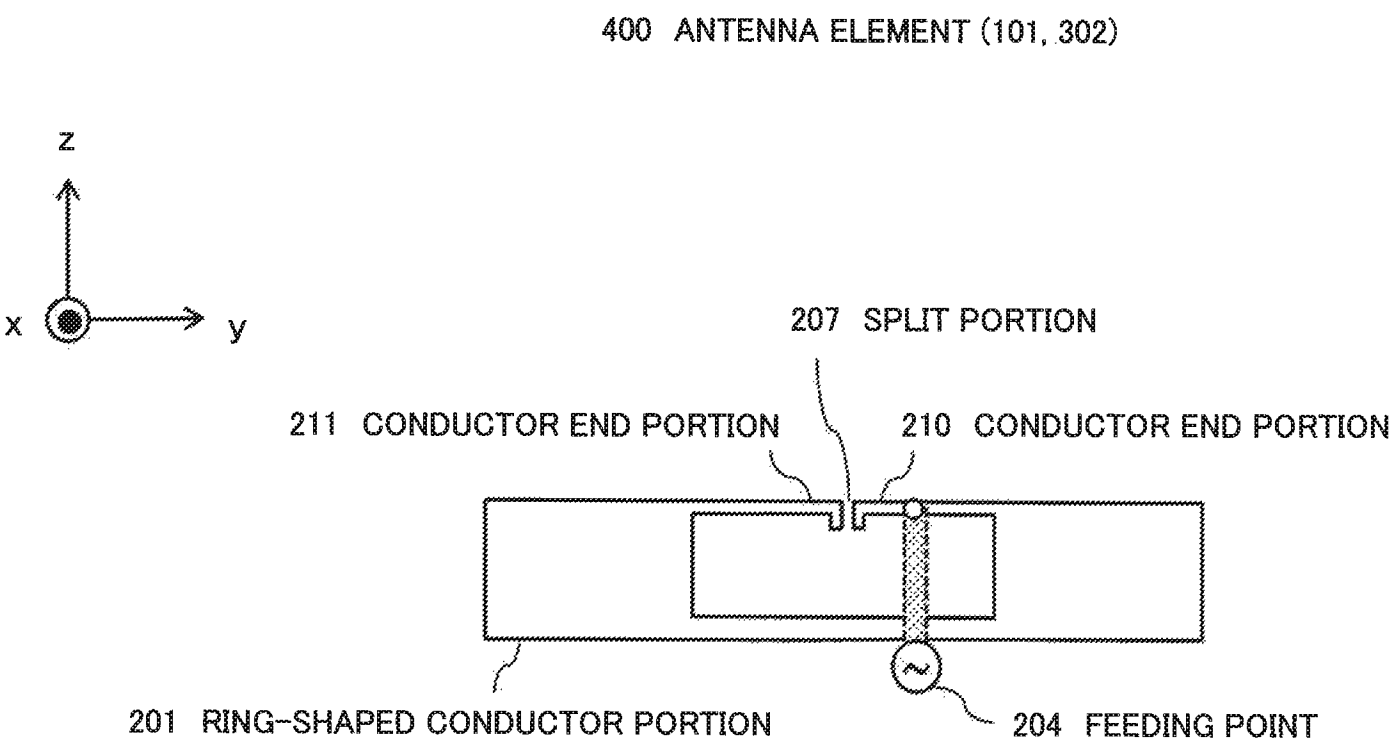
FIG. 40 is a plan view illustrating a structure of an antenna element 400 in a variation 17 of the present invention.

FIG. 40 is a plan view of an antenna element 400 of the variation 17.

The resonance frequency of the split ring resonator that the ring-shaped conductor portion 201 forms can be shifted to lower frequencies by increasing inductance through lengthening a current path by means of increase in the size of the split ring (ring-shaped conductor portion 201). Alternatively, the resonance frequency of the split ring resonator can be shifted to lower frequencies by increasing capacitance through narrowing a gap at the split portion 207.

As a method for increasing capacitance, for example, there is a method in which, as illustrated in FIG. 40, the facing area of the conductor end portions 210 and 211, which face each other and form the split portion 207, out of the ring-shaped conductor portion 201 is increased. In the example illustrated in FIG. 40, each of the conductor end portions 210 and 211, which face each other with the split portion 207 interposed therebetween, is bent in a direction (negative z-axis direction) that is substantially orthogonal to the direction in which the conductor end portions 210 and 211 face each other. The configuration increases the facing area of the conductor end portions 210 and 211, which face each other with the split portion 207 interposed therebetween, and the increase in the facing area increases the capacitance. In addition, as illustrated in FIGS. 41 and 42, the facing area (capacitance) may be increased by employing a configuration in which auxiliary conductor patterns 415 are disposed in a layer different from the layer in which the ring-shaped conductor portion 201 is disposed and, in conjunction therewith, are respectively connected to the conductor end portions 210 and 211 by way of conductive vias 416 that are disposed on the conductor end portions 210 and 211.

Figure 41:
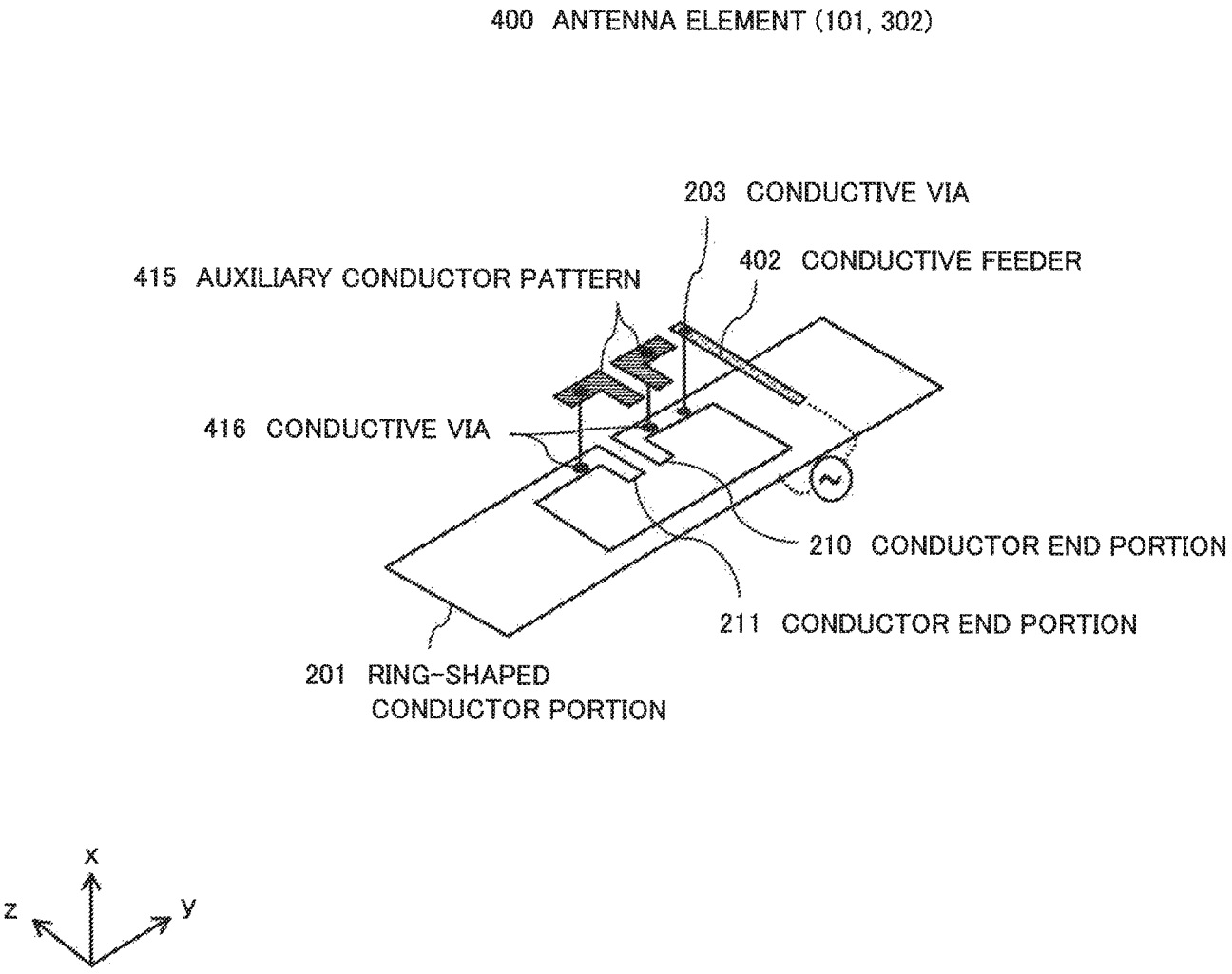
FIG. 41 is a perspective view illustrating another structure of the antenna element 400 in the variation 17 of the present invention.
Figure 42:
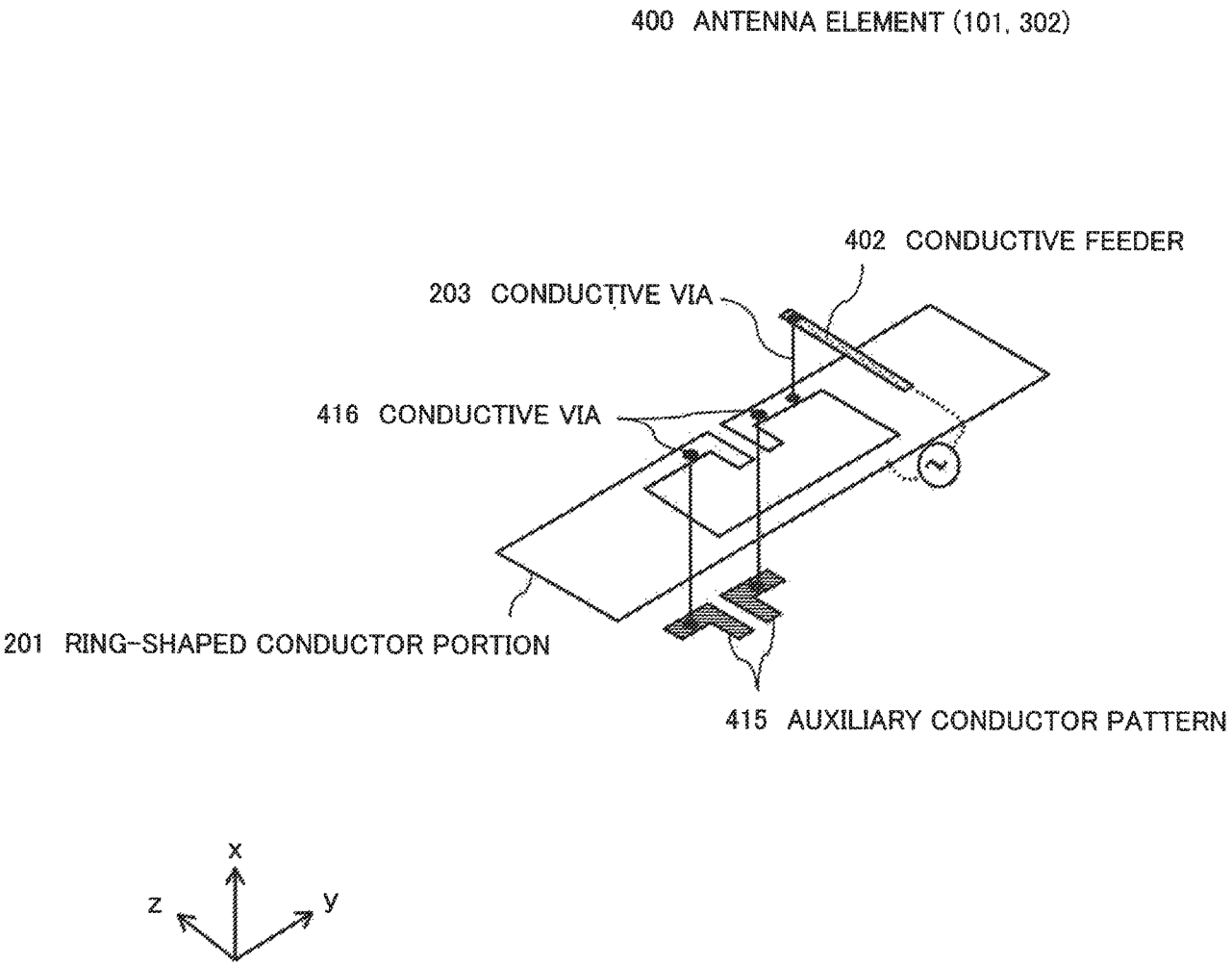
FIG. 42 is a perspective view illustrating still another structure of the antenna element 400 in the variation 17 of the present invention.

In FIG. 41, an example in the case where the auxiliary conductor patterns 415 are disposed in the same layer as the conductive feeder 201 is illustrated. In FIG. 42, an example in the case where the auxiliary conductor patterns 415 are disposed in a layer different from the layers in which the ring-shaped conductor portion 201 and the conductive feeder 402 are respectively disposed is illustrated.

Figure 43:
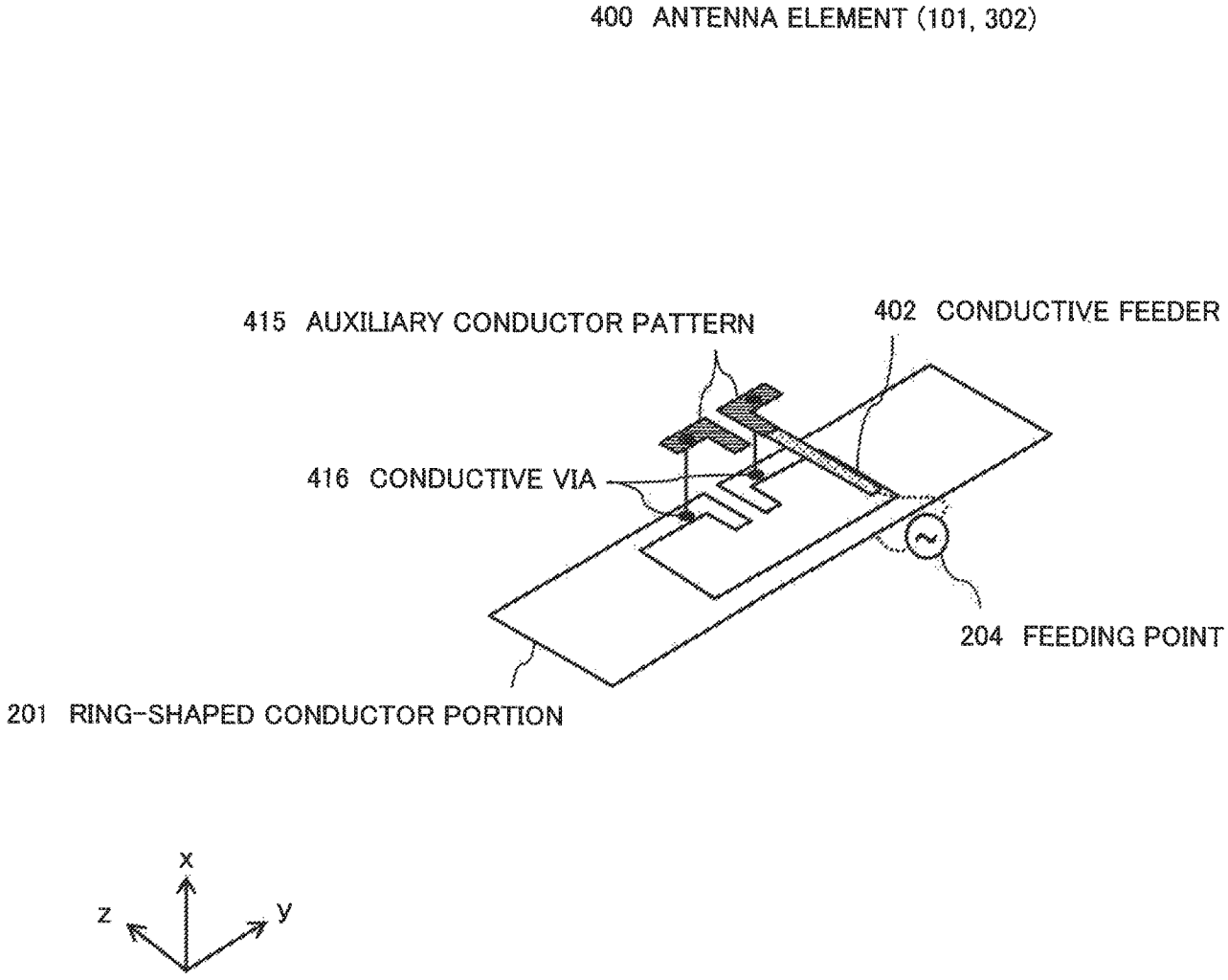
FIG. 43 is a perspective view illustrating still another structure of the antenna element 400 in the variation 17 of the present invention.

In addition, as illustrated in FIG. 43, a configuration in which the conductive feeder 402 in FIG. 41 is directly connected to one of the auxiliary conductor patterns 415 is also conceivable. The configuration enables the conductive via 203 to be omitted and the structure to be simplified.

Figure 44:
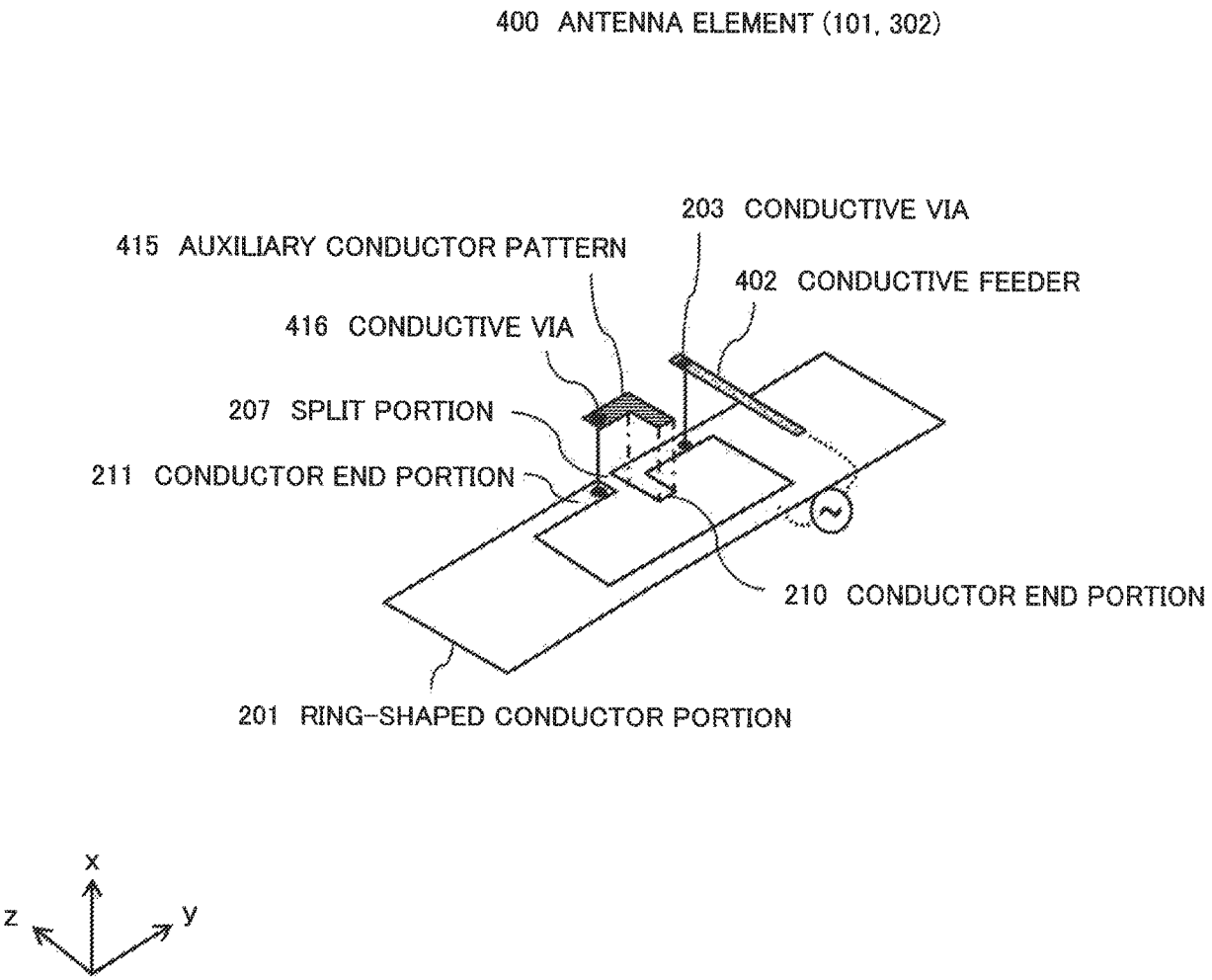
FIG. 44 is a perspective view illustrating still another structure of the antenna element 400 in the variation 17 of the present invention.
Figure 45:
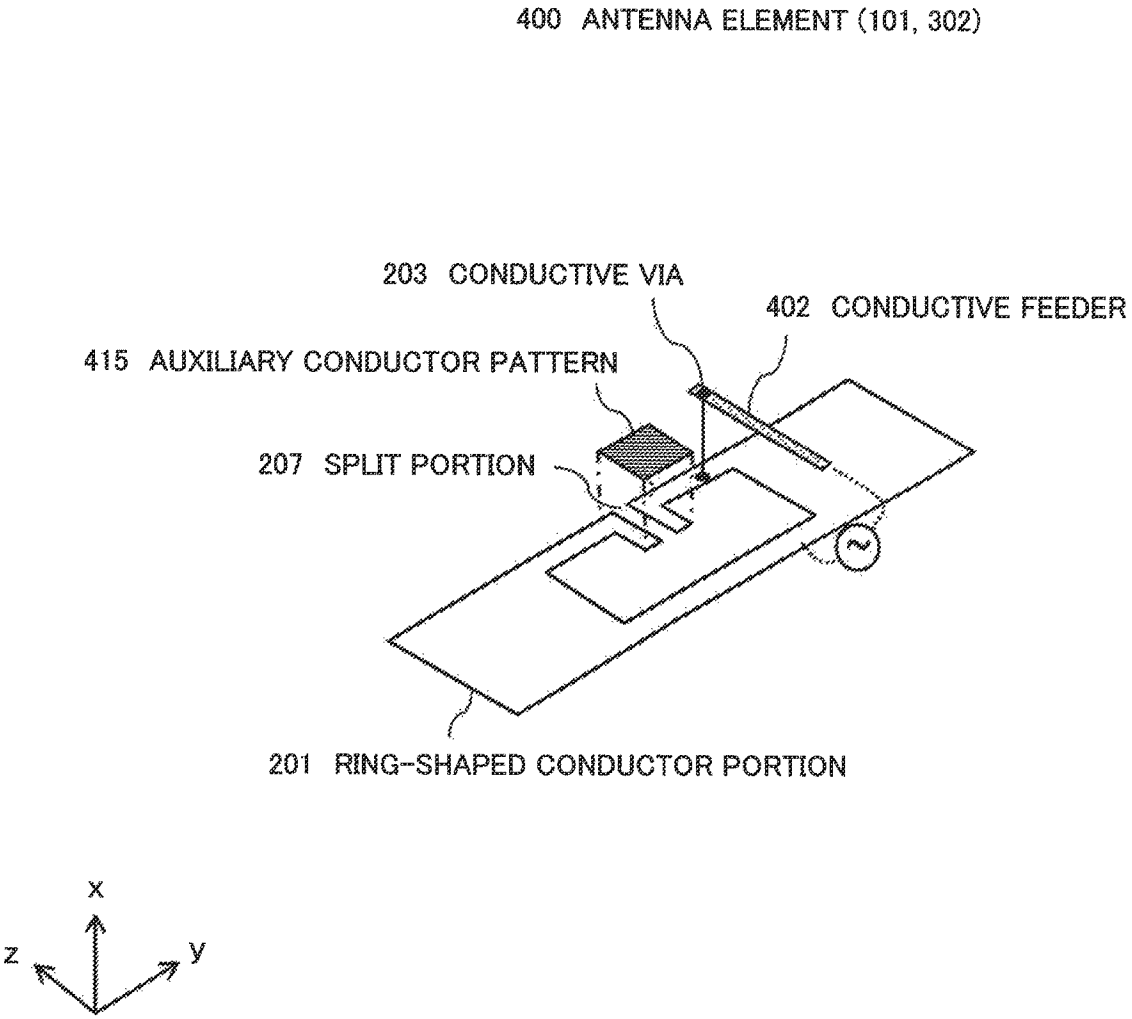
FIG. 45 is a perspective view illustrating still another structure of the antenna element 400 in the variation 17 of the present invention.

In addition, as illustrated in FIG. 44, an auxiliary conductor pattern 415 may be provided to only one of the conductor end portions 210 and 211 (in FIG. 45, only the conductor end portion 211). In this case, a configuration in which the auxiliary conductor pattern 415 and at least a portion of the other of the conductor end portions 210 and 211 (in FIG. 44, the conductor end portion 210) face each other in the perpendicular direction (x-axis direction) causes the facing area at the split portion 207 to be increased.

In addition, as illustrated in FIG. 45, the antenna element 400 may be configured in such a manner that no conductive via 416 is included and an auxiliary conductor pattern 415 overlaps the conductor end portions 210 and 211, which face each other with the split portion 207 interposed therebetween, as viewed from the direction perpendicular to the plane that the ring-shaped conductor portion 201 constitutes. Since the configuration enables the area of conductors that face each other to be increased, it becomes possible to increase the capacitance without increasing the size of the whole resonator.

Note that, although being disposed in the same layer in the example illustrated in FIG. 44, the auxiliary conductor pattern 415 and the conductive feeder 402 may be disposed in different layers. In addition, although having bent shapes in the examples illustrated in FIGS. 41 to 44, the conductor end portions 210 and 211 and the auxiliary conductor patterns 415 may have shapes that do not bend or other shapes.

In addition, changing the connection position between the conductive via 203 (when the conductive via 203 is omitted, one end of the conductive feeder 402) and the ring-shaped conductor portion 201 enables input impedance of the split ring resonator as viewed from the feeding point 204 to be changed. Matching the input impedance of the split ring resonator with the impedance of a not-illustrated wireless communication circuit unit or transmission line that is connected to the feeding point 204 enables wireless communication signals to be fed to the antenna without reflection. However, even when the impedances are not matched with each other, the impedance mismatch does not affect the essential operational effects of the present example embodiment.

<Variation 18>

Figure 46:
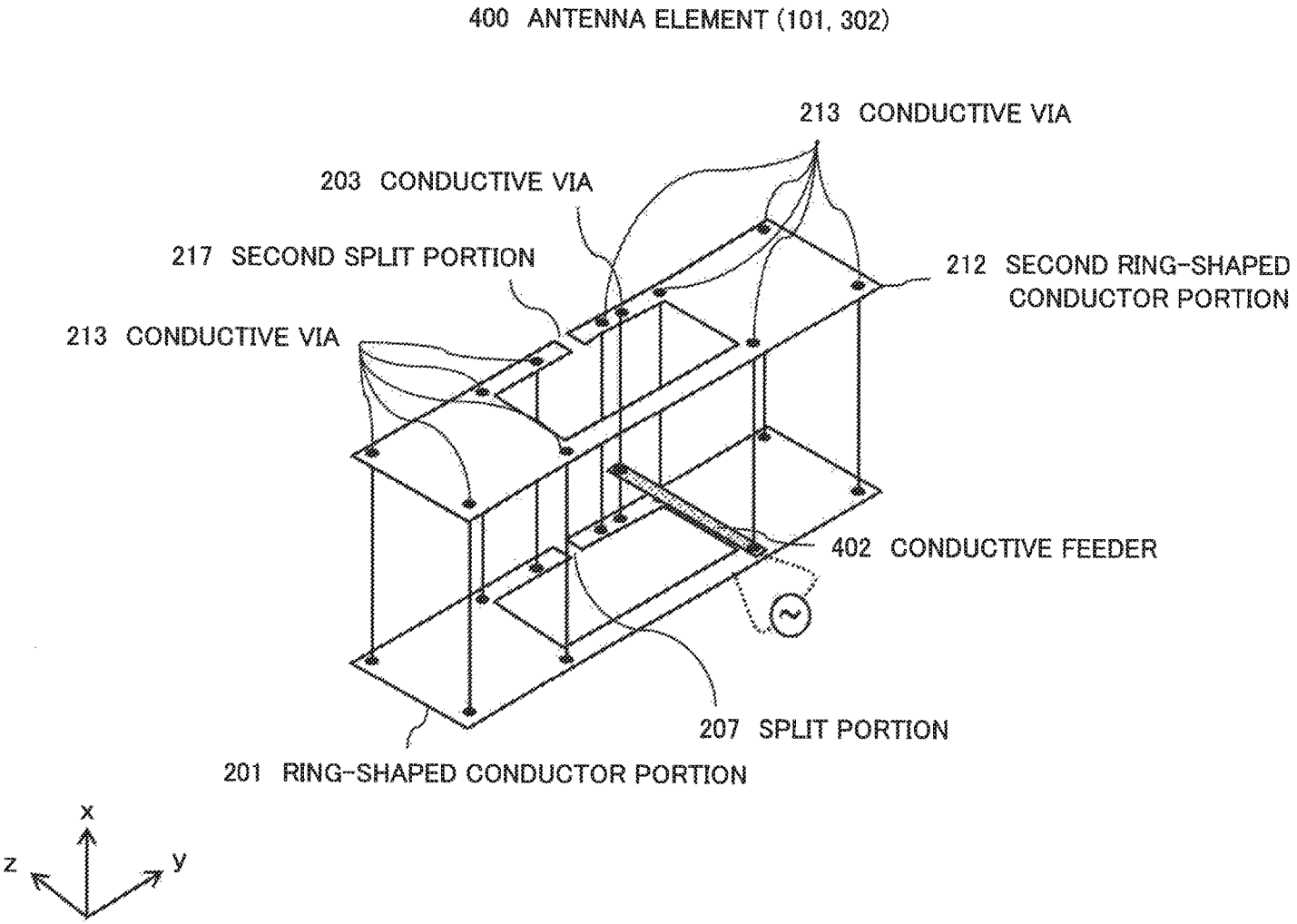
FIG. 46 is a perspective view illustrating a structure of an antenna element 400 in a variation 18 of the present invention.

FIG. 46 is a perspective view of an antenna element 400 of the variation 18.

The antenna element 400 of the present variation includes a second ring-shaped conductor portion in a layer different from the layers in which the ring-shaped conductor portion 201 and the conductive feeder 402 are respectively disposed. The ring-shaped conductor portion 201 and the second ring-shaped conductor portion 212 are electrically connected to each other by a plurality of conductive vias 213.

In this case, a position at which the split portion 207 is disposed in the circumferential direction of the ring-shaped conductor portion 201 and a position at which a second split portion 217 is disposed in the circumferential direction of the second ring-shaped conductor portion 212 coincide with each other as viewed from the direction (x-axis direction) perpendicular to a plane on which the ring-shaped conductor portion 201 is disposed. The ring-shaped conductor portion 201 and the second ring-shaped conductor portion 212 work as a single split ring resonator.

In this case, the conductive feeder 402 has a large portion of the periphery thereof surrounded by the ring-shaped conductor portion 201, the second ring-shaped conductor portion 212, and the plurality of conductive vias 213, which are conductors that are conductive with one another. The above configuration enables radiation of unnecessary electromagnetic waves from the conductive feeder 402 to be reduced.

Figure 47:
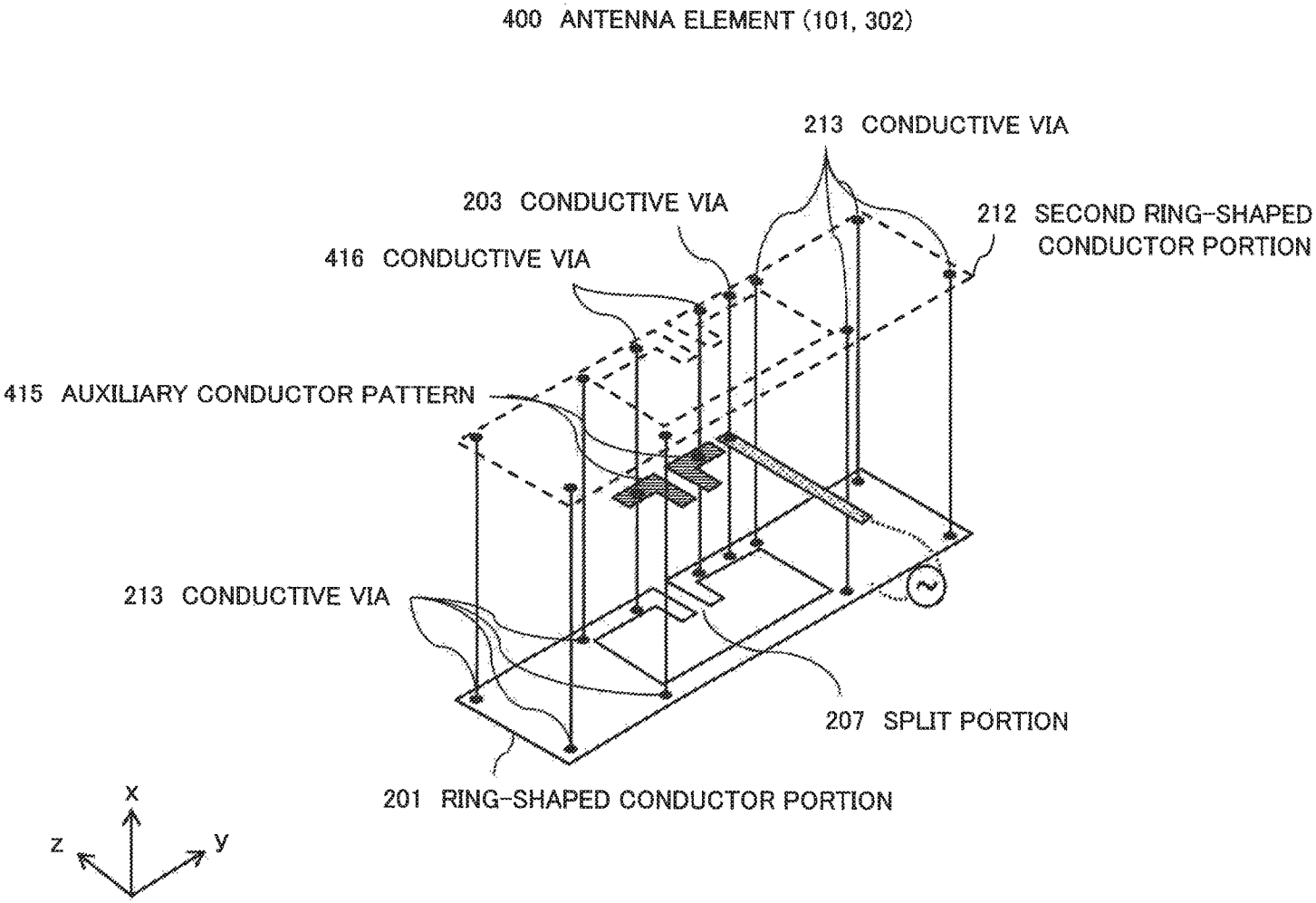
FIG. 47 is a perspective view illustrating another structure of the antenna element 400 in the variation 18 of the present invention.

In addition, as illustrated in FIG. 47, the antenna element 400 may also be configured in such a manner that auxiliary conductor patterns 415 similar to the ones illustrated in FIG. 41 are disposed in a layer different from the layers in which the ring-shaped conductor portion 201 and the second ring-shaped conductor portion 212 are respectively disposed and the auxiliary conductor patterns 415 connect to the ring-shaped conductor portion 201 and the second ring-shaped conductor portion 212 via conductive vias 416. Since the auxiliary conductor patterns 415 cause the area of conductors that face each other at the split portion 207 and the second split portion 217 to be increased, the capacitance may be increased without increasing the size of the whole split ring resonator.

Figure 69:
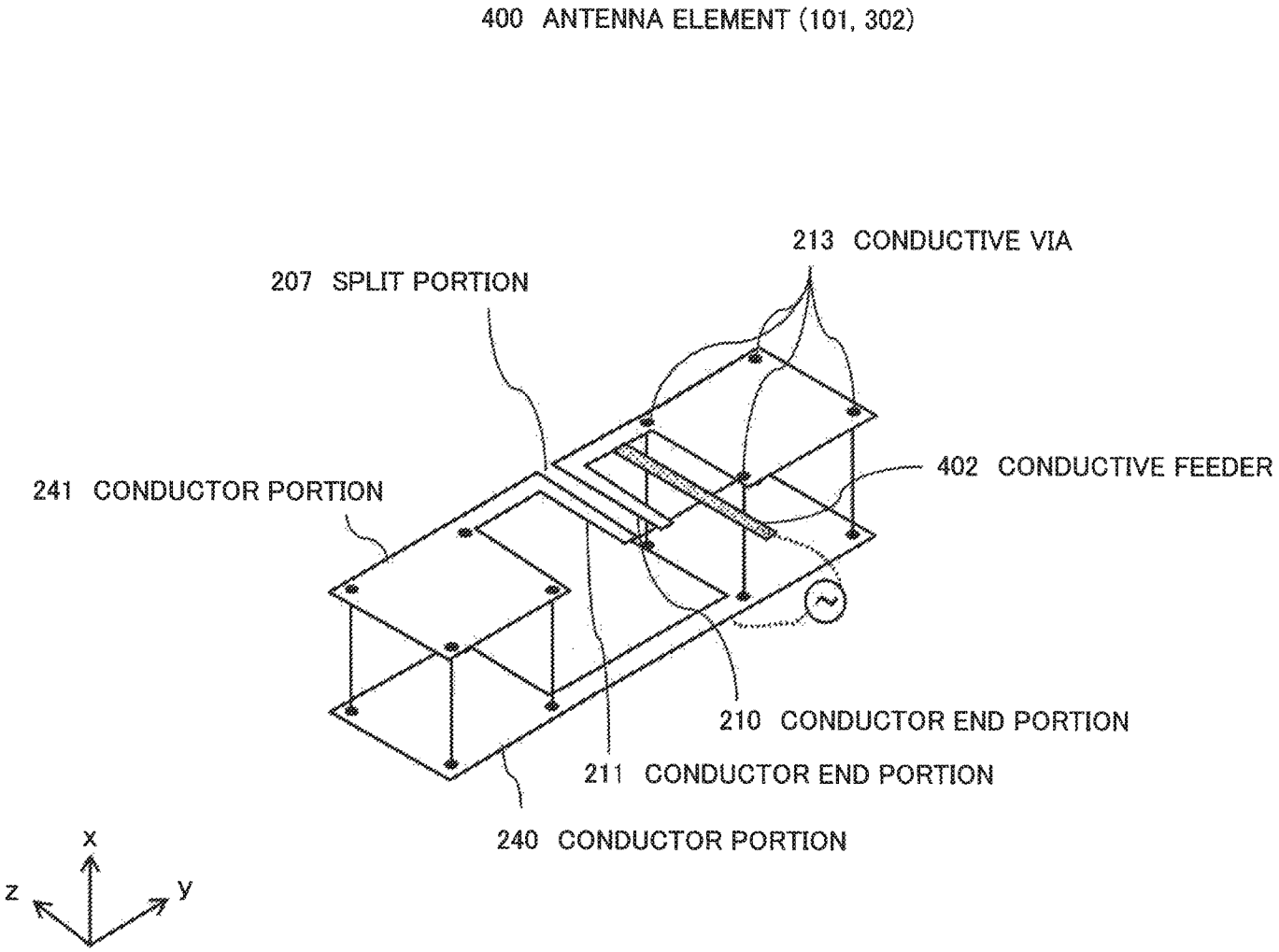
FIG. 69 is a perspective view illustrating still another structure of the antenna element 400 in the variation 18 of the present invention.

In addition, the antenna element 400 may use two-layered conductor portions 240 and 241 in place of the ring-shaped conductor portion 201 and the second ring-shaped conductor portion 212 in FIG. 46, as illustrated in FIG. 69.

The conductor portions 240 and 241 are configured so that the two layers work as a single ring-shaped conductor. The conductor portions 240 and 241 are connected to each other by a plurality of conductive vias 213.

The conductor portions 241, which are the second layer, are configured in such a manner that a long side portion facing the split portion 207 with a void space interposed therebetween is removed from the ring-shaped conductor portion 201. The conductor portions 241 are disposed in the same layer as the conductive feeder 402. The conductive feeder 402 is directly connected to the conductor end portion 210 or 211, both of which form the split portion 207 of the conductor portions 241, without the conductive via 203 interposed therebetween (in FIG. 67, connected to the conductor end portion 210).

The conductor portion 240, which is the first layer, is configured in such a manner that a long side portion including the split portion 207 is removed from the ring-shaped conductor portion 201. The conductor portion 240 is disposed at the position of the ring-shaped conductor portion 201 in FIG. 46.

Employing the configuration described above enables the conductor end portions 210 and 211, which constitute the split portion 207, to bend in a direction (negative z-axis direction) that is substantially orthogonal to the direction in which the conductor end portions 210 and 211 face each other and to extend as illustrated in FIG. 69. Since such a configuration increases the facing area of the conductor end portions 210 and 211, which face each other with the split portion 207 interposed therebetween, the capacitance at the split portion 207 may be increased.

Figure 70:
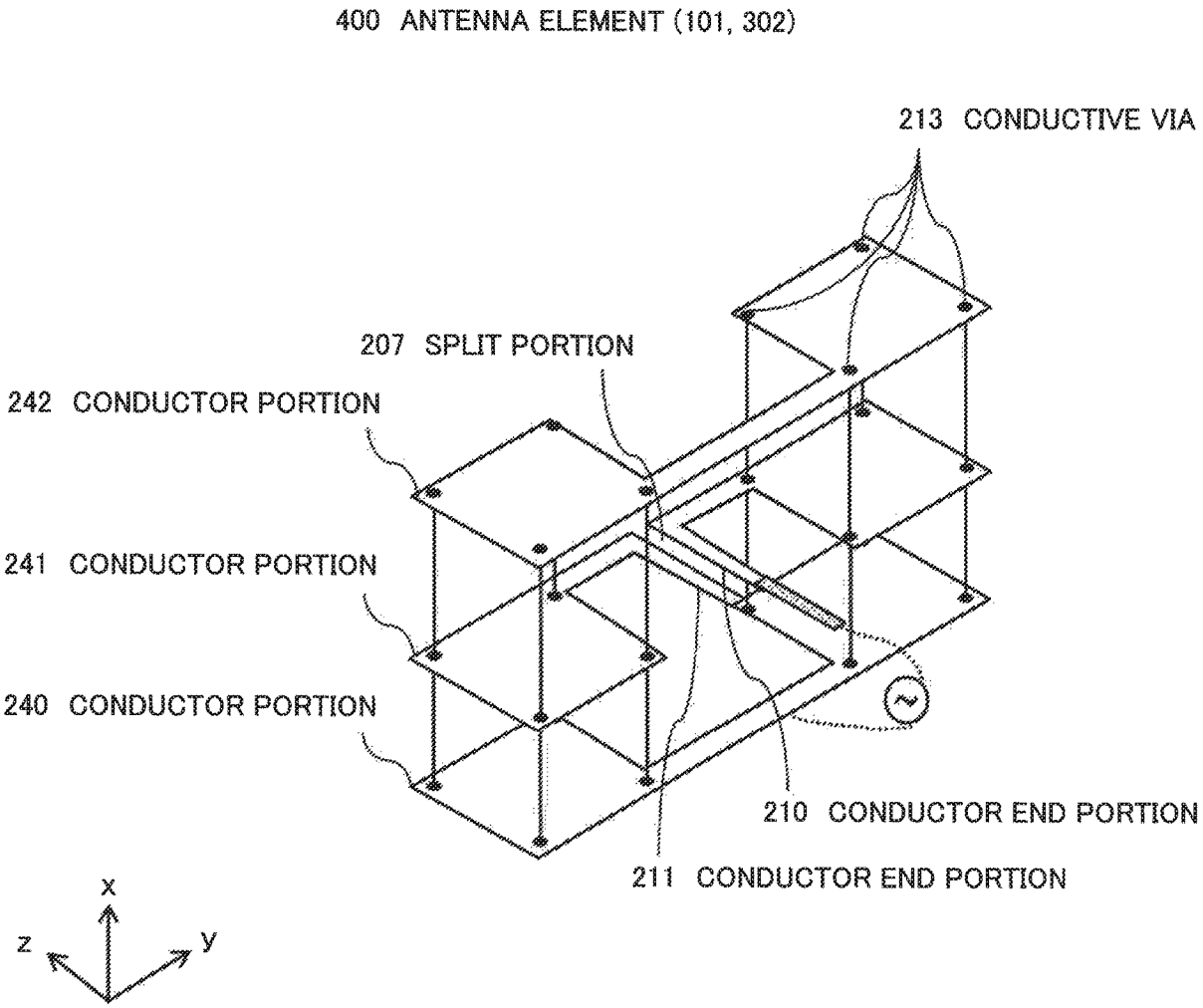
FIG. 70 is a perspective view illustrating still another structure of the antenna element 400 in the variation 18 of the present invention.

As still another configuration, the antenna element 400 may further overlay a conductor portion 242 on the two-layered conductor portions 240 and 241, as illustrated in FIG. 70.

The conductor portion 242 has the same shape as the conductor portion 240 and is disposed in such a way as to face the conductor portion 240 with the conductor portions 241 interposed therebetween. The conductor portion 242 is connected to the conductor portions 240 and 241 by a plurality of conductive vias 213.

The configuration as described above causes the split portion 207 to be formed inside the dielectric layer 205 (not illustrated). For this reason, the antenna element 400 in which influence of an object present outside the dielectric layer 205 on capacitance generated at the split portion 207 is reduced is achieved.

<Variation 19>

Figure 48:
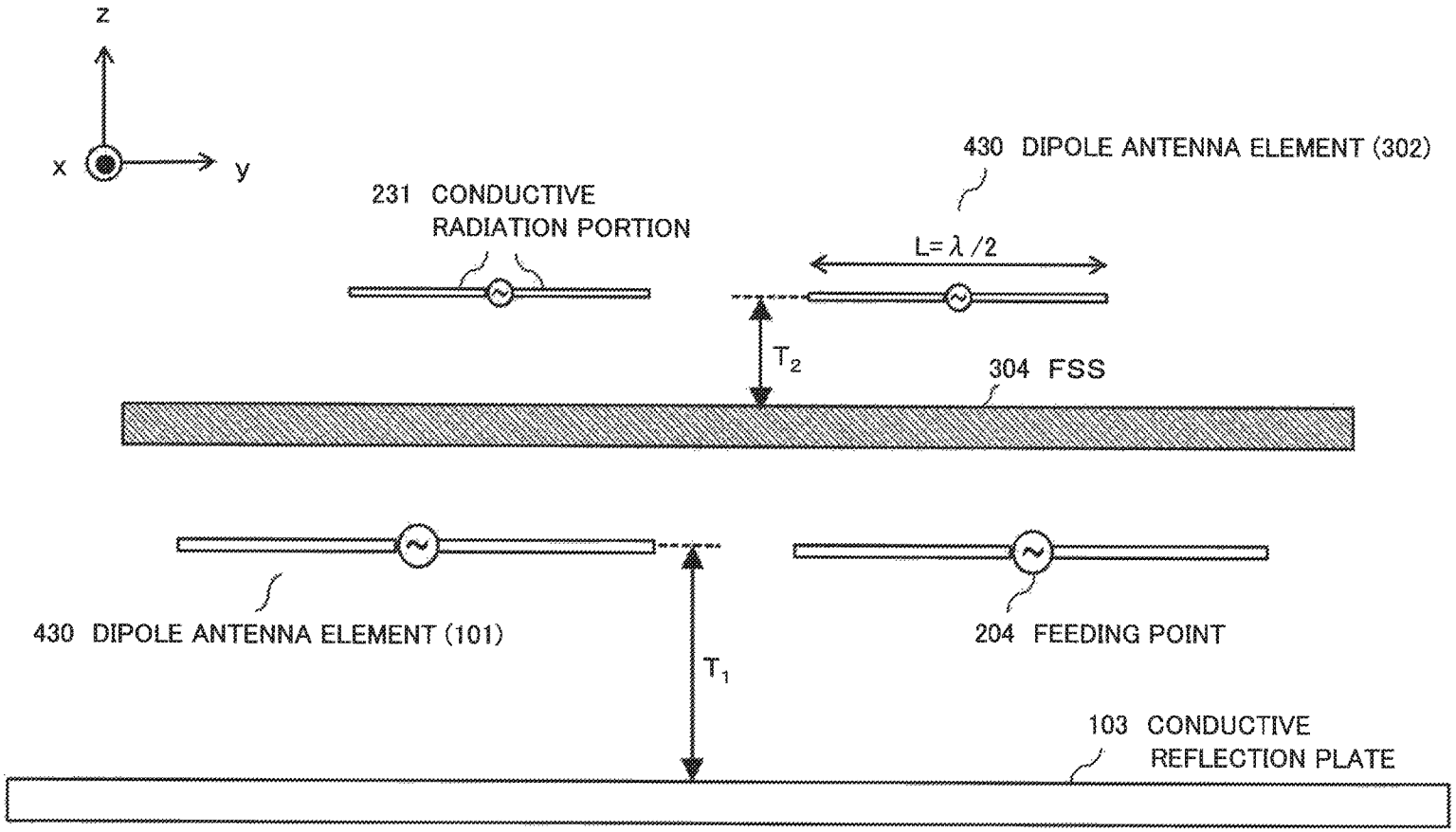
FIG. 48 is a plan view illustrating a structure of a multiband antenna 3 in a variation 19 of the present invention.

FIG. 48 is a diagram illustrating a structure of a multiband antenna 3 of the variation 19.

In the present variation, each of the antenna elements 400 that constitute the first antenna elements 101 and the second antenna elements 302 is configured with a dipole antenna element 430. The dipole antenna element 430 includes conductive radiation portions 231 and a feeding point 204.

The antenna element 430 of the present variation differs from the antenna element 230 of the variation 10 in that the conductive feeder 202 and the conductive feeding GND portion 206 are not included. Since the configuration of the dipole antenna element 430 is the same as the dipole antenna element 230 of the variation 10 except the above-described difference, a detailed description thereof will be omitted.

Although, in the present example embodiment, the antenna element 400 is assumed to be an antenna element that works as a split ring resonator or a dipole antenna element, other antenna structures, such as a patch antenna, may also be employed. When the antenna elements 400 are patch antennas, the distance $T_1$ of the first antenna elements 101 from the conductive reflection plate 103 and the distance $T_2$ of the second antenna elements 302 from the FSS 304 are generally reduced to substantially less than a quarter of the wavelengths of electromagnetic waves having the operating frequencies of the respective antenna elements. In addition, in order to suppress influence of the second antenna elements 302 as metal objects on the first antenna elements 101, it is more desirable that each second antenna elements 302 have a structure constituting a split ring resonator, such as the variation 11, that has a small antenna element size.

<Variation 20>

Figure 49:
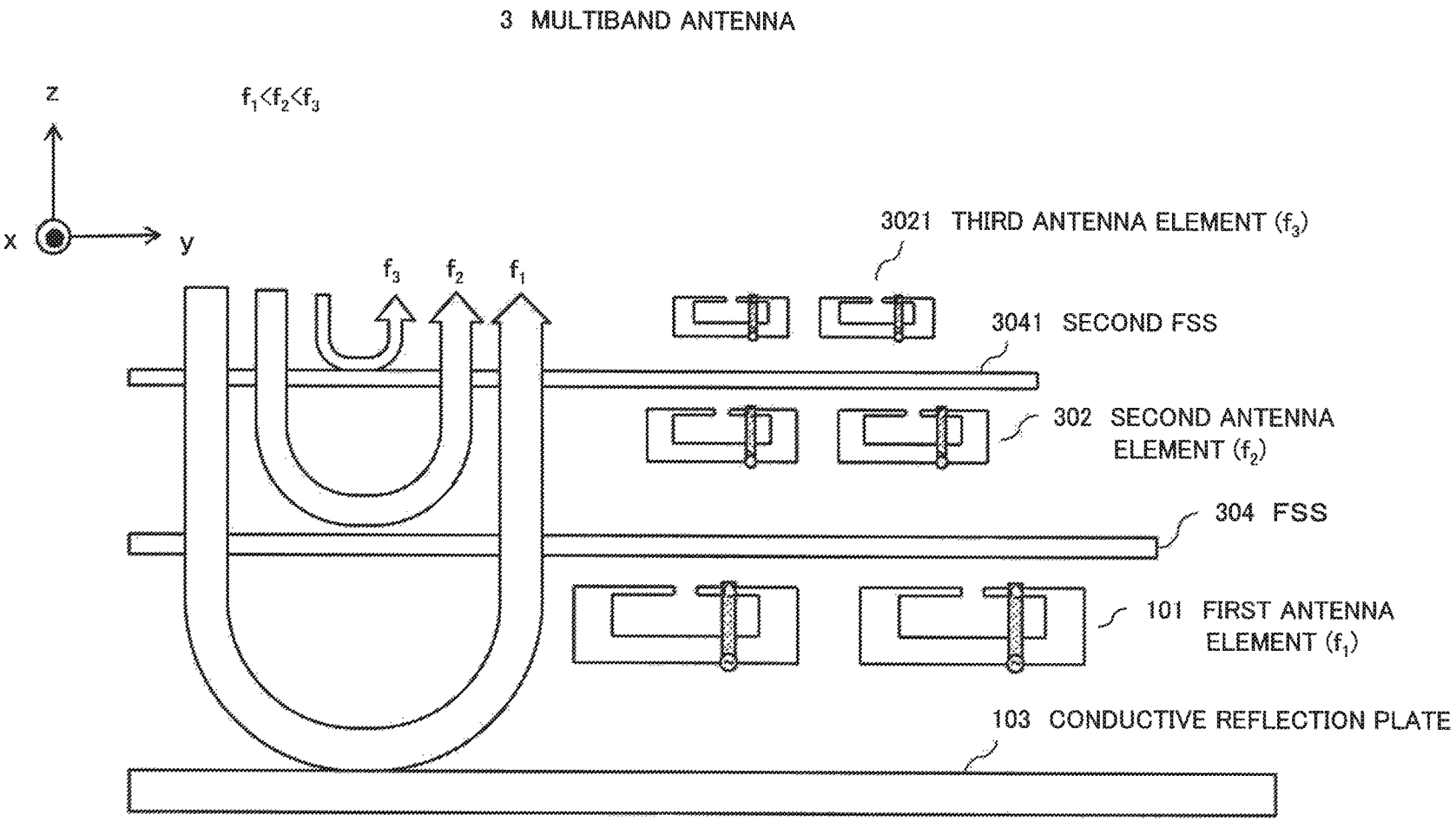
FIG. 49 is a diagram illustrating a configuration of a multiband antenna 3 in a variation 20 of the present invention.

FIG. 49 is a diagram illustrating a configuration of a multiband antenna 3 of a variation 20.

The multiband antenna 3 of the present variation includes a second FSS 3041 and a plurality of third antenna elements 3021 in addition to the configuration of the multiband antenna 3 described in the present example embodiment and the above-described variations. However, the third antenna element 3021 may be singular in number.

As illustrated in FIG. 49, in the multiband antenna 3 of the present variation, the second FSS 3041 and the third antenna elements 3021 are stacked on the second antenna elements 302 in this sequence. As a result, the multiband antenna 3 may, while arranging the plurality of first antenna elements 101, the plurality of second antenna elements 302, and the plurality of third antenna elements 3021, which are tuned to different operating frequencies, respectively, in proximity to one another in the planar direction (directions perpendicular to the stacking direction), retain performance of each antenna element. The reason for the capability is because the second FSS 3041 transmits therethrough electromagnetic waves in a first frequency band and a second frequency band including the frequencies $f_1$ and $f_2$ and reflects thereon electromagnetic waves in a third frequency band that is a frequency band outside the first frequency band and the second frequency band and includes a frequency $f_3$ ($f_1<f_2<f_3$).

In the present variation, each of the antenna elements that the multiband antenna 3 includes is configured with the antenna element 400 described in the variation 11. However, the configuration of the respective antenna elements is not limited to the above configuration. For example, each antenna element may be configured with an antenna element 400 of other variations of the present example embodiment, an antenna element of other example embodiments, or a combination thereof. When each third antenna element 3021 is configured with an antenna element 200 of the first example embodiment, it is assumed that both the FSS 304 and the second FSS 3041 include openings 107.

Although, in the present variation, the multiband antenna 3 is assumed to have a configuration including three types of antenna elements, the multiband antenna 3 may have a configuration including four or more types of antenna elements in a similar manner.

Third Example Embodiment

Figure 50:
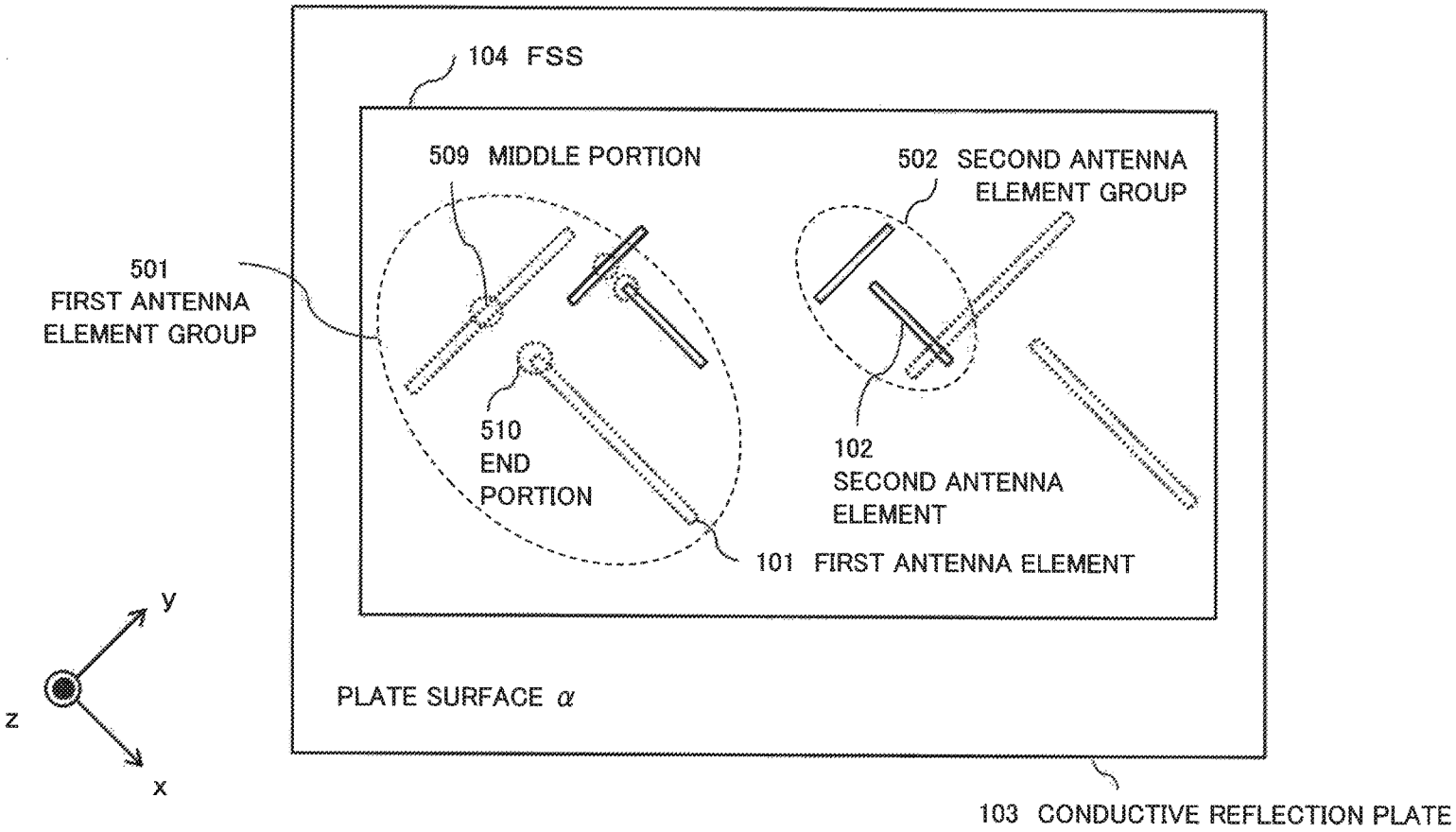
FIG. 50 is a top view illustrating a configuration of a multiband antenna 5 in a third example embodiment of the present invention.
Figure 51:
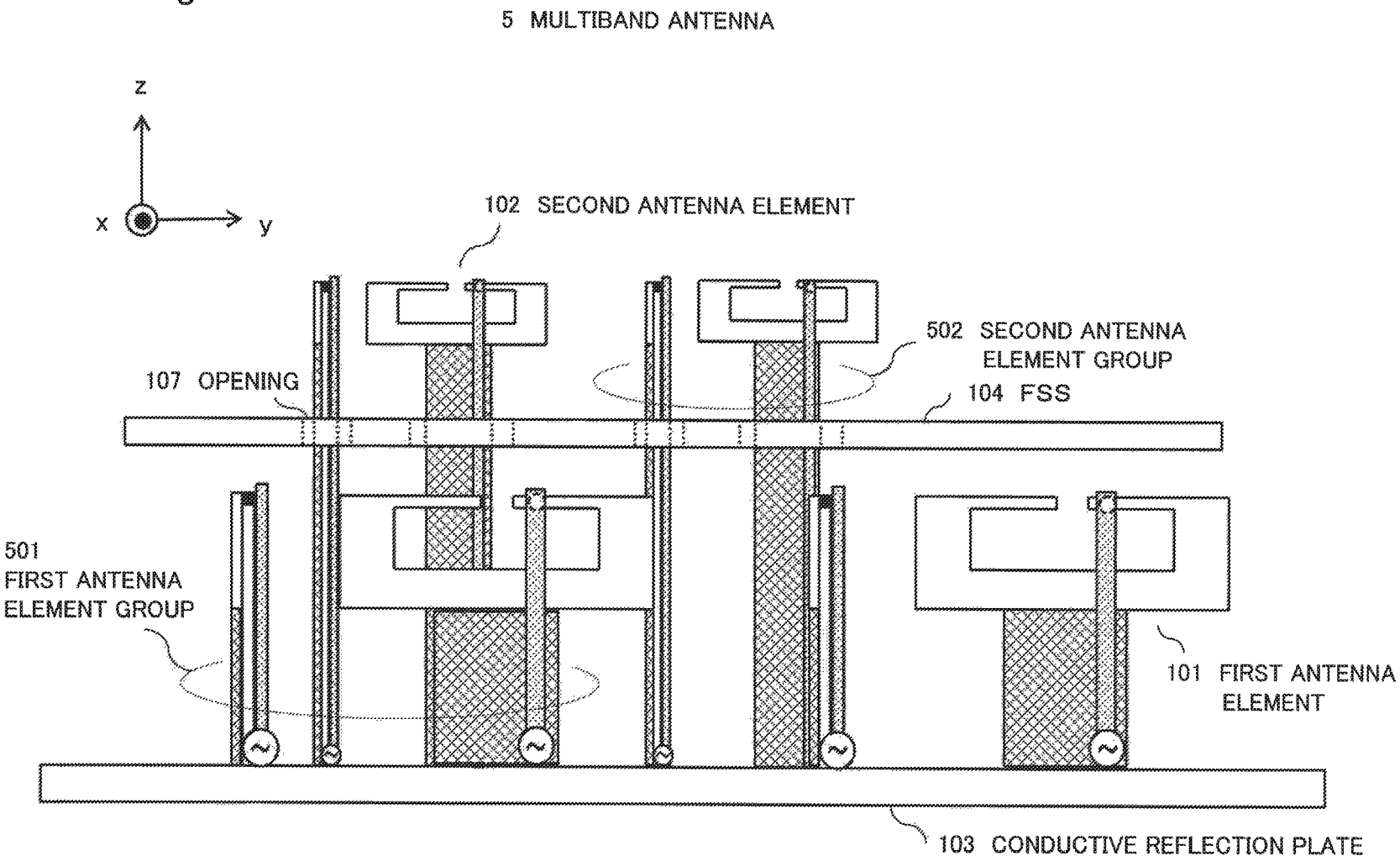
FIG. 51 is a plan view illustrating the configuration of the multiband antenna 5 in the third example embodiment of the present invention.

FIGS. 50 and 51 are diagrams illustrating a multiband antenna 5 in a third example embodiment of the present invention.

FIG. 50 is a top view of the multiband antenna 5 in the present example embodiment. FIG. 51 is a yz cross-sectional view of the multiband antenna 5 of the present example embodiment. The multiband antenna 5 includes a plurality of first antenna element groups 501, a plurality of second antenna element groups 502, a conductive reflection plate 103, and an FSS 104. A first antenna element group 501 is configured with two first antenna elements 101 that are orthogonal to each other. Similarly, a second antenna element group 502 is configured with two second antenna elements 102 that are orthogonal to each other. The multiband antenna 5 of the present example embodiment differs from multiband antennas of the first and second example embodiments in that two antenna elements that are orthogonal to each other constitute an orthogonal dual polarization antenna (equivalent to a first antenna element group 501 and a second antenna element group 502) and the orthogonal dual polarization antennas are arrayed in plurality. Since the configuration is the same as the multiband antennas of the first and second example embodiments except the above-described difference, a detailed description thereof will be omitted.

As illustrated in FIG. 51, each of the first antenna elements 101 and the antenna elements 102 is configured with an antenna element 200 of the variation 4.

As illustrated in FIG. 50, in a projection view on the conductive reflection plate 103, the longitudinal directions of two antenna elements that constitute each first antenna element group 501 and each second antenna element group 502 are substantially orthogonal to each other. An end portion 510 in the longitudinal direction (x-axis direction) of one of the antenna elements is positioned substantially in a vicinity of a middle portion 509 (middle vicinity) in the longitudinal direction of the other of the antenna elements. Two antenna elements that constitute each first antenna element group 501 and each second antenna element group 502 are disposed distanced from each other.

The multiband antenna 5 having the configuration described above includes a plurality of first antenna elements 101 that are in substantially perpendicular relationships to one another in in-plane directions of a plane surface $\alpha$ and a plurality of second antenna elements 102 that are in substantially perpendicular relationships to one another in in-plane directions of the plane surface $\alpha$. For this reason, a multiband antenna that is capable of transmitting and receiving orthogonal dual polarized waves may be achieved.

In addition, as described above, vicinities of both ends (end portions 510) in the extending direction (x-axis direction or y-axis direction) of each antenna element constituting a first antenna element group 501 and a second antenna element group 502 constitute electrical open-circuit planes when the antenna element is in resonance electromagnetically. For this reason, the vicinities are brought to a state in which electric field strength is strong and magnetic field strength is weak. On the other hand, a vicinity of the middle (middle portion 509) in the extending direction of each antenna element constitutes a short-circuit plane and is brought to a state in which magnetic field strength is strong and electric field strength is weak.

Accordingly, two antenna elements that constitute each first antenna element group 501 and each second antenna element group 502 being disposed substantially perpendicularly to each other in such a way that an end portion 510 of one of the antenna elements is positioned in a vicinity of the middle portion 509 of the other of the antenna element causes the two antenna elements to be disposed orthogonal to each other so that portions having strong field strengths do not come close to each other. Therefore, a plurality of antenna elements may, while suppressing electromagnetic coupling, be disposed in proximity to one another. In other words, when dual polarization capable antenna elements are formed using a plurality of antenna elements, it is possible to, while suppressing electromagnetic coupling between polarized waves, dispose antenna elements capable of transmitting and receiving respective polarized waves in proximity to each other and, eventually, to suppress an increase in the size of the whole antenna caused by the forming of dual polarization capable antenna elements.

Figure 52:
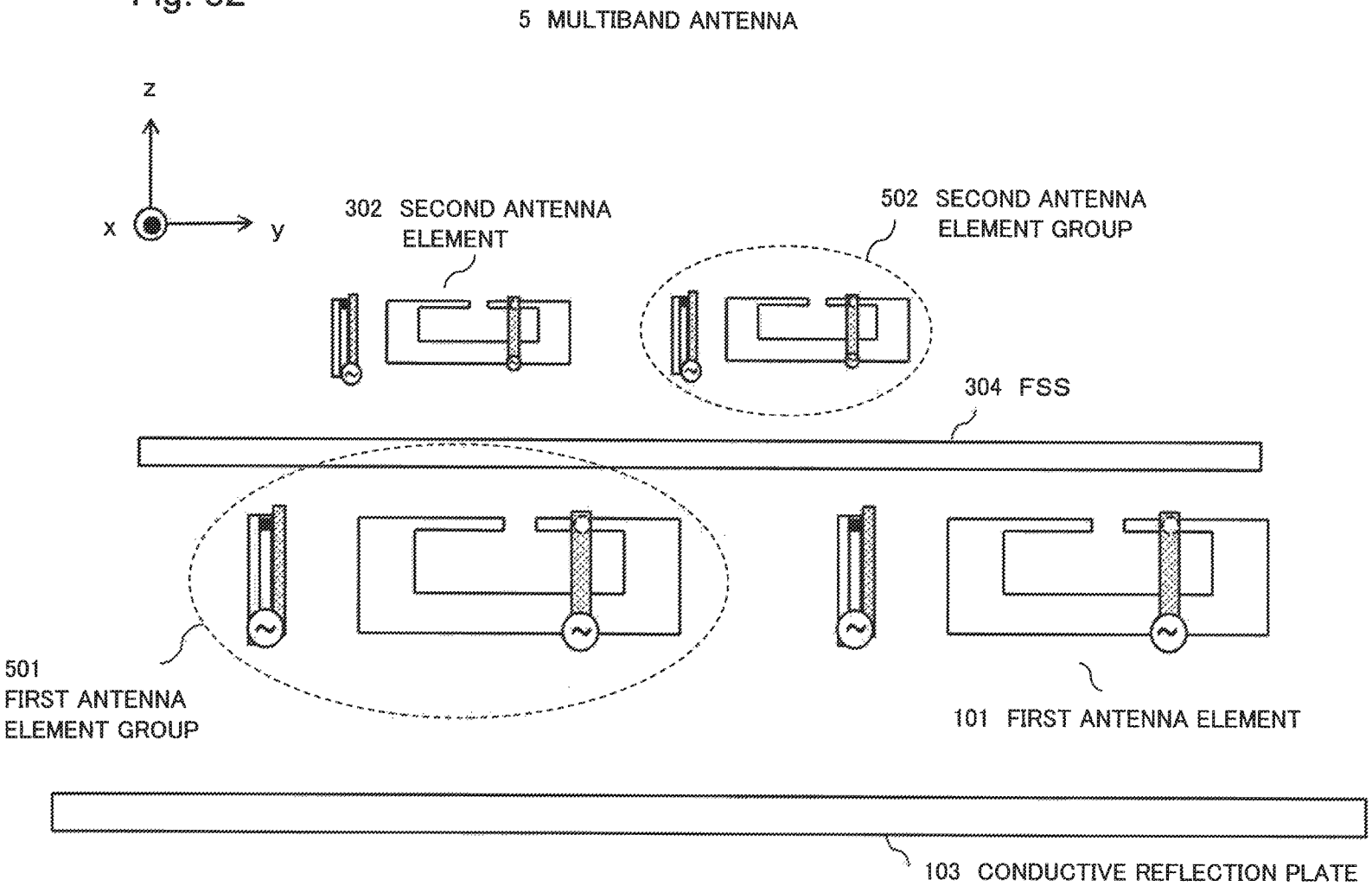
FIG. 52 is another plan view illustrating the configuration of the multiband antenna 5 in the third example embodiment of the present invention.

In the present example embodiment, it is assumed that each of antenna elements that constitute the first antenna element groups 501 and the second antenna element groups 502 is configured with an antenna element 200 of the variation 4. However, the configuration of the antenna elements is not limited to the above configuration. For example, as illustrated in FIG. 52, each antenna element may be configured with an antenna element 400 of the variation 11. In this case, the FSS 104 is, as with the variation 11, configured with an FSS 304 that does not include any openings. As described above, antenna elements that constitute the first antenna element groups 501 and the second antenna element groups 502 may be configured with respective antenna elements described in the above-described example embodiments and the variations or a combination thereof.

Consequently, in addition to the advantageous effects of the first and second example embodiments, the multiband antenna 5 according to the third example embodiment further enables a multiband antenna to be provided that is capable of transmitting and receiving orthogonal dual polarized waves and, while suppressing coupling between polarized waves, suppresses an increase in the size of the whole antenna caused by the forming of dual polarization capable antenna elements.

<Variation 21>

Figure 53:
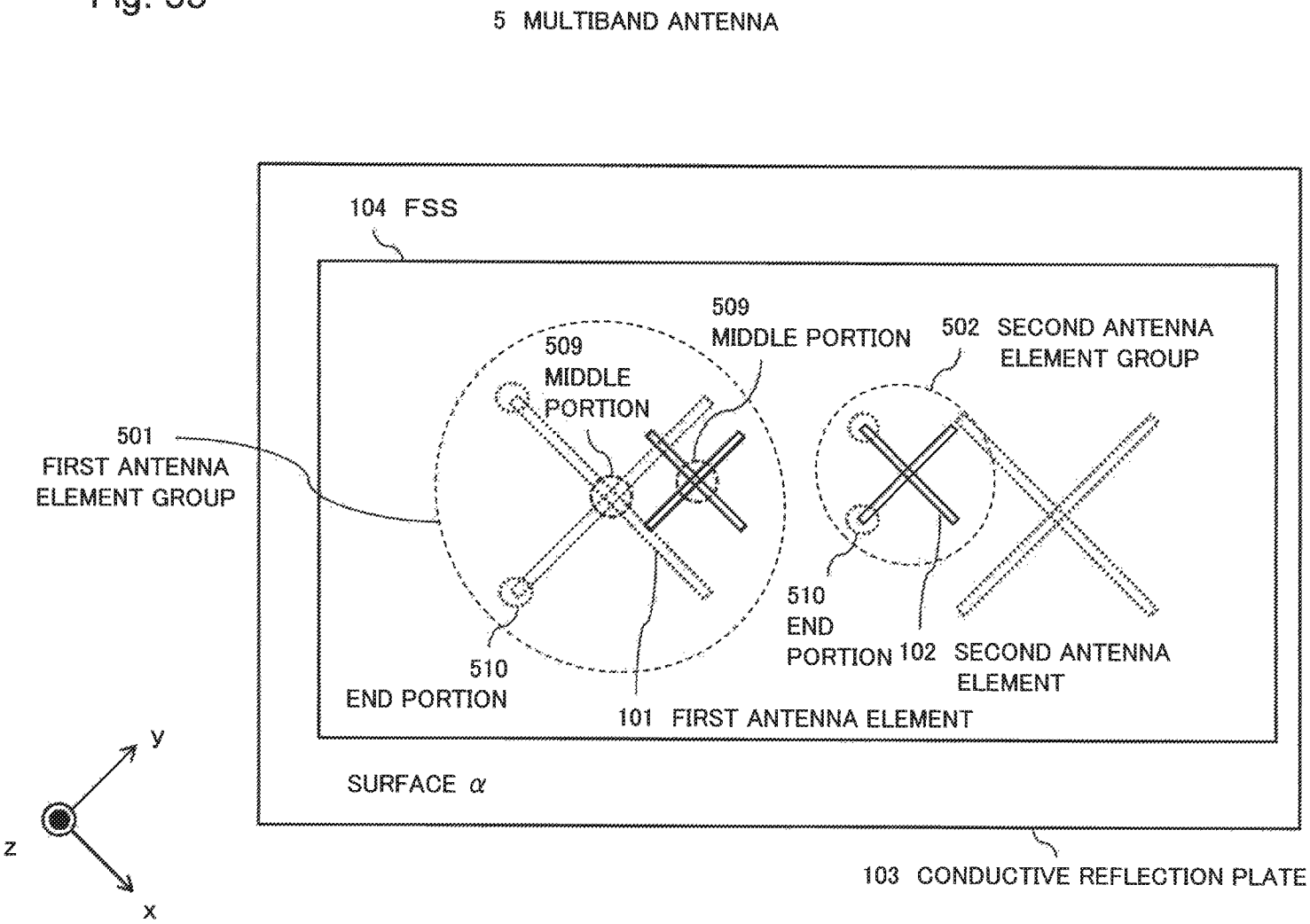
FIG. 53 is a top view illustrating a configuration of a multiband antenna 5 in a variation 21 of the present invention.
Figure 54:
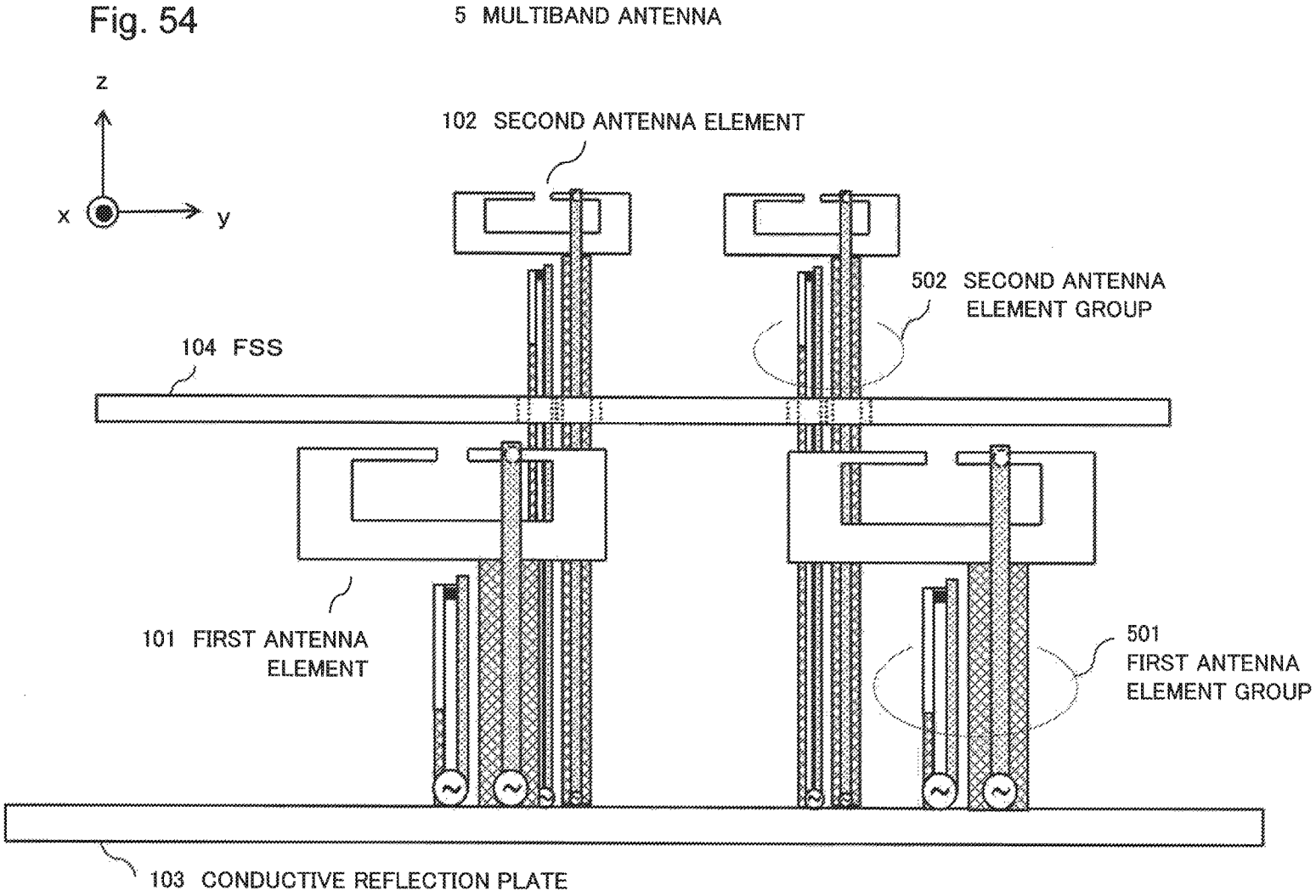
FIG. 54 is a plan view illustrating the configuration of the multiband antenna 5 in the variation 21 of the present invention.

FIG. 53 is a top view of a multiband antenna 5 of a variation 21. FIG. 54 is a yz cross-sectional view of the multiband antenna 5 of the variation 21.

As illustrated in FIG. 53, in each first antenna element group 501 and each second antenna element group 502 of the multiband antenna 5 of the present variation, as viewed from the top surface (positive z-axis direction) side, a first antenna element 101 and a second antenna element 102 that have one direction (y-axis direction) as the extending direction and another first antenna element 101 and another second antenna element 102 that have another direction (x-axis direction) as the extending direction are disposed in such a way that the first antenna elements 101 and the second antenna elements 102 cross at right angles with each other at the middles (middle portions 509) in the extending directions of the respective antenna elements, respectively.

In addition, as illustrated in FIG. 54, two first antenna elements 101 and two second antenna elements 102 that are disposed in such a way as to cross at right angles with each other as viewed from the top surface side are disposed distanced from each other in the z-axis direction, respectively.

Employing the configuration described above causes both ends (end portions 510) in the extending directions (x-axis direction and y-axis direction) of the respective antenna elements, which constitute electrical open-circuit planes when the antenna elements are in resonance and at which electric field strength is strong, to be distanced from each other. In addition, magnetic fields that two antenna elements crossing at right angles with each other generate are highly orthogonal. Therefore, the multiband antenna 5 of the present variation may, while suppressing coupling between first antenna elements 101 that constitute a first antenna element group 501 and the extending directions of which are in a perpendicular relationship and second antenna elements 102 that constitute a second antenna element group 502 and the extending directions of which are in a perpendicular relationship, cause a plurality of first antenna element groups 501 and a plurality of second antenna element groups 502 to be disposed in proximity to one another.

Figure 55:
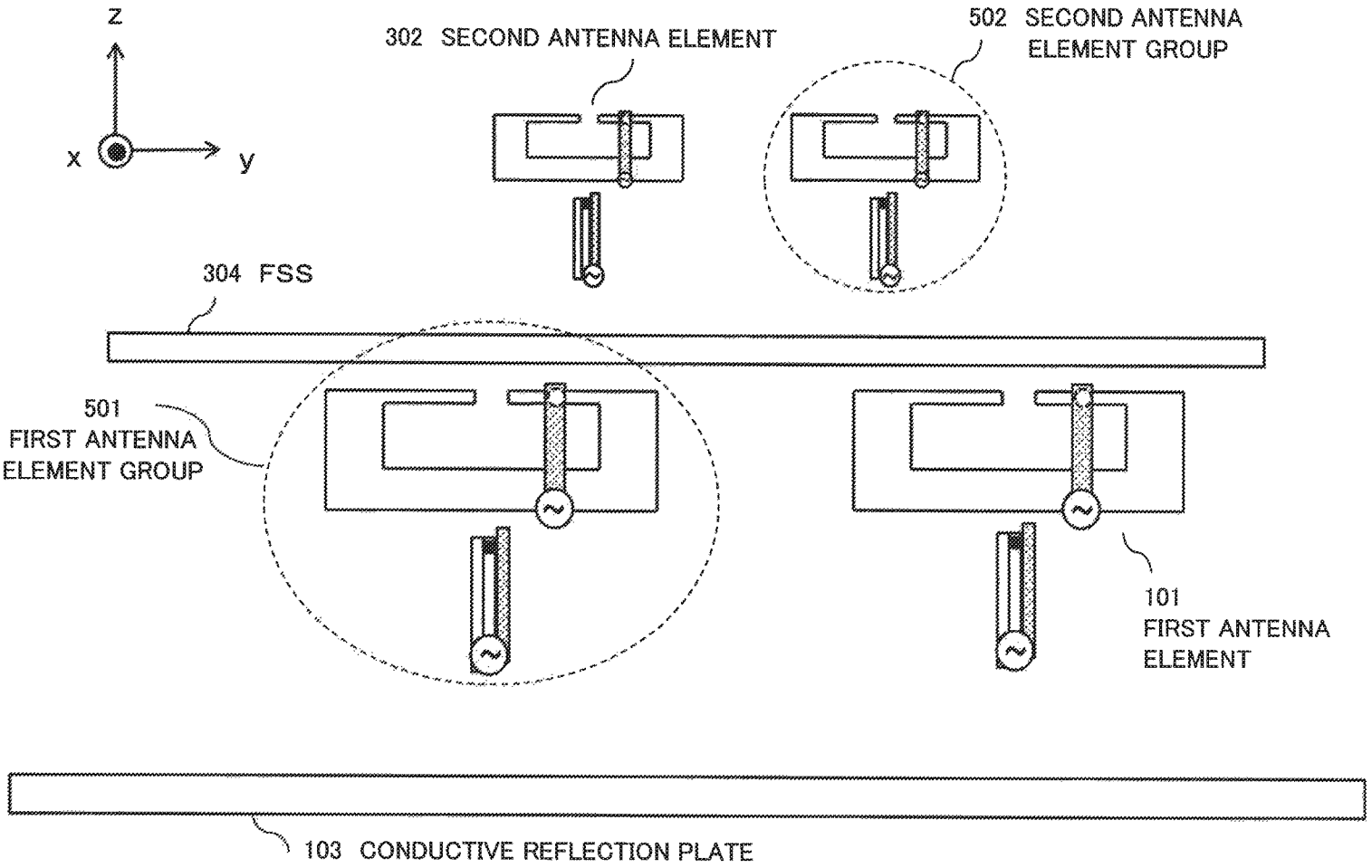
FIG. 55 is another plan view illustrating the configuration of the multiband antenna 5 in the variation 21 of the present invention.

In the present variation, it is assumed that each of antenna elements that constitute the first antenna element groups 501 and the second antenna element groups 502 is configured with an antenna element 200 of the variation 4. However, as illustrated in FIG. 55, the antenna element may be configured with an antenna element 400 of the variation 11, an antenna element of other variations, or a combination thereof.

<Variation 22>

Figure 56:
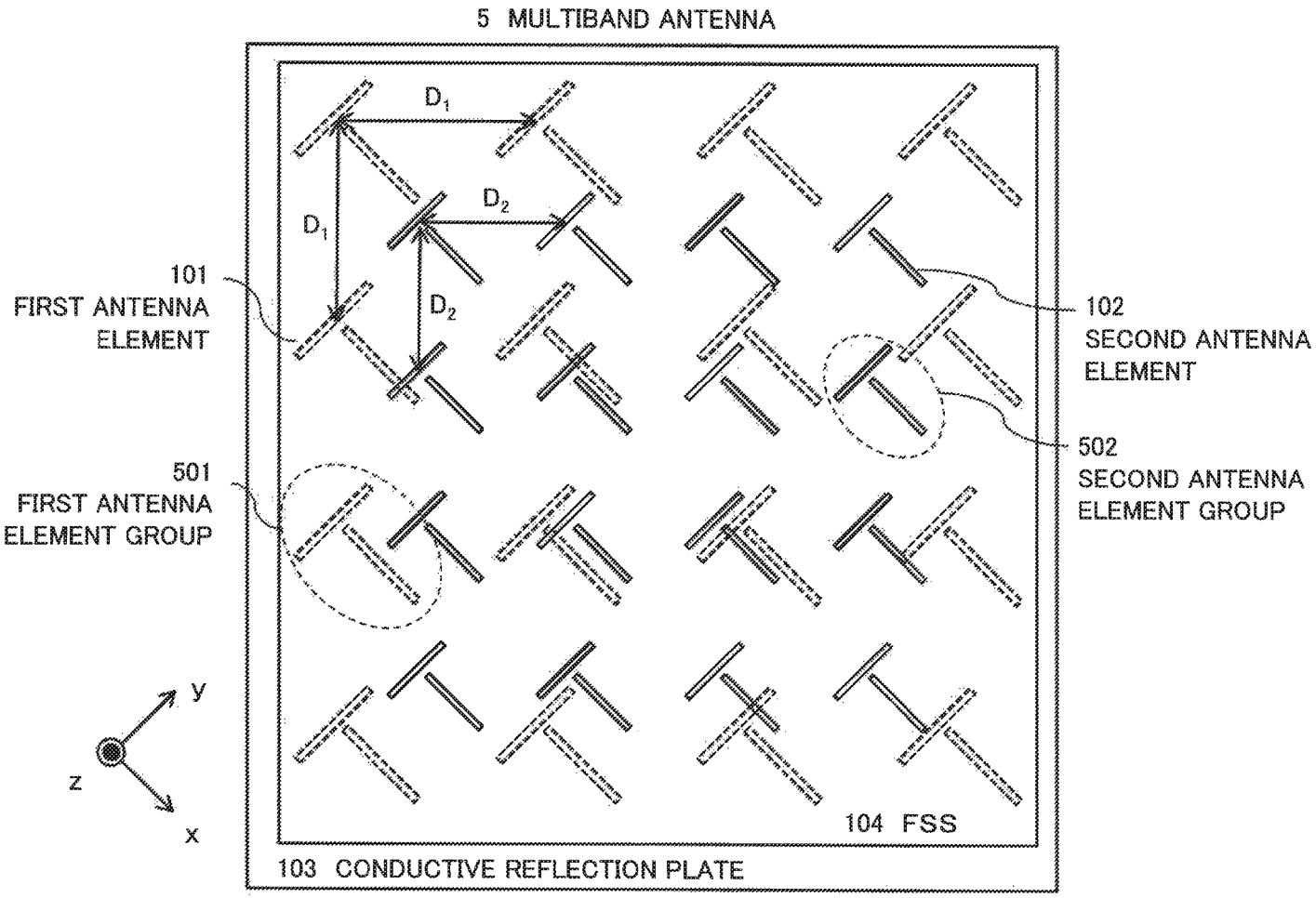
FIG. 56 is a top view illustrating a configuration of a multiband antenna 5 in a variation 22 of the present invention.

FIG. 56 is a top view of a multiband antenna 5 of a variation 22.

In the multiband antenna 5 of the present variation, a plurality of first antenna element groups 501 constitute an antenna array in a square shape with pairs of first antenna elements 101, each pair of which are formed into dual polarization capable antenna elements in a manner described above and are in an orthogonal relationship to each other, arrayed in plurality at a constant interval $D_1$ in in-plane directions of the xy plane into an array shape as with the multiband antenna 1, which is illustrated in FIG. 1 and was described in the first example embodiment. Similarly, a plurality of second antenna element groups 502 constitute an antenna array in a square shape with pairs of second antenna elements 102, each pair of which are in an orthogonal relationship to each other, arrayed in plurality at a constant interval $D_2$ in in-plane directions of the xy plane into an array shape. In this case, since use of a plurality of antenna elements that are parallel with each other enables beam forming as described in the first example embodiment, the multiband antenna 5 of the present variation may perform beam forming with respect to each different frequency ($f_1$ and $f_2$). Further, the multiband antenna 5 of the present variation may perform beam forming with respect to each of orthogonal dual polarized waves.

Figure 57:
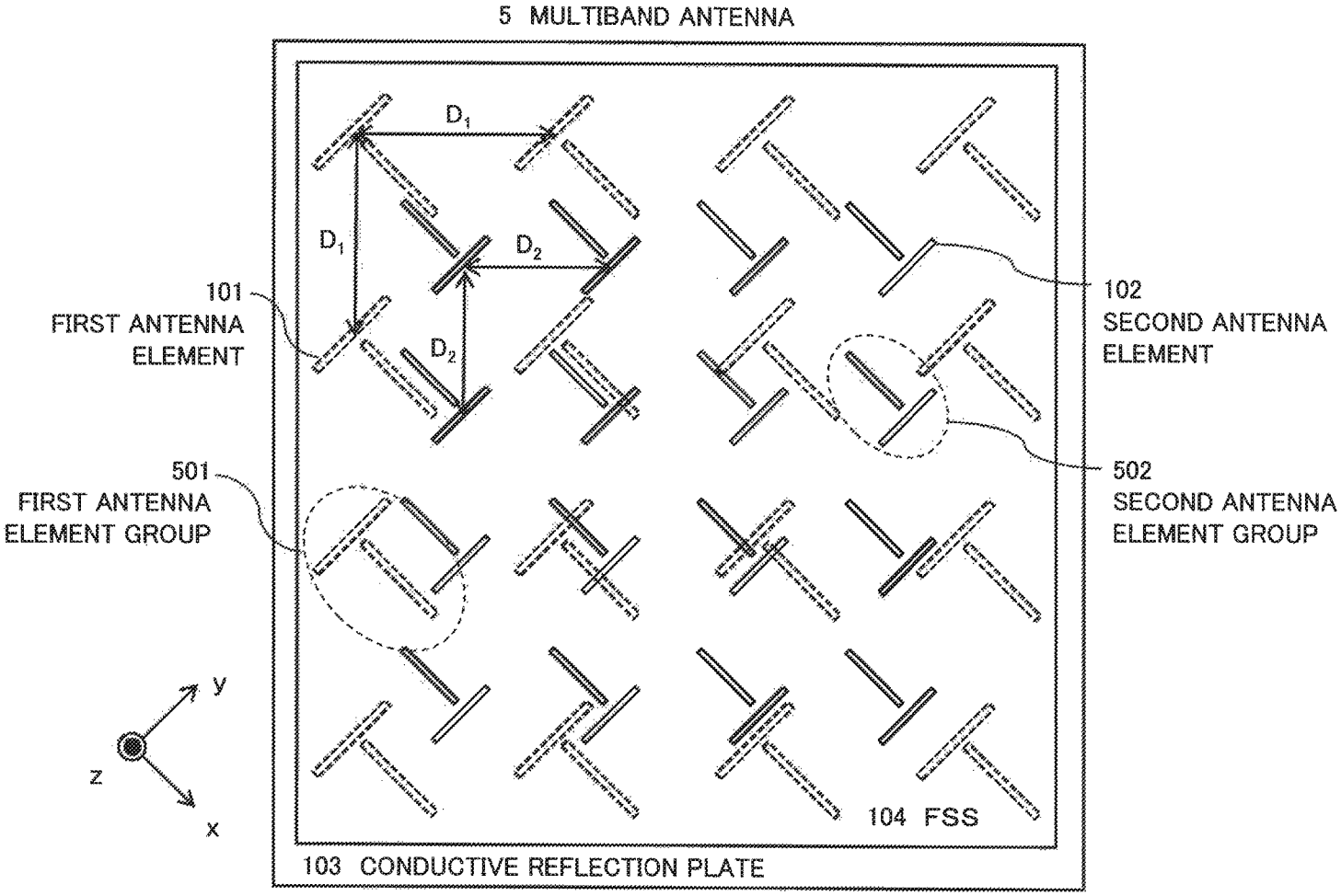
FIG. 57 is a top view illustrating another configuration of the multiband antenna 5 in the variation 22 of the present invention.
Figure 58:
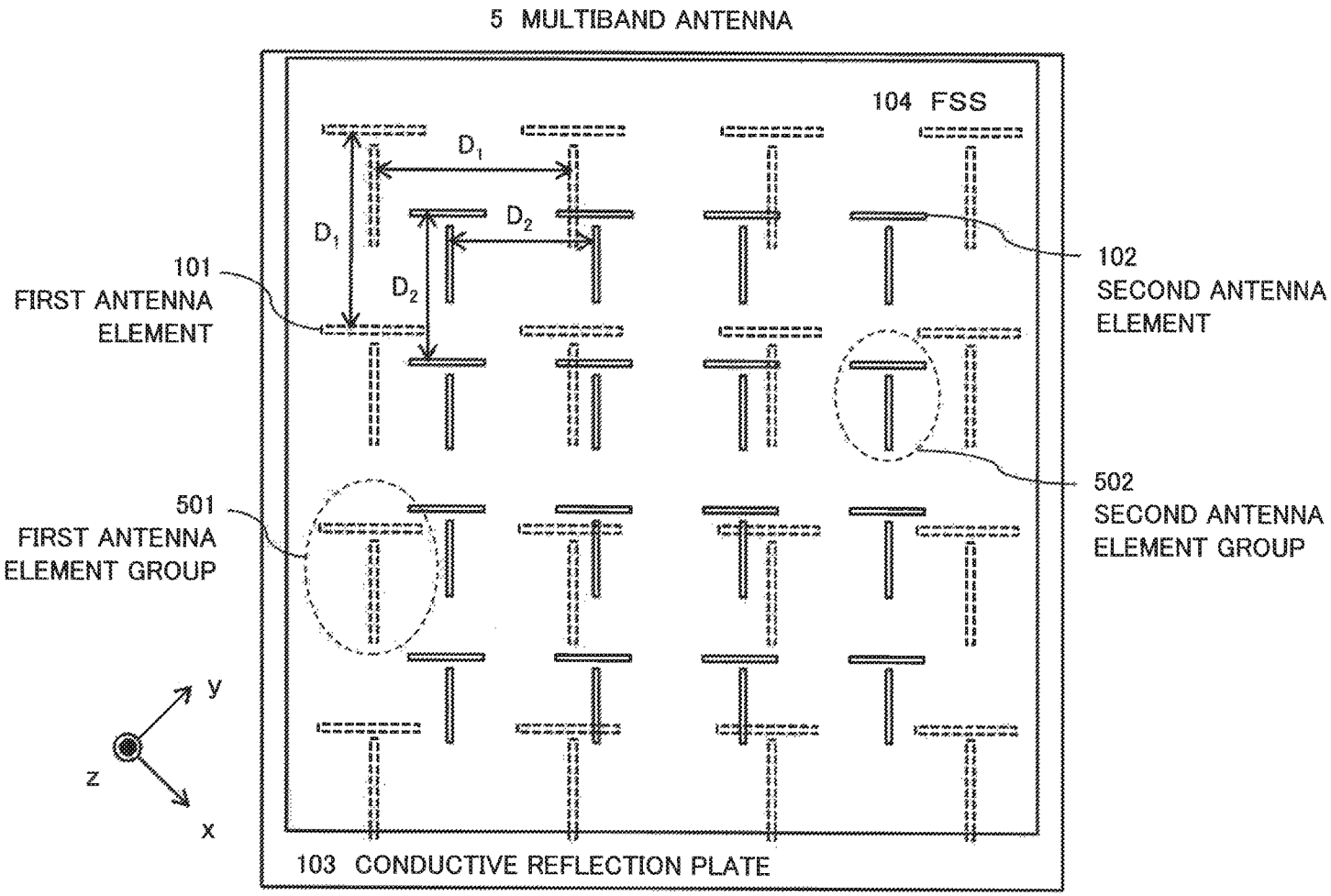
FIG. 58 is a top view illustrating still another configuration of the multiband antenna 5 in the variation 22 of the present invention.

In addition, in the present variation, the first antenna element groups 501 and the second antenna element groups 502 may be configured as illustrated in FIGS. 57 and 58. That is, the directions of a periodic array as an array antenna and the respective extending directions of T-shapes each of which is made up of two antenna elements that are formed into dual polarization capable antenna elements in a manner described in the present example embodiment may be different from each other as illustrated in FIGS. 56 and 57 or identical as illustrated in FIG. 58.

<Variation 23>

Figure 59:
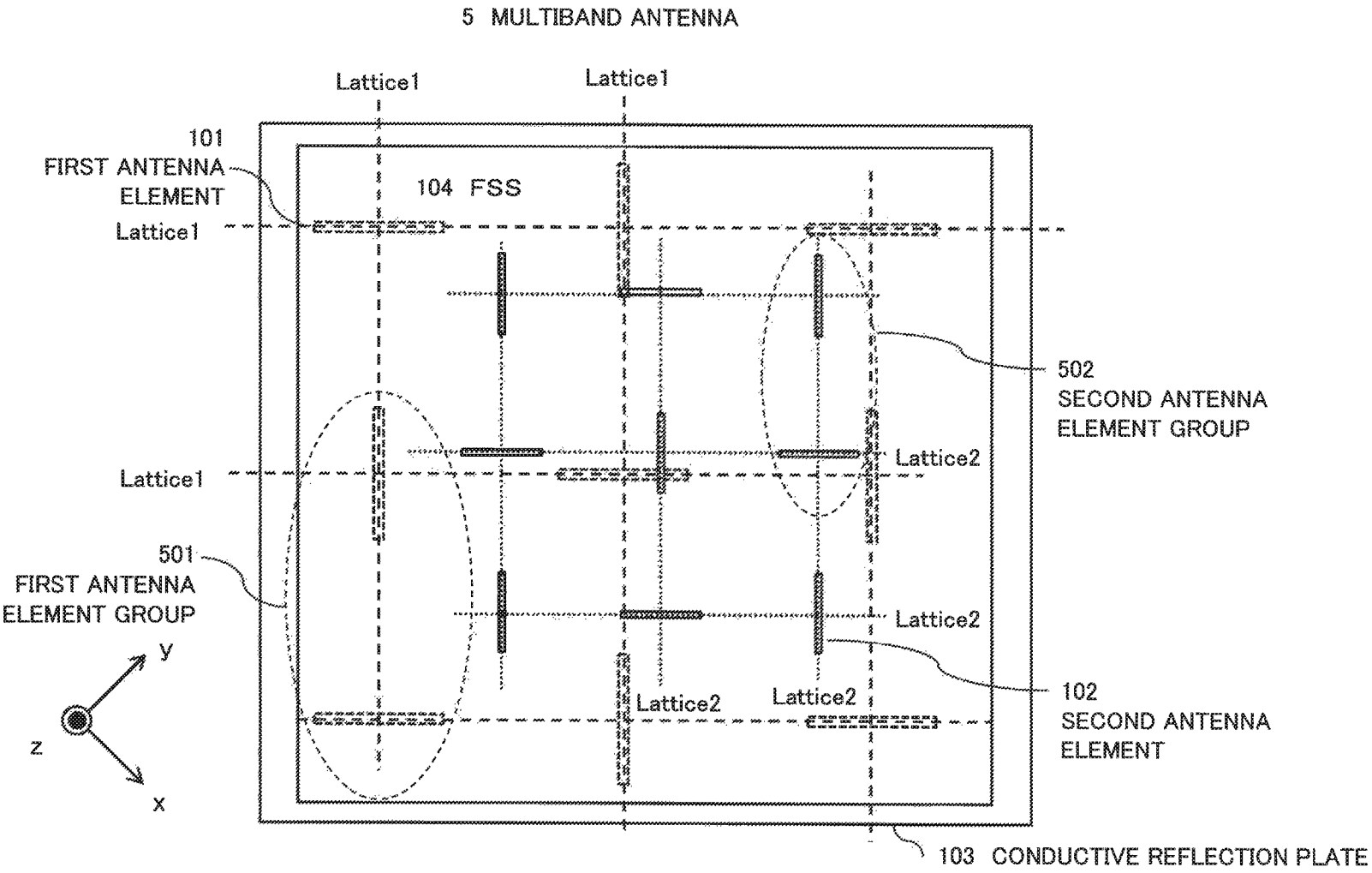
FIG. 59 is a top view illustrating a configuration of a multiband antenna 5 in a variation 23 of the present invention.

FIG. 59 is a top view of a multiband antenna 5 of a variation 23.

In the multiband antenna 5 of the present variation, pairs of first antenna elements 101 that constitute the first antenna element groups 501 are periodically arrayed in such a way that the middles (middle portions 509 in FIG. 50) in the extending directions of the respective antenna elements 101 coincide with respective lattice points of a square lattice Lattice 1, which is defined on a plate surface $\alpha$ of the conductive reflection plate 103. At the same time, the first antenna elements 101 are disposed in such a way that the extending directions of two antenna elements that are adjacent to each other are orthogonal to each other.

In other words, respective first antenna elements 101 positioned at lattice points adjacent to each other are disposed in such a way that the extending directions of the respective first antenna elements 101 are in an orthogonal relationship to each other and, on the extension line in the extending direction of one first antenna element 101, a vicinity of the middle in the extending direction of the other first antenna element 101 is positioned.

Employing the configuration described above enables each first antenna element 101 to suppress electromagnetic coupling with other four first antenna elements 101 in an orthogonal relationship by the effect described in the present example embodiment.

The second antenna elements 102 that constitute the second antenna element groups 502 are also disposed in a square lattice Lattice 2 as with the first antenna element groups 501.

Note that the square lattices Lattice 1 and Lattice 2 do not always have to have square unit lattices and the unit lattices may be, for example, rectangle unit lattices. In this case, it is possible to suppress electromagnetic coupling between an antenna element and four antenna elements that are present on the periphery thereof.

In addition, an interval between periodically arrayed antenna elements does not have be constant. If a plurality of antenna elements are arrayed at intervals in two directions that are parallel with the plate surface $\alpha$ of the conductive reflection plate 103 and are perpendicular to each other, the respective antenna elements may be directed in directions similar to those described above, which enables the above-described advantageous effects to be achieved.

<Variation 24>

Figure 60:
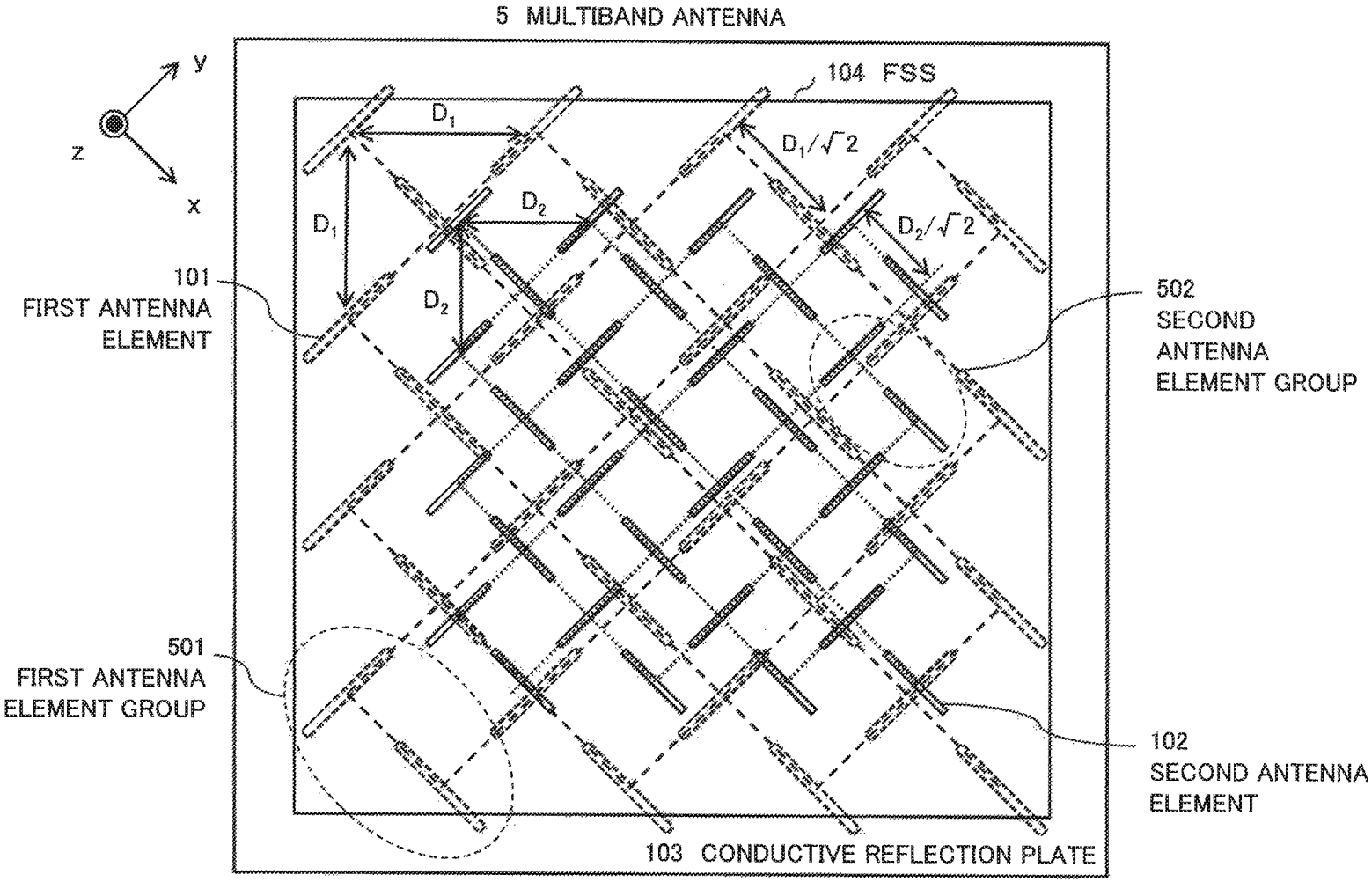
FIG. 60 is a top view illustrating a configuration of a multiband antenna 5 in a variation 24 of the present invention.

FIG. 60 is a top view of a multiband antenna 5 of a variation 24.

In the multiband antenna 5 of the present variation, the first antenna element groups 501 may, while retaining positional relations illustrated in FIG. 59, also be disposed into a square lattice form with an interval $D_1$. In this case, the inter-lattice point distance of the square lattice Lattice 1 becomes $D_1/\sqrt{2}$. Note that, in the present variation, the second antenna element groups 502 are also configured to have, in the square lattice Lattice 2, a disposition similar to the disposition of the first antenna element groups 501.

<Variation 25>

Figure 61:
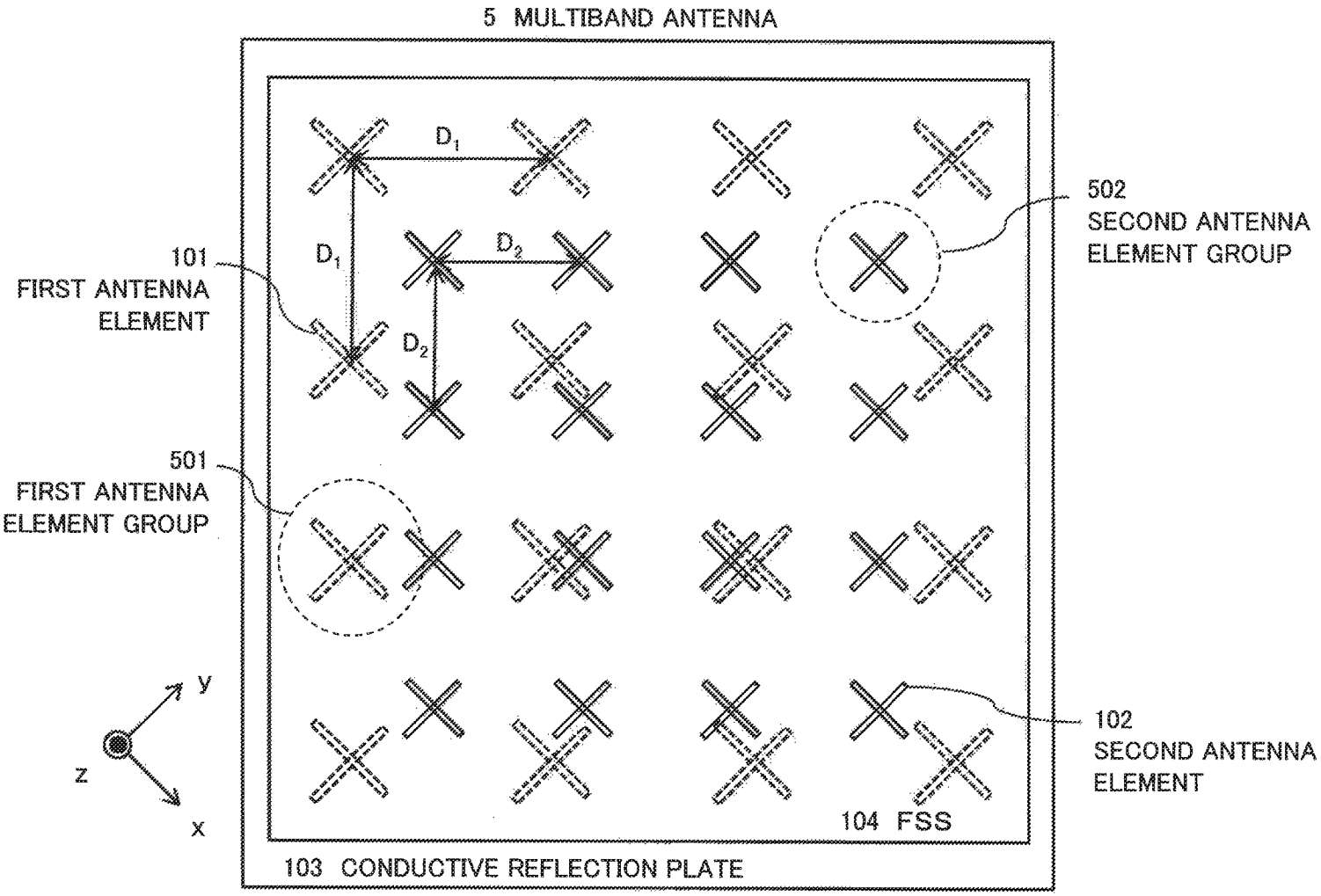
FIG. 61 is a top view illustrating a configuration of a multiband antenna 5 in a variation 25 of the present invention.

FIG. 61 is a top view of a multiband antenna 5 of a variation 25.

Figure 62:
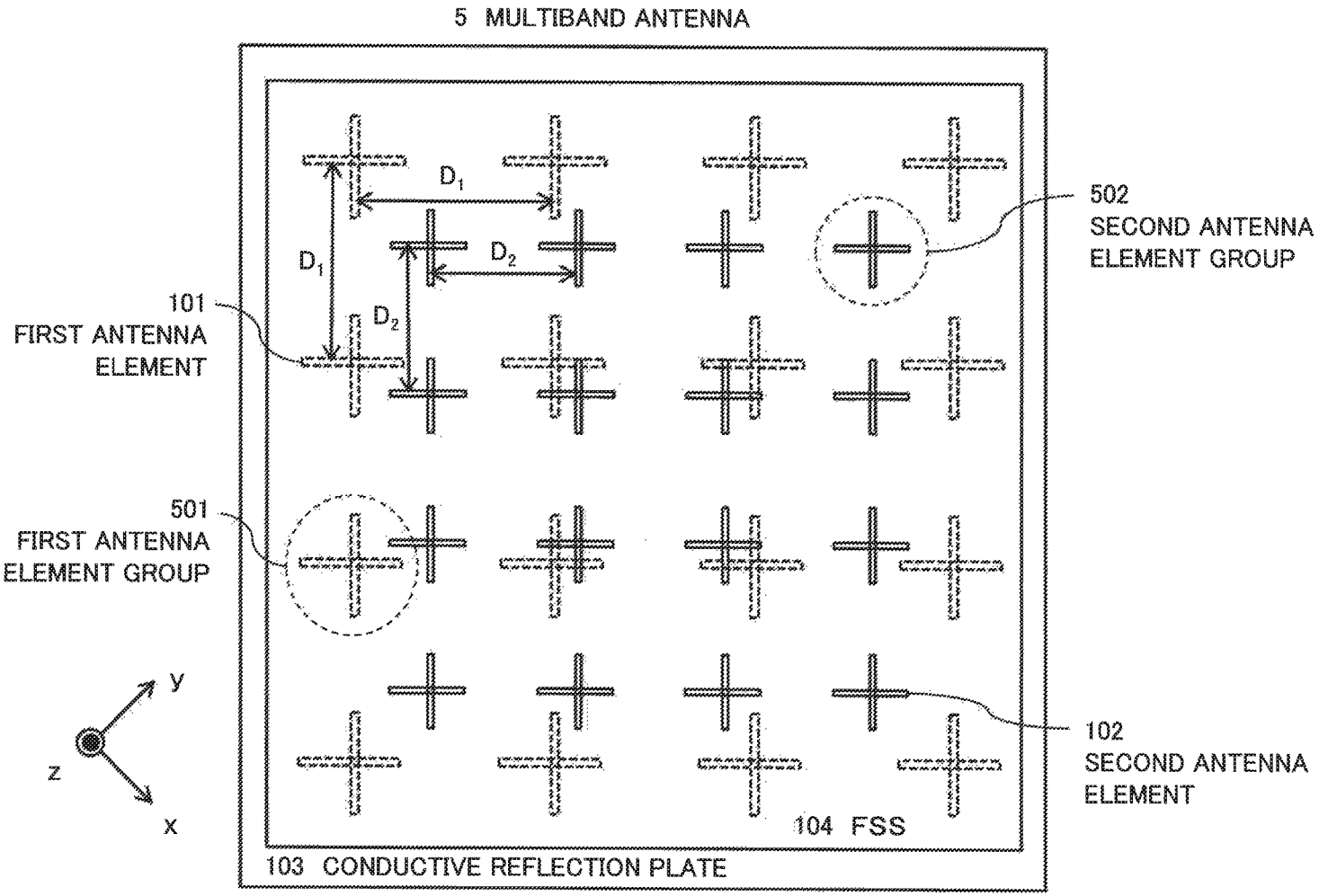
FIG. 62 is a top view illustrating another configuration of the multiband antenna 5 in the variation 25 of the present invention.

A pair of two first antenna elements 101 are in a relationship of being formed into dual polarization capable antenna elements in a manner described in FIG. 53 and crossing at right angles with to each other. The first antenna element groups 501 constitute an antenna array in a square shape with pairs of first antenna elements 101 arrayed in plurality at a constant interval $D_1$ in in-plane directions of the xy plane into an array shape as with the multiband antenna 1, which is illustrated in FIG. 1 and was described in the first example embodiment. Similarly, the second antenna element groups 502 constitute an antenna array in a square shape with pairs of second antenna elements 102, each pair of which are in a relationship of crossing at right angles with each other, arrayed in plurality at a constant interval $D_2$ in in-plane directions of the xy plane into an array shape. In this case, the multiband antenna 5 may, as with a case in FIG. 56 and the like, also perform beam forming with respect to each different frequency and each different polarized wave. In addition, the first antenna element groups 501 and the second antenna element groups 502 may be disposed as illustrated in FIG. 62. That is, the directions of a periodic array as an array antenna and the respective extending directions of cross shapes each of which is made up of two antenna elements that are formed into dual polarization capable antenna elements in a manner described in FIGS. 53 and 54 may be different from each other as illustrated in FIG. 61 or identical as illustrated in FIG. 62.

<Variation 26>

Figure 63:
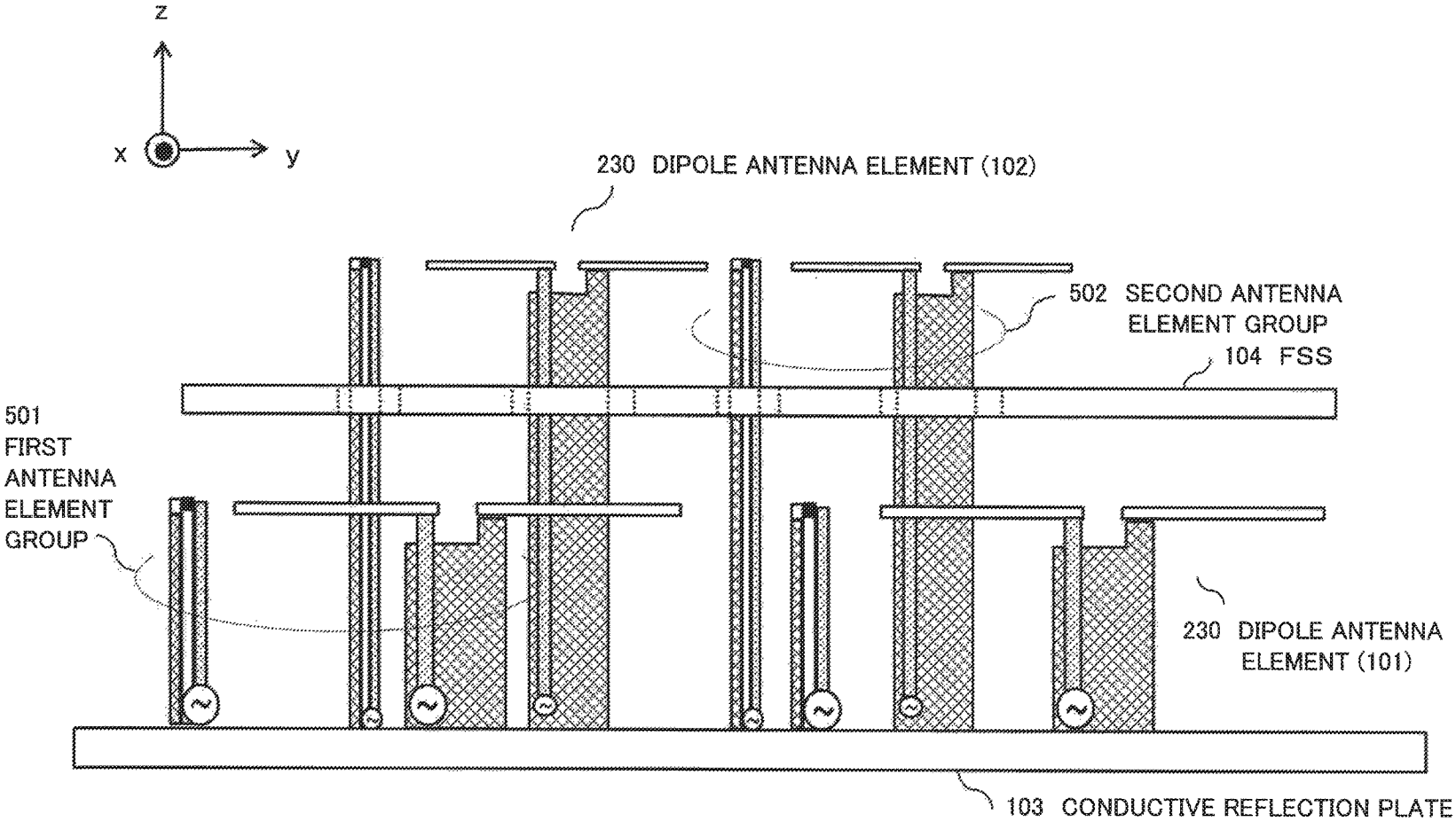
FIG. 63 is a plan view illustrating a configuration of a multiband antenna 5 in a variation 26 of the present invention.

FIG. 63 is a yz cross-sectional view of a multiband antenna 5 of a variation 26.

Although each of the first antenna elements 101 and the second antenna elements 102 in the present variation is configured with a dipole antenna element 230 of the variation 10, the antenna element may also be configured with a dipole antenna element 430 of the variation 19.

As described above, even when the first antenna elements 101 and the second antenna elements 102 are dipole antenna elements 230, vicinities of both ends of each antenna element can be considered to constitute electrical open-circuit planes when the antenna element is in resonance. In addition, a vicinity of the middle of each antenna element can be considered to constitute an electrical short-circuit plane. Therefore, a multiband antenna 5 may be provided that is capable of transmitting and receiving dual polarized waves and the whole of which is miniaturized by, while suppressing coupling between antenna elements capable of transmitting and receiving different polarized waves, disposing the respective antenna elements in proximity to one another.

Note that a pair of first antenna elements 101 and a pair of second antenna elements 102 the extending directions of each of which are in a perpendicular relationship to each other may be disposed, without being limited to the above described variations, in any manner within an allowable range of influence of electromagnetic coupling between the respective antenna elements on the resonance characteristics of the respective antenna elements. In addition, the multiband antenna 5 does not always have to be capable of transmitting and receiving dual polarized waves. Thus, the first antenna element groups 501 and the second antenna element groups 502 may, depending on uses, be configured with antenna elements that are capable of transmitting and receiving only a single polarized wave.

When beam forming is performed by means of an antenna array in the multiband antenna 5 illustrated in FIGS. 56 to 58 and FIGS. 60 to 62, it is more preferable that $D_1$ and $D_2$ be set at approximately a half of $\lambda_1$ and a half of $\lambda_2$, respectively, in terms of the purpose of reducing sidelobes, as described in the first example embodiment. However, $D_1$ and $D_2$ are not always limited to the values.

In the multiband antenna 5 illustrated in FIGS. 56 to 58 and FIGS. 60 to 62, each of the first antenna elements 101 and the second antenna elements 102 are periodically arrayed into a square lattice form. However, each of the first antenna elements 101 and the second antenna elements 102 may constitute an array antenna by being periodically arrayed into a lattice form the unit lattices of which are other shapes, such as a rectangle and a triangle. Each of the first antenna elements 101 and the second antenna elements 102 may also be arrayed into an array antenna one side of which is shorter than the other side and the whole of which is an elongated shape, such as a single row array and a double row array.

In the multiband antenna 5 illustrated in FIGS. 56 to 62, the first antenna elements 101 and the second antenna elements 102 may be configured with antenna elements described in the above-described other example embodiments and the variations or a combination thereof.

Note that words "middle", "perpendicular", "parallel", "square", and the like that were used in the above description are not limited to exact meanings thereof and are assumed to include meanings having a certain level of error as long as substantial advantageous effects are achieved based on the respective example embodiments.

Fourth Example Embodiment

Figure 64:
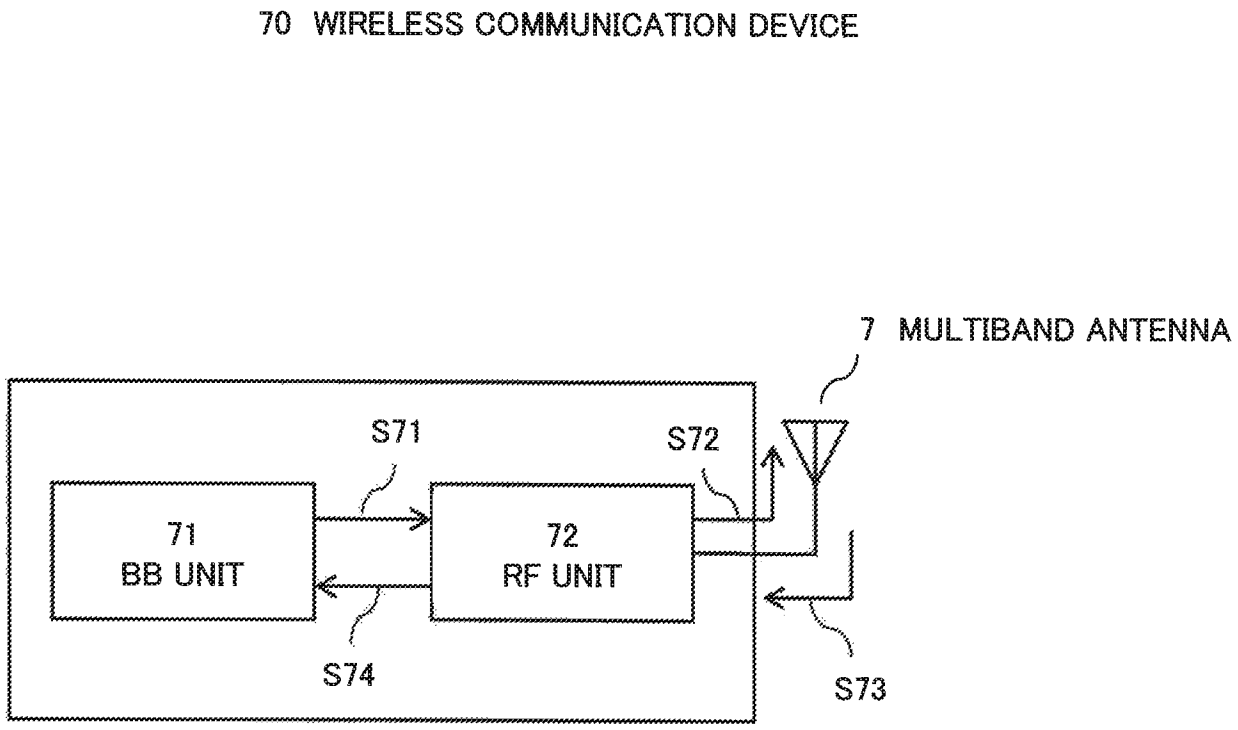
FIG. 64 is a block diagram illustrating a configuration of a wireless communication device 70 in a fourth example embodiment of the present invention.

A wireless communication device 70 according to a fourth example embodiment will be described. FIG. 64 is a block diagram schematically illustrating a configuration of a wireless communication device 70 according to the fourth example embodiment. The wireless communication device 70 includes a multiband antenna 7, a base band (BB) unit 71, and a radio frequency (RF) unit 72. The multiband antenna 7 is configured with a multiband antenna 1 of the first example embodiment, a multiband antenna 3 of the second example embodiment, or a multiband antenna 5 of the third example embodiment. The base band unit 71 treats a base band signal S71 before modulation or a reception signal after demodulation. The RF unit 72 modulates a base band signal S71 from the base band unit 71 and outputs a modulated transmission signal S72 to the multiband antenna 7. The RF unit 72 also demodulates a reception signal S73 that the multiband antenna 7 receives and outputs a reception signal S74 after demodulation to the base band unit 71. The multiband antenna 7 radiates a transmission signal S72 or receives a reception signal S73 that an antenna of another device or the like radiates.

Figure 65:
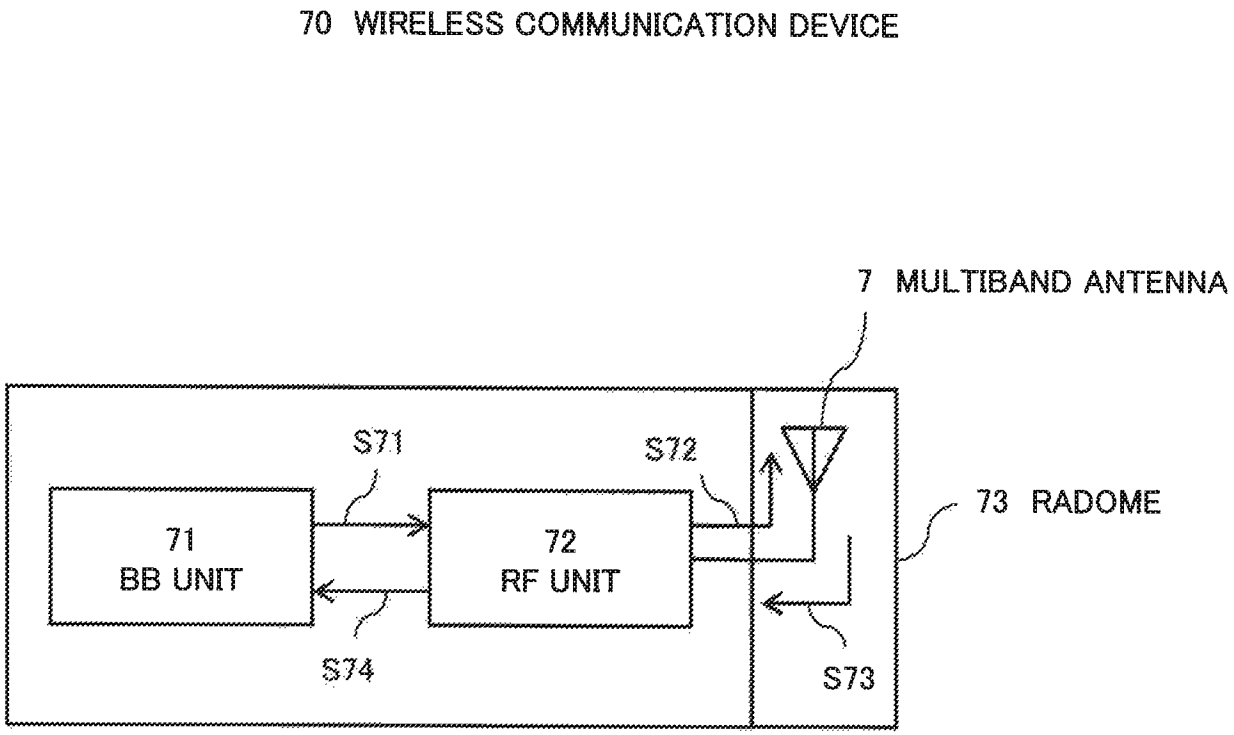
FIG. 65 is a block diagram illustrating another configuration of the wireless communication device 70 in the fourth example embodiment of the present invention.

The wireless communication device 70 of the present example embodiment may further include a radome 73 that mechanically protects the multiband antenna 7, as illustrated in FIG. 65. The radome 73 is, in general, configured with a dielectric.

As described above, it is possible to understand that the present configuration enables a wireless communication device 70 to be specifically configured that is capable of communicating with the outside wirelessly using the multiband antenna 7.

When a configuration in which a split ring resonator is used as an antenna element 200 of a multiband antenna 1 of the first example embodiment is employed for the multiband antenna 7 of the present configuration, the antenna tips are grounded. For this reason, differing from a conventional dipole antenna the tips of which are electrically opened, the multiband antenna 7 of the present configuration may discharge electrical charges of a lightning strike to a grounded conductor. The configuration enables a transceiver connected to an input terminal to be protected from surge voltage due to a lightning strike.

Note that, as a matter of course, the example embodiments and a plurality of variations described above may be combined within a range in which contents thereof do not conflict with each other. In addition, although, in the above-described example embodiments and variations, functions and the like of the respective components have been specifically described, the functions and the like may be changed in various ways within a range satisfying the claimed invention.

Although some example embodiments of the present invention have been described above, the example embodiments have been presented only as examples and are not intended to limit the scope of the invention. The example embodiments may be embodied in a variety of other forms, and various omissions, substitutions, and changes may be made without departing from the spirit of the invention. The example embodiments and variations thereof should be understood, as being included in the scope and spirit of the invention, to be included in the invention described in the claims and the range of equivalency thereof.

INDUSTRIAL APPLICABILITY

Examples of utilization of the present invention include a multiband antenna, a wireless communication device, and the like.

The present invention was described above using the above-described example embodiments as typical examples. However, the present invention is not limited to the above-described example embodiments. In other words, various modes that could be understood by a person skilled in the art may be applied to the present invention within the scope of the present invention.

This application claims priority based on Japanese Patent Application No. 2015-190531, filed on Sep. 29, 2015, the entire disclosure of which is incorporated herein by reference

REFERENCE SIGNS LIST

1, 3, 5, 7 Multiband antenna
101 First antenna element
102, 302 Second antenna element
103 Conductive reflection plate;
1031 Metamaterial reflection plate
1032 Periodic structure
1033 Opening
104, 304 FSS
105, 106, 306 Feeder
107 Opening
108 Unit cell
109 Conductive patch
110 Conductor portion
111 Void portion
112 Open stub
113 Conductive pin
200, 400 Antenna element
201 Ring-shaped conductor portion
202, 402 Conductive feeder
203 Conductive via
204 Feeding point
205, 2051, 2052 Dielectric layer
206 Conductive feeding GND portion
207 Split portion
208 Cut-out portion
209 Slit
210, 211 Conductor end portion
212 Second ring-shaped conductor portion
213, 215 Conductive via
214 Second conductive feeding GND portion
217 Second split portion
240, 241, 242 Conductor portion
220 Coaxial cable
221 Core wire
222 Conductive feeder
223 External conductor
224 Clearance
225 Connector
226 External conductor
227 Core wire
230, 430 Dipole antenna element
231 Conductive radiation portion
232 Connecting point
410, 411 Conductive line
412 Cut-out conductor end portion
413 Bridging conductor
414 Conductive radiation portion
415 Auxiliary conductor pattern
416 Conductive via
3041 Second FSS
3021 Third antenna element
501 First antenna element group
502 Second antenna element group
509 Middle portion
510 End portion
70 Wireless communication device
71 Base band unit
72 RF unit
73 Radome

What is claimed is:

1. A multiband antenna comprising:

a conductive reflection plate;

a frequency selective surface that is disposed so as to at least partially face the conductive reflection plate, that transmits therethrough electromagnetic waves in a first frequency band, that reflects thereon electromagnetic waves in a second frequency band that is a higher frequency band than the first frequency band, and that has a plurality of openings;

a plurality of first antenna elements that are disposed in a region sandwiched between the conductive reflection plate and the frequency selective surface and that are tuned to a first frequency included in the first frequency band; and a plurality of second antenna elements that are disposed on a surface opposite a surface of the frequency selective surface facing the first antenna elements, that are fed through feeders passing through the openings, and that are tuned to a second frequency included in the second frequency band.

2. The multiband antenna according to claim 1, wherein a diameter of each of the openings is equal to or smaller than a half wavelength of the second frequency.

3. The multiband antenna according to claim 1, wherein the frequency selective surface is configured by periodically arraying unit cells, and each of the openings is formed by removing the unit cell.

4. The multiband antenna according to claim 1, wherein the openings are configured with slots through which the feeders are passed.

5. The multiband antenna according to claim 1, wherein the plurality of first antenna elements are periodically arrayed at an interval corresponding to a wavelength of the first frequency, and the plurality of second antenna elements are periodically arrayed at an interval corresponding to a wavelength of the second frequency.

6. The multiband antenna according to claim 1, wherein each of the first antenna elements and the second antenna elements includes:

a ring-shaped conductor portion in which a portion of a ring-shaped conductor is cut out by a split portion; and the feeder one end of which is electrically connected to the ring-shaped conductor portion and that is configured to bridge an opening formed inside the ring-shaped conductor portion.

7. The multiband antenna according to claim 6, wherein each of the first antenna elements and the second antenna elements further includes a connection conductor one end of which is electrically connected to the ring-shaped conductor portion, the other end of which is electrically connected to the conductive reflection plate, and that passes through the opening that the frequency selective surface has.

8. The multiband antenna according to claim 7, wherein the connection conductor is connected to a side of the ring-shaped conductor portion on a side opposite a side on which the split portion is formed.

9. The multiband antenna according to claim 6, wherein the first antenna elements and the second antenna elements further includes at least one conductive radiation portion that is electrically connected to the ring-shaped conductor portion to extend length of the ring-shaped conductor portion in an extension direction of a side including the split portion.

10. A multiband antenna comprising:

a conductive reflection plate;

a frequency selective surface that is disposed so as to at least partially face the conductive reflection plate, that transmits therethrough electromagnetic waves in a first frequency band and that reflects thereon electromagnetic waves in a second frequency band that is a higher frequency band than the first frequency band;

a plurality of first antenna elements that are disposed in a region sandwiched between the conductive reflection plate and the frequency selective surface and that are tuned to a first frequency included in the first frequency band; and a plurality of second antenna elements that are disposed on a surface opposite a surface of the frequency selective surface facing the first antenna elements and that are tuned to a second frequency included in the second frequency band.

11. A wireless communication device comprising a multiband antenna according to claim 1.

* * * * *